US007581998B2

(12) United States Patent
Fujita et al.

(10) Patent No.: US 7,581,998 B2
(45) Date of Patent: Sep. 1, 2009

(54) METHOD FOR REGULATING AGROUND ELECTRODE POSITION IN SPARK PLUG

(75) Inventors: Shigeo Fujita, Nagoya (JP); Masahiro Enuma, Aichi (JP); Shinichiro Mitsumatsu, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 293 days.

(21) Appl. No.: 11/220,636

(22) Filed: Sep. 8, 2005

(65) Prior Publication Data

US 2007/0054581 A1 Mar. 8, 2007

(51) Int. Cl.
*H01T 21/02* (2006.01)

(52) U.S. Cl. ..... 445/7

(58) Field of Classification Search ..... None
See application file for complete search history.

(56) References Cited

U.S. PATENT DOCUMENTS

| | | | | |
|---|---|---|---|---|
| 6,215,234 | B1 * | 4/2001 | Abe et al. | 313/141 |
| 6,592,418 | B2 * | 7/2003 | Ito et al. | 445/4 |
| 6,695,663 | B2 | 2/2004 | Ito et al. | |
| 6,790,113 | B1 | 9/2004 | Fujita | |
| 6,893,310 | B2 | 5/2005 | Nakatani | |
| 7,043,813 | B2 * | 5/2006 | Hanai | 29/407.04 |
| 2002/0193033 | A1 * | 12/2002 | Nasu et al. | 445/7 |
| 2004/0029480 | A1 * | 2/2004 | Fujita et al. | 445/7 |
| 2004/0078972 | A1 | 4/2004 | Hanai | |
| 2005/0042965 | A1 * | 2/2005 | Oda et al. | 445/7 |

FOREIGN PATENT DOCUMENTS

| | | | |
|---|---|---|---|
| EP | 0 540 159 | A1 | 5/1993 |
| JP | 7-22157 | A | 1/1995 |
| JP | 11-121143 | | 4/1999 |
| JP | 11-219773 | A | 8/1999 |
| JP | 2000-164320 | A | 6/2000 |
| JP | 2002-164149 | A | 6/2002 |
| JP | 2002-231412 | A | 8/2002 |
| JP | 2002-313525 | A | 10/2002 |
| JP | 2004-146101 | | 5/2004 |

* cited by examiner

*Primary Examiner*—Toan Ton
*Assistant Examiner*—Britt Hanley
(74) *Attorney, Agent, or Firm*—Sughrue Mion, PLLC

(57) ABSTRACT

A method and apparatus for manufacturing a spark plug, the spark plug being defined herein, the method including a center electrode position measuring step of measuring an X-directional position of the front end of the center electrode; a regulation member positioning step of positioning an X-directional position of a regulation member based on the X-directional position of the front end of the center electrode measured in the center electrode position measuring step, the regulation member regulating an X-directional position of a front end surface of the ground electrode when the ground electrode is pressed and bent in a Y direction; and a gap forming step of using the regulation member to regulate the X-directional position of the front end surface of the ground electrode while pressing and bending the ground electrode in the Y direction so as to form the spark discharge gap; wherein: the X direction and the Y direction are as defined herein.

9 Claims, 45 Drawing Sheets

(Xf = Xg + Q + Sb)

$(Xd = Xf + \Delta Xg + \Delta X1)$
$(Xd = Xf + \Delta Xr + \Delta X1)$

METHOD FOR REGULATING AGROUND ELECTRODE POSITION IN SPARK PLUG

BACKGROUND OF THE INVENTION

1. Field of the Invention

The present invention relates to a method and apparatus for manufacturing an internal combustion spark plug.

2. Description of the Related Art

Various methods and apparatus for manufacturing spark plugs for internal combustion engines have heretofore been proposed (see, for example, Japanese Patent. Laid-Open No. 121143/1999 (page 10, FIG. 1) and EP 0540159 A1 (FIG. 4)).

3. Problems to be Solved by the Invention

In recent years, there has been a demand for spark plugs for internal combustion engines capable of igniting a fuel gas at a proper timing under any of various conditions. To this end, recent spark plugs face severe requirements as to accuracy of an X-directional position of a front end surface (or rather a fee end surface) of a ground electrode that is bent and formed over a front end of a center electrode for the spark gap. This is because the X-directional position or the covering length of the ground electrode extending over the front end of the center electrode is critical to ignition timing of fuel gas injected into present day high performance engine cylinders.

Notably, the covering length of the ground electrode herein means a distance from an X-directional position of the front end surface (i.e., free end surface) of the ground electrode to an X-directional position of the front end surface of the center electrode, as measured in an X direction that is transverse to an axis direction (i.e., Y direction) of a metal shell of a spark plug and normal to a width direction of a fixation portion of the ground electrode formed on the ground electrode.

If the X-directional position of the ground electrode is not fixed at an appropriate position with respect to that of the front end of the center electrode, for instance, if the front end portion of the ground electrode is positioned too far away or too close to the front end of the center electrode, the ignition tinting of the fuel gas by spark discharge of the spark plug in the engine cylinder is delayed or hastened, resulting in reduced total combustion efficiency of the engine. This is because the covering length of the ground electrode extending over the front end of the center electrode affects an approach of the injected fuel gas to the spark gap or aggravates propagation of the ignited gas through the engine cylinder, even if the spark occurs properly at the spark gap formed between the ground and center electrodes of the spark plug. Therefore, since constant-ignition timing is required to a high degree in present day high performance internal combustion engines, the covering length or X directional position of the ground electrode must be fixed or controlled with very small deviation as possible deviating from a predetermined length thereof in manufacturing high performance spark plugs.

In conventional methods and apparatus for manufacturing spark plugs, it has been difficult to fix the X-directional position of the front end surface of the ground electrode at a constant predetermined position with respect to the front end of the center electrode. For example, in the manufacturing method and apparatus disclosed in Japanese Patent Laid-Open No. 121143/1999 (page 10, FIG. 1), the ground electrode is pressed and bent for a spark gap without regulating the X-directional position of the front end surface of the ground electrode with respect to the front end of the center electrode.

On the other hand, in the manufacturing method and apparatus disclosed in EP 0540159 A1 (FIG. 4), the ground electrode formed on the metal shell is pressed and bent while the X-directional position of the front end surface of the ground electrode is regulated. However, because the insulator, center electrode inserted therein and the metal shell holding the insulator and having the pre-bent ground electrode are assembled afterwards, it is difficult to keep or re-fix a constant X-directional positional relationship between the front end of the center electrode and the front end of the ground electrode in the assembled spark plug. This is because a large dimensional deviation is generated during the assembly of these components into the spark plug.

SUMMARY OF THE INVENTION

It is therefore a first object of the present invention to provide a method and apparatus for manufacturing a spark plug, in which the X-directional position of a front end surface of a ground electrode is fixed at a constant predetermined position so as to result in only a small deviation with respect to the X-directional position of a front end of the center electrode during manufacture of the spark plug.

Another object of the present invention is to provide a method and apparatus for manufacturing a spark plug in which the Z-directional position of a front end surface of the ground electrode is fixed so as to result in only a small deviation with respect to the Z-directional position of a front end surface of the center electrode, the Z-direction being perpendicular (or rather normal) to the central axis of the metal shell on which the ground electrode is formed.

The above objects of the invention have been achieved by providing a method for manufacturing a spark plug, the spark plug including: a cylindrical insulator having an axial hole or bore penetrating said cylindrical insulator in an axial direction thereof; a center electrode inserted into said axial hole of said insulator and having a front end projecting beyond a front end surface of said insulator; a metal shell surrounding said insulator; and a ground electrode fixedly attached to said metal shell by a fixation portion and bent to form a spark discharge gap between a front end portion of said ground electrode and said frond end of said center electrode; said method comprising: measuring an X-directional position of said front end of said center electrode; positioning an X-directional position of a regulation member based on said X-directional position of said front end of said center electrode measured in said center electrode position measuring step, said regulation member regulating an X-directional position of a front end surface of said ground electrode when said ground electrode is pressed and bent in a Y direction; and forming said spark discharge gap using said regulation member to regulate said X-directional position of said front end surface of said ground electrode while pressing and bending said ground electrode in said Y direction so as to form said spark discharge gap; wherein: said X direction designates, of directions perpendicular (or rather transverse) to a central axis of said metal shell and perpendicular(or rather normal) to a width direction of said fixation portion of said ground electrode, a direction from said fixation portion of said ground electrode toward said central axis of said metal shell; and said Y direction designates a direction from a front end side of said internal combustion spark plug to a base side thereof along said central axis of said metal shell.

More specifically, according to the method of the invention, the X-directional position of the front end of the center electrode is firstly determined. Next, the X-directional position of the regulation member for regulating the X-directional position of the front end surface of the ground electrode is predetermined based on the X-directional position of the front end of the center electrode. Then, the X-directional position of the front end surface of the ground electrode is regulated or controlled by the regulation member that is positioned at the predetermined X-directional position, while the ground electrode is pressed and bent in the Y direction so as to form a spark discharge gap between the center and ground electrodes.

An advantage of this method according to the invention is that even if the position of the front end of the center electrode differs from one spark plug to another, the X-directional position of the front end surface of the ground electrode with respect to that of the front end of the center electrode can be made constant, and resultantly, a spark plug having a small X-directional positional deviation of the ground electrode deviating from its predetermined position with respect to a X-directional position of the front end surface of the center electrode can be made by mass production. Thereby, a high-quality spark plug providing a constant ignition timing for the fuel gas under various engine conditions is attained.

As used herein, when the center electrode includes a noble metal tip fixedly attached to the front end of a center electrode body, a distal end of the noble metal tip corresponds to the front end of the center electrode.

Another advantage of the method according to the invention is that even if the ground electrode includes a noble metal tip formed on a side surface of the ground electrode, an X-directional position of the noble metal tip of the ground electrode with respect to that of the front end of the center electrode can be accurately positioned by positioning the X-directional position of the front end surface of the ground electrode with respect to the front end of the center electrode by means of the regulation member. The regulation member regulates or controls an X directional movement of the position of the front end surface of the ground electrode when the ground electrode is bent to form an accurate spark gap between the center electrode and the metal tip formed on the ground electrode. Accordingly, even if the position of the front end of the center electrode differs from one spark plug to another, deviating in a radial direction from a central axis of the spark plug due to a deviation in assembly of the spark plug, the X-directional position of the noble metal tip of the ground electrode with respect to that of the front end of the center electrode can be made constant.

Further, in a preferred embodiment, the X-directional position of the regulation member is positioned such that the front end surface of the ground electrode is regulated or fixed within a predetermined range in the X direction with respect to the front end of the center electrode once the gap forming step has been completed. Namely, the front end surface of the ground electrode will have been fixed by the time that the gap forming step has been completed.

The deviation range is preferably ±0.1 mm.

The ground electrode may include a convex noble metal tip projecting toward the center electrode so that a spark discharge gap is formed between the noble metal tip of the ground electrode and the front end of the center electrode. The X-directional position of the regulation member determines the X-directional position of the front end of the ground electrode. As such, the noble metal tip formed on the ground electrode can be positioned within a predetermined range or deviation in the X direction with respect to the front end of the center electrode once the gap forming step has been completed. Accordingly, the X-directional position of the noble metal tip formed on the ground electrode with respect to the front end of the center electrode can be made constant within a predetermined range.

In another preferred embodiment, the regulation member has a regulation abutment surface which abuts against the front end surface of the ground electrode in the gap forming step. Preferably, the front end surface of the ground electrode abuts against the regulation abutment surface of the regulation member in forming the spark gap, and the X-directional position of the front end surface of the ground electrode is regulated during formation of the spark plug. It is most preferable to position the X-directional position of the front end surface of the ground electrode with respect to the front end of the center electrode and to almost simultaneously bend the ground electrode in forming the spark gap by using the regulation member. This is because simultaneous positioning and bending is simple, contributes to a reduction in manufacturing cost, and provides a spark plug having a small deviation in covering length or distance of the ground electrode extending over the front end of the center electrode, deviating from the predetermined length in the X-direction.

In another preferred embodiment, the X-directional position of the regulation abutment surface of the regulation member is fixed at least by the time that the spark discharge gap is formed after the ground electrode has been pressed. In other words, when the spark discharge gap is formed in a gap forming step (wherein the ground electrode is completely bent), the X-directional position of the front end surface of the ground electrode with respect to that of the front end of the center electrode is regulated or controlled. As one example, the X-directional position of the regulation abutment surface of the regulating member is fixed before pressing and bending the ground electrode in the Y direction. As another example, when the ground electrode is pressed and bent in the Y direction, the regulation abutment surface is moved in the X direction together with the front end surface of the ground electrode while abutting against the front end surface of the ground electrode to a predetermined X-directional position of the regulation abutment surface of the regulation member, before the spark discharge gap is formed.

In yet another preferred embodiment, the ground electrode may be bent while the X-directional position of the front end surface of the ground electrode is partly regulated by the regulation abutment surface of the regulation member. The regulation abutment surface of the regulation member may then be fixed such that that the X-directional position of the front end surface of the ground electrode is finally regulated or fixed. Accordingly, the X-directional position of the front end surface of the ground electrode can be completely regulated by the X-directional position of the regulation abutment surface of the regulation member.

In yet another preferred embodiment, the method may further comprise returning the regulation member to its original position after forming the spark gap (in a gap forming step). The returning step includes a separation step wherein the regulation member abutting against the ground electrode moves in a direction including the X-direction so as to separate the regulation member from the ground electrode without varying the distance of the spark discharge gap formed in the gap-forming step.

When the regulation member abutting against the ground electrode is separated from the ground electrode in the returning step, and the regulation member is returned to its original position waiting for the next regulation member positioning step, the spark gap distance should neither be affected nor varied. Therefore, in the separation step, the regulation member abutting against the ground electrode is preferably moved in the X direction so as to separate the regulation member from the ground electrode.

Further, in yet another preferred embodiment, the ground electrode is pressed and bent in the Y direction by a pressure member having a pressure abutment surface abutting against the ground electrode. This pressure abutment surface of the pressure member is surface-treated such that a coefficient of friction between the pressure abutment surface of the pressure member and the ground electrode abutment surface of the ground electrode is not higher than 0.2, according to the invention. When the friction coefficient is not higher than 0.2, the ground electrode can easily slide on the pressure abutment surface of the pressure member in the X direction so that the ground electrode is smoothly deformed not only in the Y direction but also in the X direction. As a result, the X-directional position of the front end surface of the ground electrode can be accurately regulated by the regulation member.

As for the surface treatment applied to the pressure abutment surface of the pressure member and/or also applied to the regulation abutment surface of the regulation member abutting against the ground electrode, a low friction coefficient material such as DLC (diamond-like carbon) and a lubricating oil is preferably coated on at least the abutment surface of the pressure member. Among them, a DLC coating is most preferred, because it is hard and has a low coefficient of friction. The pressure abutment surface may be polished. In addition, the pressure abutment surface may be cut such that a plurality of convex portions each having a substantially triangular shape in section tapered in the Y direction and extending in the X direction are formed as an array in the pressure abutment surface. By thus treating the convex portions abutting against the abutment surface of the ground electrode, the abutment surface of the ground electrode can move smoothly in the X direction while the ground electrode abutment surface of the ground electrode is pressed by the pressure member. Accordingly, the friction drag action between the ground electrode and the abutment surface of the pressure member is reduced so that the ground electrode can be deformed and slide smoothly in the X direction in forming the spark gap.

The pressure member may be integrally formed with the regulation member or may be formed independent and separate therefrom.

Further, the aforementioned method may further include: a deviation measuring step of measuring a Z-directional deviation of the front end surface of the ground electrode deviating in a direction normal to the X and Y directions with respect to the front end of the center electrode, the deviation measuring step being carried out after the gap forming step or the returning step; and a deviation adjusting step of adjusting the Z-directional position of the front end surface of the ground electrode based on the deviation measured in the deviation measuring step, so that the front end surface of the ground electrode is located within a predetermined range in the Z direction with respect to the front end of the center electrode. The Z direction designates a direction normal to the axis of the metal shell and also normal to the X direction. Accordingly, not only is it possible to adjust the X-directional position of the front end surface of the ground electrode with respect to the front end of the center electrode in the spark discharge gap forming step, it is also possible to adjust the Z-directional position of the front end surface of the ground electrode with respect to the front end of the center electrode in the deviation adjusting step. Thus, even if the Z-directional position of the front end surface of the ground electrode with respect to the front end of the center electrode shifts and is located outside a predetermined range of deviation when the spark discharge gap is formed, the Z-directional position of the front end surface of the ground electrode can be adjusted (corrected) to be within the predetermined range. When the ground electrode includes a noble metal tip in its front end portion, the Z-directional position of the noble metal tip of the ground electrode with respect to the front end of the center electrode can be also adjusted by adjusting the Z-directional position of the front end surface of the ground electrode with respect to the front end of the center electrode in the aforementioned manner.

When the ground electrode includes a convex noble metal tip formed thereon, the noble metal tip projecting toward the center electrode such that the spark discharge gap is formed between the noble metal tip of the ground electrode and the front end of the center electrode, the method may further include: a deviation measuring step of measuring a Z-directional deviation of the noble metal tip of the ground electrode with respect to the front end of the center electrode, the deviation measuring step being carried out after the gap forming step or the returning step; and a deviation adjusting step of adjusting the Z-directional position of the noble metal tip of the ground electrode based on the deviation measured in the deviation measuring step, so that the noble metal tip of the ground electrode is located within a predetermined range in a Z direction with respect to the front end of the center electrode. The Z direction designates a direction perpendicular to the central axis of the metal shell and perpendicular to the X direction.

Accordingly, not only is it possible to adjust the X-directional position of the noble metal tip of the ground electrode (or the front end surface of the ground electrode) with respect to the front end of the center electrode in the spark discharge gap forming step, it is also possible to adjust the Z-directional position of the noble metal tip of the ground electrode with respect to the front end of the center electrode in the deviation adjusting step. Thus, even if the Z-directional position of the noble metal tip of the ground electrode with respect to the front end of the center electrode shifts and is located outside a predetermined deviational range when the spark discharge gap is formed, the Z-directional position of the noble metal tip of the ground electrode can be adjusted (corrected) to be within the predetermined range.

Further, the aforementioned method may include: a gap size measuring step of measuring a gap size of the spark discharge gap after the deviation adjusting step; and a gap adjusting step of regulating the X-directional position of the front end surface of the ground electrode while pressing and bending the ground electrode in the Y direction to thereby adjust the gap size within a predetermined range based on the gap size measured in the gap size measuring step.

When deviation adjustment is performed on the ground electrode in the deviation adjusting step, there is a concern that the gap size of the spark discharge gap may change so as to be outside a predetermined range. This concern is addressed by measuring the gap size after the deviation adjusting step, and the gap size is adjusted to be within the predetermined range based on the measured gap size. Accordingly, even when the gap size is outside the predetermined range due to the deviation adjusting step, the gap size can be adjusted to be within the predetermined range.

The gap size is preferably set at a value within the predetermined range or slightly larger than the predetermined range in the spark discharge gap forming step prior to the gap adjusting step, and any slight variation in gap size incurred in the deviation adjustment step is corrected in the gap adjusting step. In such manner, the distance that the ground electrode is pressed in the Y direction in the gap size adjusting step becomes slight. Accordingly, deviation of the ground electrode in the Z direction with respect to the center electrode in the gap adjusting step becomes extremely slight, so that there is no concern that the deviation is outside the predetermined range due to the gap adjustment.

Further, the aforementioned method for manufacturing the spark plug may be adapted so that in the gap forming step, the spark discharge gap is formed so that the gap size of the spark discharge gap has a first gap size value; and in the gap adjusting step, the gap size is adjusted to have a second gap size value smaller than the first gap size value.

As described above, when deviation adjustment is performed on the ground electrode in the deviation adjusting step, the gap size of the spark discharge gap may change.

To cope with the change in the gap size, the spark discharge gap is formed in the gap forming step so that the gap size has a first gap size value, and the gap size is adjusted to a second gap size value smaller than the first gap size value in the gap adjusting step after the deviation adjusting step. In such manner, the gap size can be adjusted to have the second gap size value surely within a predetermined range due to gap adjustment by application of pressure in the gap adjusting step.

The above object of the invention has also been achieved by providing an apparatus for manufacturing a spark plug, the spark plug comprising: a cylindrical insulator having an axial hole (or rather bore) penetrating said cylindrical insulator in an axial direction thereof; a center electrode inserted into said axial hole of said insulator and having a front end projecting beyond a front end surface of said insulator; a metal shell surrounding said insulator; and a ground electrode fixedly attached to said metal shell by a fixation portion and bent to form a spark discharge gap between a front end portion of said ground electrode and said front end of said center electrode; said apparatus comprising: a center electrode position measuring unit for measuring an X-directional position of said front end of said center electrode; a pressure member for pressing and bending said ground electrode in a Y direction to thereby form said spark discharge gap between said front end of said center electrode and said front end surface of said ground electrode; a regulation member for regulating an X-directional position of said front end surface of said ground electrode when said ground electrode is pressed and bent by said pressure member; and a positioning unit for positioning an X-directional position of said regulation member based on said X-directional position of said front end of said center electrode measured by said center electrode position measuring unit; wherein: said X-direction designates, of directions perpendicular (or rather transverse) to a central axis of said metal shell and perpendicular (or rather normal) to a width direction of said fixation portion of said ground electrode, a direction from said fixation portion of said ground electrode toward said central axis of said metal shell; and said Y-direction designates a direction from a front end side of said internal combustion spark plug to a base side thereof along said central axis of said metal shell.

The apparatus for manufacturing a spark plug according to the invention includes a center electrode position measuring unit for measuring the X-directional position of the front end of the center electrode, a pressure member for pressing and bending the ground electrode to thereby form the spark discharge gap, a regulation member for regulating the X-directional position of the front end surface of the ground electrode, and a positioning unit for positioning the X-directional position of the regulation member based on the X-directional position of the front end of the center electrode as measured by the center electrode position measuring unit. Accordingly, when the inventive apparatus is used, the X-directional position of the front end surface of the ground electrode with respect to the front end of the center electrode can be made constant while the spark discharge gap is formed.

When the center electrode includes a center electrode body portion and a noble metal tip fixedly attached to the front end of the center electrode body portion, the front end of the noble metal tip corresponds to the front end of the center electrode.

When the ground electrode includes a noble metal tip in its front end portion, the X-directional position of the noble metal tip of the ground electrode with respect to the front end of the center electrode can be positioned (adjusted) by positioning (adjusting) the X-direction position of the front end surface of the ground electrode with respect to that of the front end of the center electrode by means of the regulation member. Accordingly, in this case, the X-directional position of the noble metal tip of the ground electrode with respect to the front end of the center electrode can be made constant while the spark discharge gap is formed.

In a preferred embodiment, the positioning unit positions the X-directional position of the regulation member so that the front end surface of the ground electrode will be located within a predetermined range in the X direction with respect to the front end of the center electrode once formation of the spark discharge gap by the pressure member has been completed.

In yet another preferred embodiment, the X-directional position of the regulation member is positioned by the positioning unit so that the front end surface of the ground electrode is located within a predetermined range in the X direction with respect to the front end of the center electrode once formation of the spark discharge gap by the pressure member has been completed. Accordingly, the X-directional position of the front end surface of the ground electrode with respect to that of the front end of the center electrode can be made constant within a predetermined range.

Alternatively, the spark plug may be adapted so that the ground electrode includes a convex noble metal tip in the front end portion thereof, the noble metal tip projecting toward the center electrode; the spark discharge gap is formed between the noble metal tip of the ground electrode and the front end of the center electrode; and the positioning unit positions the X-directional position of the regulation member so that the noble metal tip of the ground electrode will be located within a predetermined range in the X direction with respect to the front end of the center electrode once formation of the spark discharge gap by the pressure member has been completed. Accordingly, the X-directional position of the noble metal tip of the ground electrode with respect to the front end of the center electrode can be made constant within the predetermined range.

Further, any one of the aforementioned apparatuses may be adapted so that the regulation member has a regulation abutment surface which abuts against the front end surface of the ground electrode.

In yet another preferred embodiment, the regulation member has a regulation abutment surface for abutting against the front end surface of the ground electrode. Accordingly, the front end surface of the ground electrode abuts against the regulation abutment surface of the regulation member so that the X-directional position of the front end surface of the ground electrode is regulated. In such manner, the X-directional position of the front end surface of the ground electrode with respect to the front end of the center electrode can be regulated by the regulation member having a simple structure. Thus, the cost is low.

The aforementioned apparatus may further include a fixation unit for fixing an X-directional position of the regulation abutment surface of the regulation member. The X-directional position of the regulation abutment surface of the regulation member is fixed by the fixation unit at least by the time that the spark discharge gap is formed after the ground electrode has been pressed. Thus, the X-directional position of the front end surface of the ground electrode with respect to the front end of the center electrode can surely be regulated when the spark discharge gap is formed. When the ground electrode includes a noble metal tip in its front end portion, the X-directional position of the noble metal tip of the ground electrode with respect to the front end of the center electrode can be regulated by regulating the X-directional position of the front end surface of the ground electrode with respect to the front end of the center electrode as described above.

For example, the fixation unit according to the invention may fix the X-directional position of the regulation abutment surface of the regulation member before the pressure member presses and bends the ground electrode in the Y direction. Alternatively, when the ground electrode is pressed and bent in the Y direction, the X-directional position of the regulation abutment surface of the regulation member may be not fixed but the regulation abutment surface of the regulation member is moved in the X direction together with the front end surface of the ground electrode while abutting against the front end surface of the ground electrode. In this case, the X-direction position of the regulation abutment surface is fixed before the ground electrode is completely bent (before the spark discharge gap is formed).

Further, any one of the aforementioned apparatuses for manufacturing the internal combustion spark plug may further include a separation unit for moving the regulation member abutting against the ground electrode in a direction including an X-directional component so as to separate the regulation member from the ground electrode after the spark discharge gap has been formed by the pressure member.

When the regulation member is returned to the position (initial position) where the X-directional position of the front end surface of the ground electrode has not yet been regulated, there is a concern that the regulation abutment surface of the regulation member may engage the front end surface of the ground electrode so as to change the gap size when the regulation member abutting against the ground electrode is moved away from the ground electrode.

To address this concern, the manufacturing apparatus may include a separation unit for moving the regulation member abutting against the ground electrode in a direction including an X-directional component so as to separate the regulation member and the ground electrode from each other. Accordingly, due to use of the separation unit, the regulation member abutting against the ground electrode can be separated from the ground electrode in the directional in which the regulation abutment surface of the regulation member leaves the front end surface of the ground electrode. Accordingly, when the regulation member abutting against the ground electrode is separated from the ground electrode, there is no concern of the regulation abutment surface of the regulation member engaging the front end surface of the ground electrode. Thus, the regulation member can be returned to its initial position without changing the gap size.

Further, in the aforementioned apparatus, the separation unit preferably moves the regulation member abutting against the ground electrode in the X direction so as to separate the regulation member and the ground electrode from each other. Since the ground electrode abuts against the regulation member in the X direction, the change in gap size due to engagement between the regulation member and the ground electrode can surely be prevented if the regulation member is moved in the X direction by the separation unit so that the regulation member and the ground electrode are separated from each other.

Further, any one of the aforementioned apparatus for manufacturing the internal combustion spark plug may be adapted so that the pressure member has a pressure abutment surface for abutting against the ground electrode, and the pressure abutment surface of the pressure member is subjected to surface treatment such that a coefficient of friction between the pressure abutment surface of the pressure member and the ground electrode abutment surface of the ground electrode is not higher than 0.2. Accordingly, the ground electrode can easily slide on the pressure abutment surface of the pressure member in the X direction. Thus, when the ground electrode is deformed by the pressure member, the ground electrode is deformed smoothly not only in the Y direction but also in the X direction so that the X-directional position of the front end surface of the ground electrode can be regulated by the regulation member.

As for the surface treatment applied to the pressure abutment surface of the pressure member, for example, diamond-like carbon, lubricating oil, or the like may be formed or applied on the pressure abutment surface. Alternatively, the pressure abutment surface may be polished and smoothed (to lower its coefficient of friction).

The pressure member may be formed separately from the regulation member or integrally with the regulation member. It is preferable to use the pressure member that can move independently from the regulation member, because the spark gap may be adjusted more precisely by only moving the pressure member once the regulation member has bee fixed. Notably, the method and apparatus according to the invention enable production of spark plugs each having a small deviation of the front end surface of the ground electrode extending over the center electrode, deviating from its predetermined position with respect to the front end of the center electrode. That is, the spark plug produced according to the method and apparatus of the invention can have a front end surface of said ground electrode located or positioned within a narrow deviation range, deviating in the X direction with respect to the front end of said center electrode. For instance, the front end surface of the ground electrode can be positioned at a distance of 0.5 mm from the front end of the center electrode with a deviation falling in the range of ±0.1 mm. This deviation range is far improved, and less than half that attained by conventional methods and apparatuses.

DESCRIPTION OF REFERENCE NUMERALS AND SYMBOLS

Figure 1:
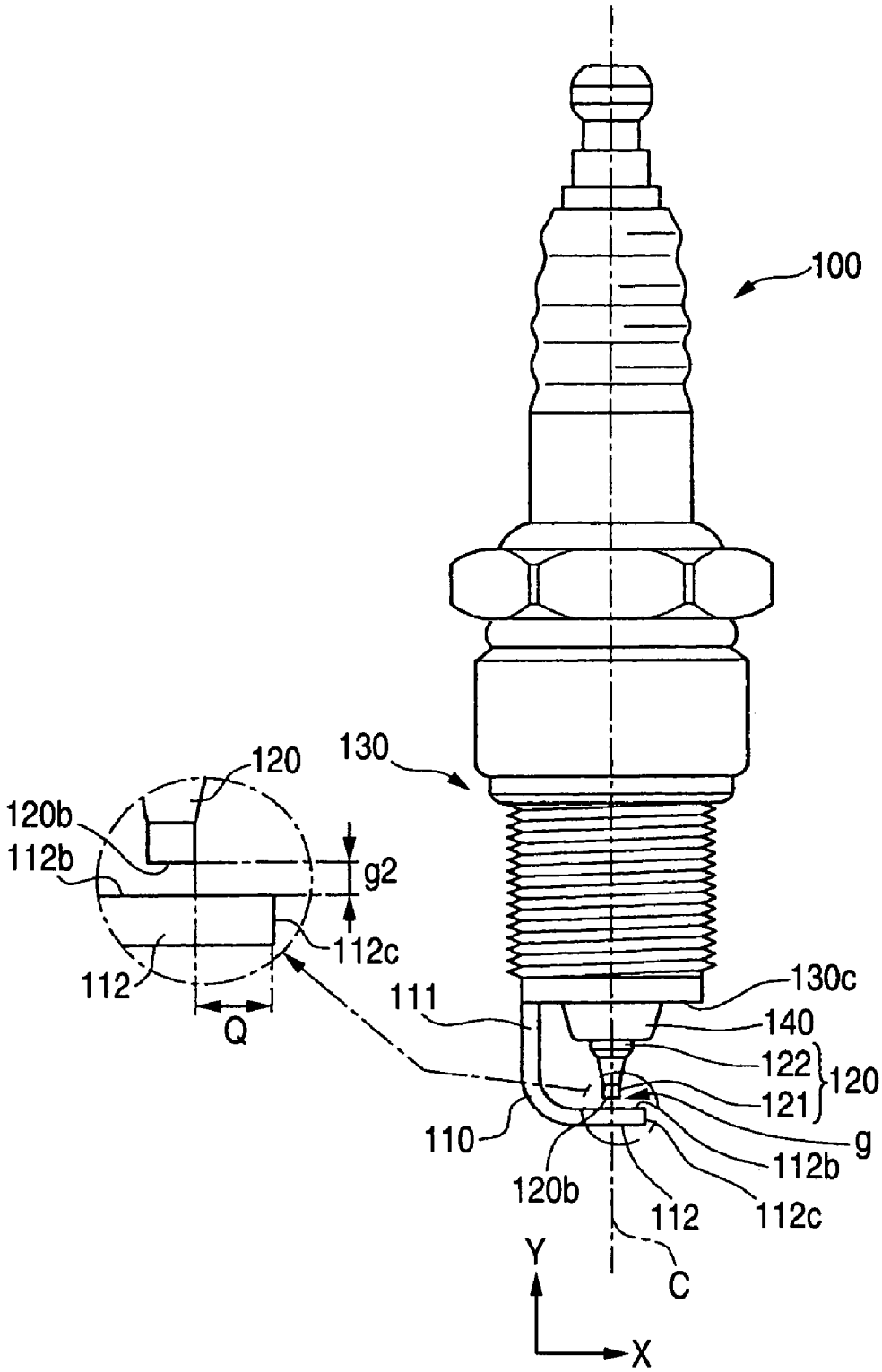
FIG. 1 is a side view of a spark plug 100 according to Embodiment 1.

Reference numerals used to identify various structural features in the drawings include the following.

100, 1100 spark plug

110, 1110 ground electrode
111 fixation portion of ground electrode
112 front end portion of ground electrode
112*c* front end surface of ground electrode
112*d* ground electrode abutment surface
113 noble metal tip of ground electrode
120 center electrode
120*b* front end of center electrode
130 metal shell
140 insulator
200, 600, 1200 spark plug manufacturing apparatus
300, 700 gap forming unit
320, 720 second electric actuator (positioning unit, fixing unit, separation unit)
330 pressure member
331, 731*b* pressure abutment surface
340 regulation member
341, 732*b* regulation abutment surface
730 gap forming member
731 pressure portion (pressure member)
732 regulation portion (regulation member)
C central axis of metal shell
g spark discharge gap
g1 first gap size value
g2 second gap size value

DETAILED DESCRIPTION OF THE INVENTION

Next, preferred embodiments of the invention will be described in detail with reference to the drawings. However, the present invention should not be construed as being limited thereto.

Embodiment 1

First, Embodiment 1 of the invention will be described with reference to the drawings.

FIG. 1 is a side view of a spark plug 100 manufactured in Embodiment 1. The spark plug 100 has a cylindrical insulator 140, a center electrode 120 inserted into the cylindrical insulator 140, a metal shell 130 surrounding the insulator 140, and a ground electrode 110 fixedly attached to the metal shell 130. The ground electrode 110 is fixedly attached to a front end surface 130*c* of the metal shell 130 by a fixation portion 111, and bent. A spark discharge gap g is formed between a front end 120*b* of the center electrode 120 and an opposed surface 112*b* of a front end portion 112 of the ground electrode 110 opposed to the front end 120*b*. In the spark plug 100 according to Embodiment 1, the front end 120*b* of the center electrode is constituted by a front end of a noble metal tip 121 welded with a front end of an electrode body portion 122 made of an Ni alloy.

Further, in the spark plug 100, as shown in an enlarged form in FIG. 1, the gap size of the spark discharge gap g is g2 (mm) (corresponding to a second gap size value), and a covering size value of the ground electrode 110 with respect to the center electrode 120 is Q (mm). Here, the covering size means an X-directional distance or length of the ground electrode 110 between a position (right end in FIG. 1) of the front end 120*b* of the center electrode 120 farthest from the fixation portion 111 of the ground electrode 110 and a front end surface 112*c* of the ground electrode 110 when the spark plug 100 is viewed laterally as shown in FIG. 1.

In Embodiment 1, assume that an X direction designates, of directions perpendicular to a central axis C of the metal shell 130 and perpendicular to a width direction of the fixation portion 111 of the ground electrode 110, a direction going from the fixation portion 111 of the ground electrode 110 toward the central axis C of the metal shell 130, and a −X direction designates a direction opposite to the X direction (see FIG. 1). Further, assume that a Y direction designates a direction extending along the central axis C of the metal shell 130 and going from the front end side (where the spark discharge gap g is located) of the spark plug 100 to the base side (opposite to the side where the spark discharge gap g is located) thereof, and a −Y direction designates a direction opposite to the Y direction (see FIG. 1). Furthermore, assume that a Z direction designates a direction perpendicular to the central axis C of the metal shell 130 and perpendicular to the X direction (see FIG. 3).

Figure 2:
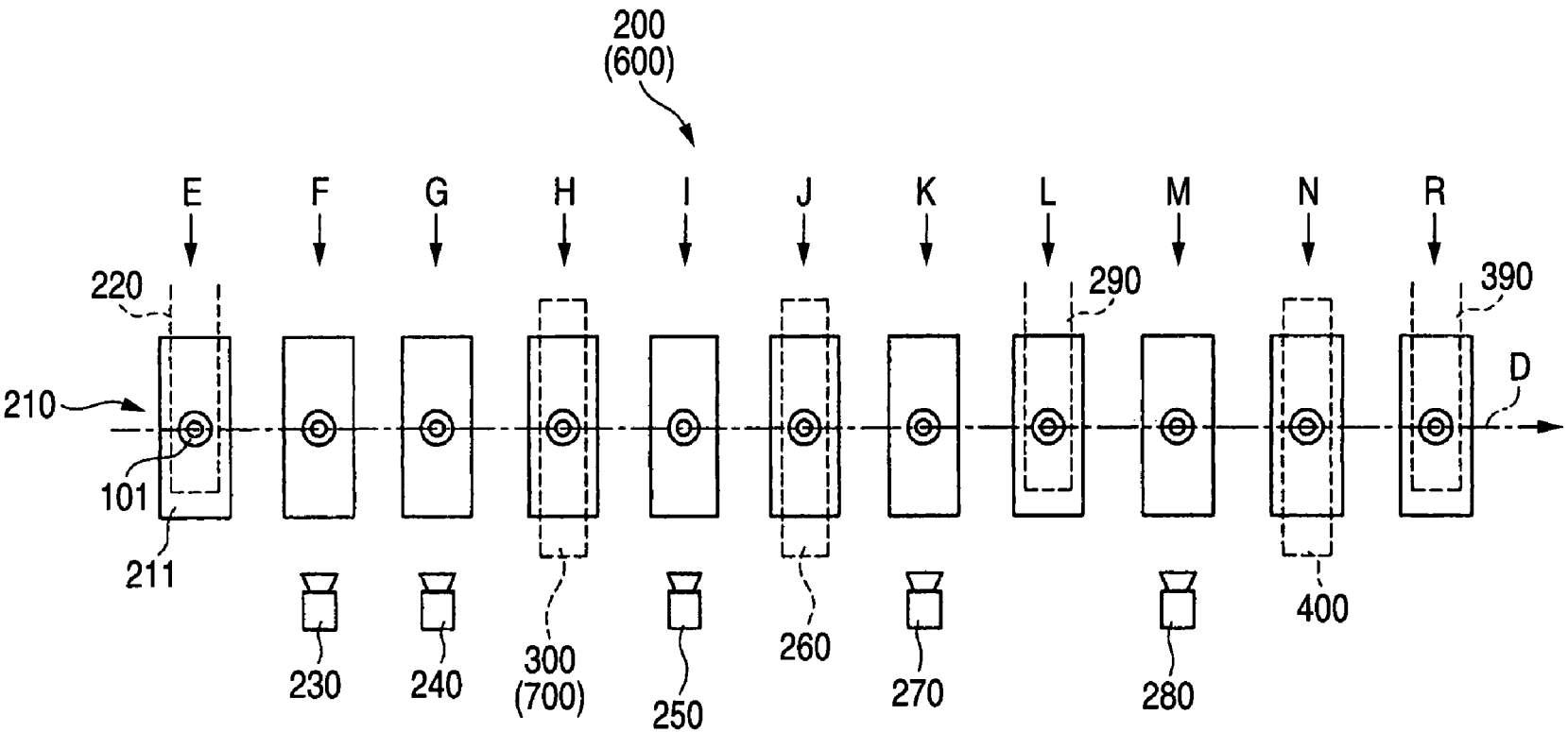
FIG. 2 is a top view schematically showing a spark plug manufacturing apparatus 200 according to Embodiment 1.

FIG. 2 is a top view schematically showing a spark plug manufacturing apparatus according to Embodiment 1. The spark plug manufacturing apparatus 200 has a linear conveyor 210 serving as a conveyance mechanism for conveying to-be-formed spark plugs (hereinafter also referred to as "works") 101 intermittently along a conveyance path D (which has a linear shape in Embodiment 1, but may have any shape such as an annular shape). The spark plug manufacturing apparatus 200 has a setter 220, a first gap size measuring unit 230, a first electrode position measuring unit 240 and a gap forming unit 300 in order of increasing distance from the upstream side (left side in FIG. 2) along the conveyance path D. The setter 220 sets each work 101. The first gap size measuring unit 230 measures the gap size of each work 101. The first electrode position measuring unit 240 measures the position of the center electrode 120 of each work 101. The gap forming unit 300 forms the spark discharge gap g of each work 101.

Further, the spark plug manufacturing apparatus 200 has a deviation measuring unit 250, a deviation adjusting unit 260, a second gap size measuring unit 270 and a first unloading unit 290. The deviation measuring unit 250 measures a deviation of the ground electrode 110 with respect to the center electrode 120 of each work 101. The deviation adjusting unit 260 adjusts the deviation of the ground electrode 110 with respect to the center electrode 120 of each work 101 to a size within a predetermined range. The second gap size measuring unit 270 measures the gap size of each work 101. The first unloading unit 290 unloads each work 101. Further, the spark plug manufacturing apparatus 200 has a second electrode position measuring unit 280, a gap adjusting unit 400 and a second unloading unit 390. The second electrode position measuring unit 280 measures the position of the center electrode 120 of each work 101. The gap adjusting unit 400 adjusts the spark discharge gap g of each work 101. The second unloading unit 390 unloads each work 101.

Carriers 211 on which the works 101 are removably mounted are attached to the linear conveyor 210 at predetermined intervals (see FIG. 2). A cylindrical work holder 212 which can open and shut in its upper end is attached integrally to each carrier 211 (see FIG. 3). Each work 101 fixed by the work holder 212 is subjected to processing in each unit.

Figure 3:
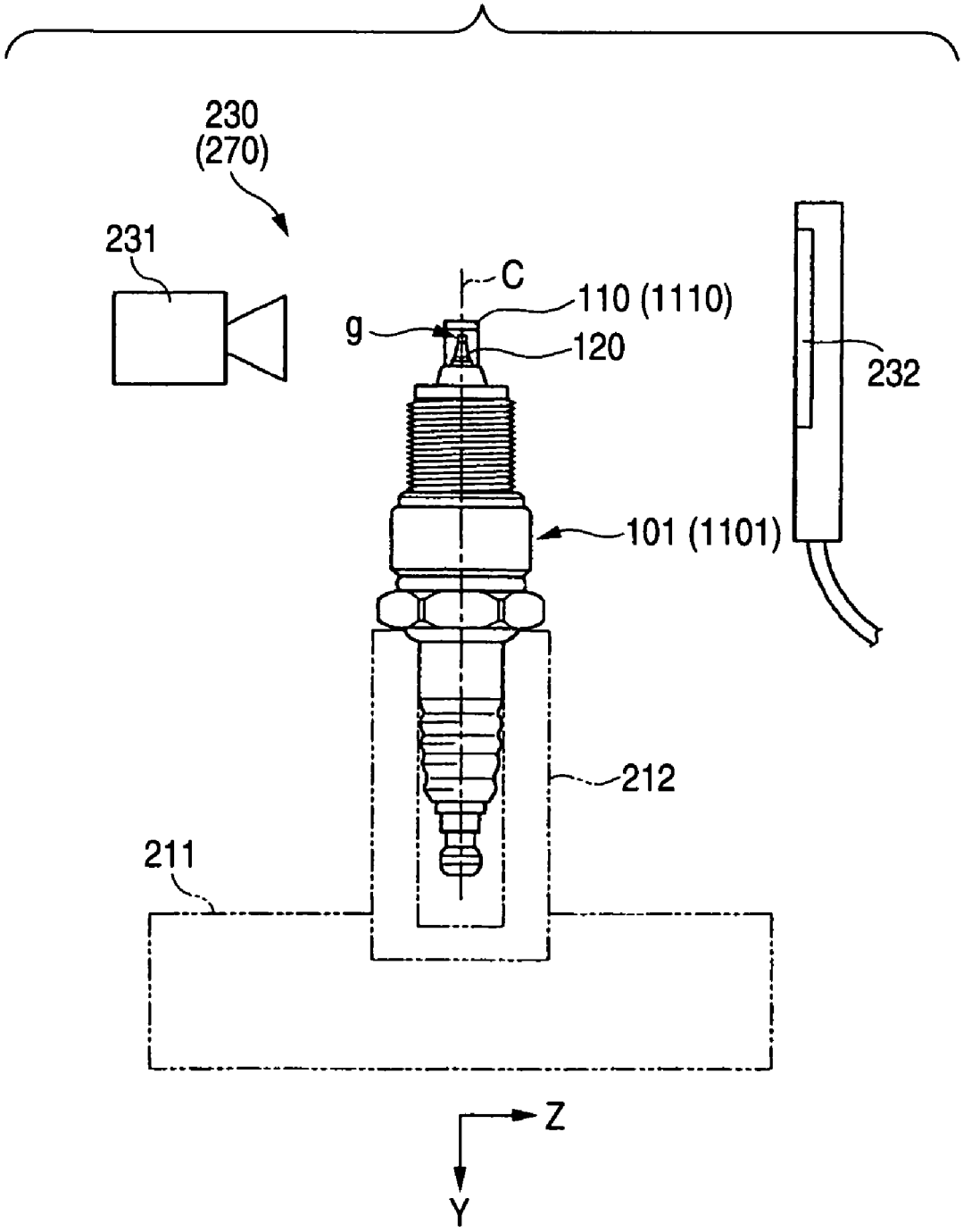
FIG. 3 is a side, view schematically showing a gap size measuring unit 230, 270 according to Embodiment 1.
Figure 4:
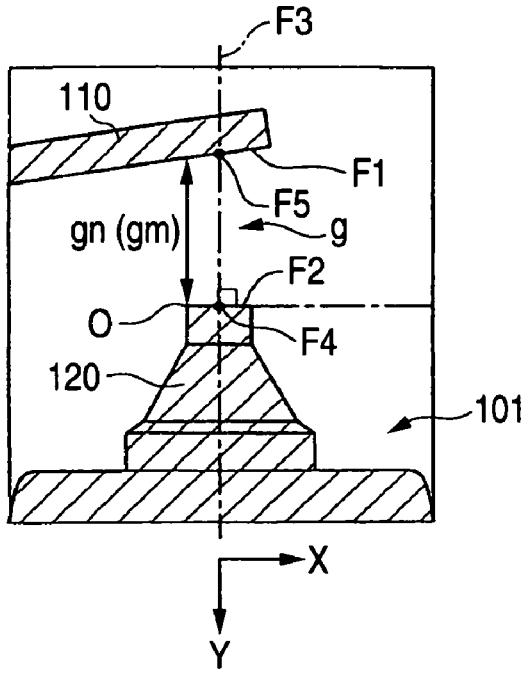
FIG. 4 is an explanatory view for explaining a gap size measuring step according to Embodiment 1.

FIG. 3 is a side view schematically showing the first gap size measuring unit 230. As shown in FIG. 3, the first gap size measuring unit 230 is constituted by an illuminator 232, a photographing camera 231 and a not-shown computer connected to the photographing camera 231. The illuminator 232 is, for example, an LED illuminator having a surface emitting LED or a large number of LEDs arrayed two-dimensionally. The illuminator 232 is provided to radiate light in the −Z direction so as to illuminate the center electrode 120 and the ground electrode 110 of the work 101. The photographing camera 231 is, for examples, designed as a CCD camera having a two-dimensional CCD image pickup device as an image detection portion. The photographing camera 231 is disposed in a position opposed to the illuminator 232 in the Z direction, so as to photograph the contours of the center electrode 120 and the ground electrode 110 of the work 101. FIG. 4 shows an image picked up by the photographing camera 231, in which the center electrode 120 and the ground electrode 110 are contoured, and their contours are clarified by the contrast with the bright background. Based on this image, the gap size is determined by the not-shown computer. Incidentally, the second gap size measuring unit 270 is configured in the same manner as the first gap size measuring unit 230.

Figure 5:
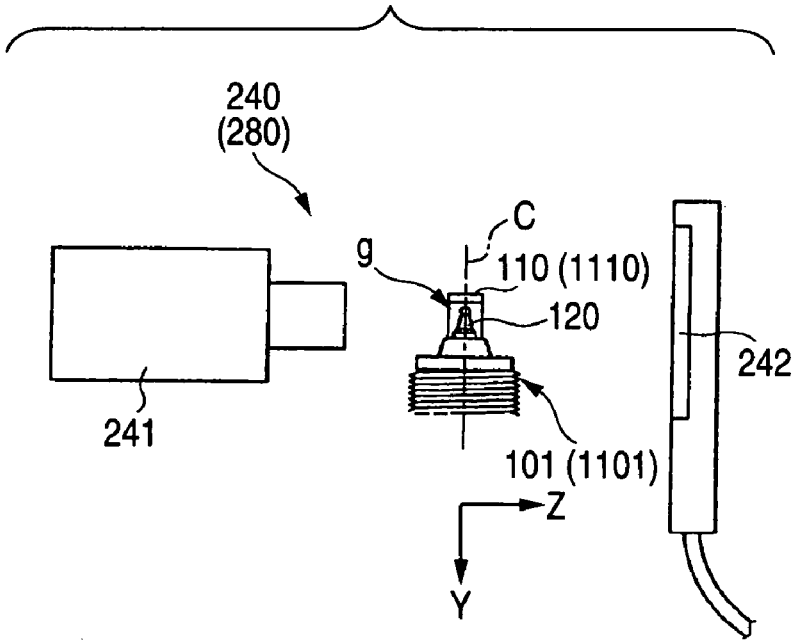
FIG. 5 is a side view schematically showing a first, second electrode position measuring unit 240, 280 according to Embodiment 1.
Figure 6:
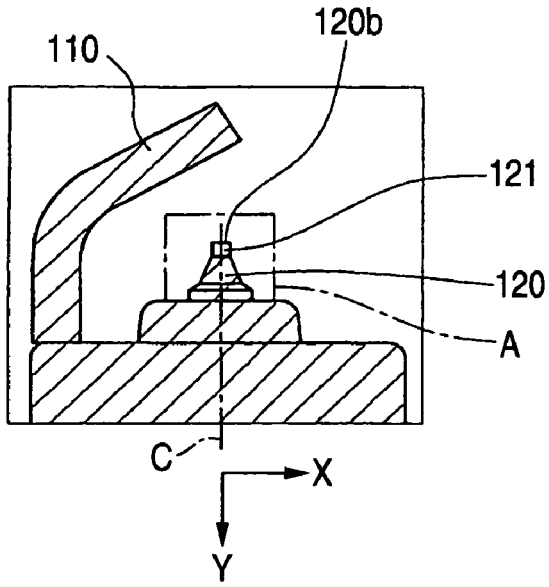
FIG. 6 is an explanatory view showing a photographed image in the first, second electrode position measuring unit 240, 280 according to Embodiment 1.

FIG. 5 is a side view schematically showing the first electrode position measuring unit 240. As shown in FIG. 5, the first electrode position measuring unit 240 is constituted by an illuminator 242, a photographing camera 241 and a not-shown computer connected to the photographing camera 241. The illuminator 242 is, for example, an LED illuminator having a surface emitting LED or a large number of LEDs arrayed two-dimensionally. The illuminator 242 is provided to radiate light in the −Z direction so as to illuminate the center electrode 120 and the ground electrode 110 of the work 101. The photographing camera 241 is, for examples, designed as a CCD camera in the same manner as the photographing camera 231. The photographing camera 241 is disposed in a position opposed to the illuminator 242 in the Z direction, so as to photograph the contours of the center electrode 120 and the ground electrode 110 of the work 101. FIG. 6 shows an image picked up by the photographing camera 241, in which the center electrode 120 and the ground electrode 110 are contoured, and their contours are clarified by the contrast with the bright background. Based on this image, the position of a front end 120*b* of the center electrode 120 is determined by the not-shown computer. Incidentally, the second electrode position measuring unit 280 is configured in the same manner as the first electrode position measuring unit 240.

Figure 8:
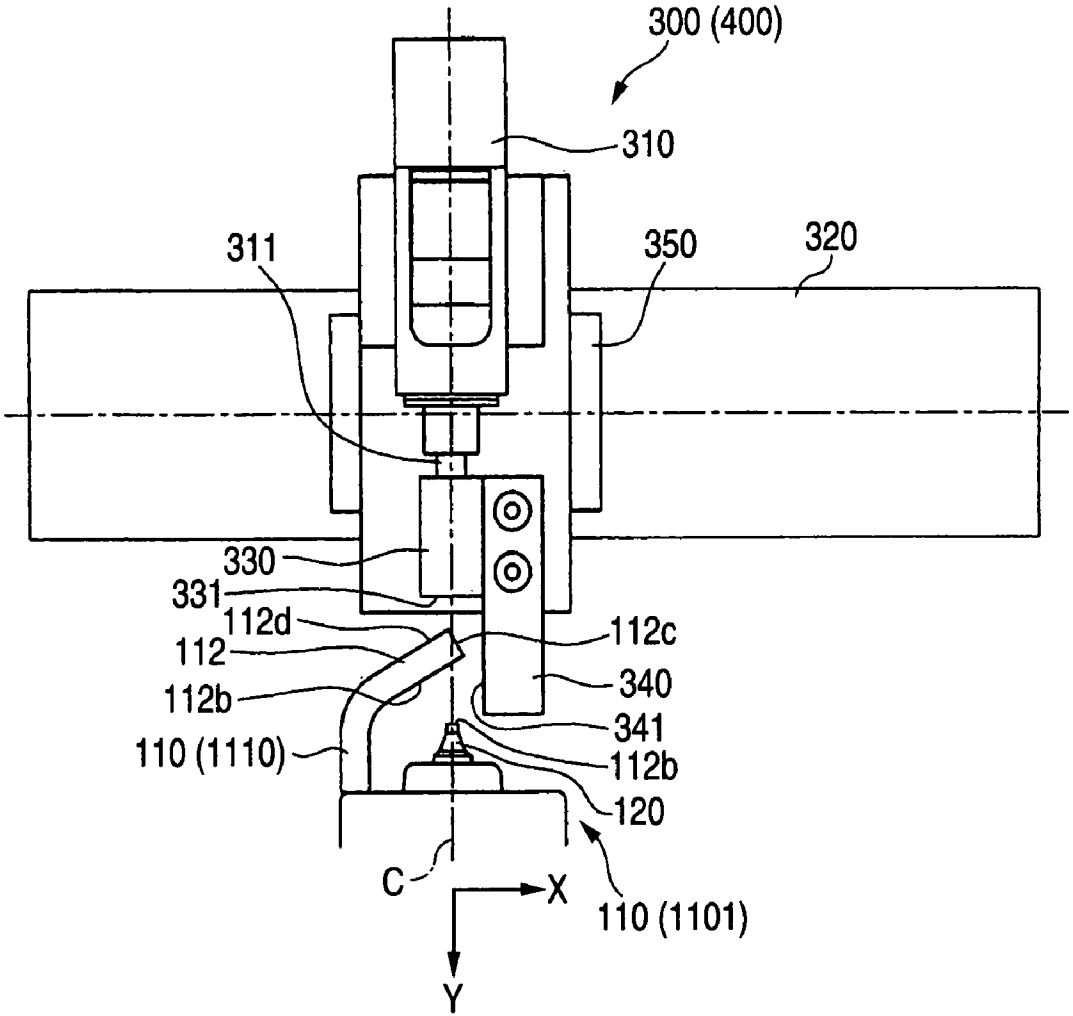
FIG. 8 is a side view schematically showing a gap forming unit 300 and a gap adjusting unit 400 according to Embodiment 1.

FIG. 8 is a side view schematically showing the gap forming unit 300. As shown in FIG. 8, the gap forming unit 300 has a first electric actuator 310 including a servo motor with a brake, a substantially columnar pressure member 330, a second electric actuator 320 including a servo motor with a brake, a slider 350, and a substantially rectangular parallelepiped regulation member 340. The pressure member 330 is attached to the front end of a piston rod 311 of the first electric actuator 310. The pressure member 330 is moved in the Y or −Y direction, (upward or downward in FIG. 8) by the first electric actuator 310. The slider 350 is attached to the second electric actuator 320, and the regulation member 340 and the first electric actuator 310 are attached to the slider 350. Thus, the slider 350 is moved in the X or −X direction (left or right direction in FIG. 8) by the second electric actuator 320, while the first electric actuator 310, the pressure member 330 attached thereto, and the regulation member 340 move together in the X or −X direction. Since the pressure member 330 and the regulation member 340 are formed separately, the pressure member 330 can move in the Y direction independently.

In the gap forming unit 300 configured thus, the pressure member 330 is moved in the Y direction by the first electric actuator 310, so that the ground electrode 110 is pressed and bent in the Y direction by the pressure member 330. Thus, the spark discharge gap g having a predetermined gap size (first gap size value g1 in Embodiment 1) can be formed between the opposed surface 112*b* of the front end portion 112 of the ground electrode 110 and the front end 120*b* of the center electrode 120 (see FIG. 9D). In this event, in order to prevent the front end surface 112*c* of the ground electrode 110 from moving too far in the X direction, the X-direction position of the front end surface 112*c* of the ground electrode 110 is regulated by the regulation member 340 in the gap forming unit 300 when the ground electrode 110 is pressed in the Y direction by the pressure member 330 (see FIG. 9B).

Specifically, first, a difference between a gap size value gn (see FIG. 4) measured by the aforementioned gap size measuring unit 230 and the first gap size value g1 is calculated by the not-shown computer. This size difference is determined as the pressure stroke distance of the first electric actuator 310 after a pressure abutment surface 331 of the pressure member 330 abuts against the ground electrode 110. Further, based on the position of the front end 120*b* of the center electrode 120 measured by the aforementioned first electrode position measuring unit 240, the moving distance of the second electric actuator 320 is determined by the not-shown computer so that a regulation abutment surface 341 of the regulation member 340 is located in a predetermined X-direction position. After that, the brake of the servo motor of the second electric actuator 320 is operated to fix the regulation member 340.

The determined moving distance of the second electric actuator 320 is converted into an intended number of revolutions of the servo motor of the second electric actuator 320 correspondingly. On the other hand, the number of revolutions of the servo motor of the second electric actuator 320 is measured by a not-shown pulse counter. When the regulation member 340 is moved in the −X direction (left direction in FIG. 8) by the second electric actuator 320 so that the value measured by the pulse counter reaches the intended number of revolutions, the regulation stroke is regarded as terminated (movement termination), and the motor of the second electric actuator 320 is suspended. After that, the brake of the servo motor of the second electric actuator 320 is operated to fix the regulation member 340 in a predetermined X-direction position.

Next, the pressure member 330 is moved in the Y direction (downward in FIG. 8) by the first electric actuator 310, so that the pressure abutment surface 331 of the pressure member 330 is allowed to abut against the ground electrode 110. Incidentally, the gap forming unit 300 is designed so that a not-shown load cell detects a change of pressure in the pressure abutment surface 331 of the pressure member 330 caused by abutment as soon as the pressure abutment surface 331 abuts against the ground electrode 110. After that, the pressure member 330 is moved in the Y direction correspondingly to the determined pressure stroke distance by use of a pulse counter in the same manner as the regulation member 340. Thus, the ground electrode 110 is pressed and bent in the Y direction so that the spark discharge gap g having the first gap size value g1 can be formed. In this event, the front end surface 112*c* of the bent ground electrode 110 abuts against the regulation abutment surface 341 of the regulation member 340 so that the X-directional position of the front end surface 112*c* of the ground electrode 110 is regulated. In such a manner, in the gap forming unit 300, the ground electrode 110 is pressed and bent in the Y direction while the X-direction position of the front end surface 112*c* of the ground electrode 110 with respect to the front end 120*b* of the center electrode 120 is regulated in a predetermined X-direction position. Thus, it is possible to form the spark discharge gap g having the first gap size value g1 (see FIGS. 9A-9D).

After that, the pressure member 330 is moved in the −Y direction (upward in FIG. 8) by the first electric actuator 310 so that the pressure member 330 and the ground electrode 110 are separated from each other. Next, the regulation member 340 is moved in the X direction (right direction in FIG. 8) by the second electric actuator 320 so that the ground electrode 110 and the regulation member 340 are separated from each other. Incidentally, in the gap forming unit 300, the second electric actuator 320 and the not-shown computer connected thereto correspond to a positioning unit, a fixation unit and a separation unit.

The pressure abutment surface 331 of the pressure member 330 is subjected to surface treatment with diamond-like carbon, so that the friction coefficient with a ground electrode abutment surface 112*d* of the ground electrode 110 is made not higher than 0.2. It is therefore easy for the ground electrode 110 to slide in the X direction on the pressure abutment surface 331 of the pressure member 330. Thus, when the ground electrode 110 is deformed by the pressure member 330, the ground electrode 110 is deformed smoothly not only in the Y direction but also in the X direction, so that the X-direction position of the front end surface 112*c* of the ground electrode 110 can be regulated by the regulation member 340.

The gap adjusting unit 400 also has a structure similar to that of the aforementioned gap forming unit 300 (see FIG. 8). The ground electrode 110 is pressed in the Y direction while the X-directional position of the front end surface 112*c* of the ground electrode 110 with respect to the front end 120*b* of the center electrode 120 is regulated in a predetermined X-directional position. Thus, the gap size of the spark discharge gap g can be adjusted to have a predetermined gap size value (second gap size value g2 in Embodiment 1) (see FIGS. 19A-19D).

Figure 10:
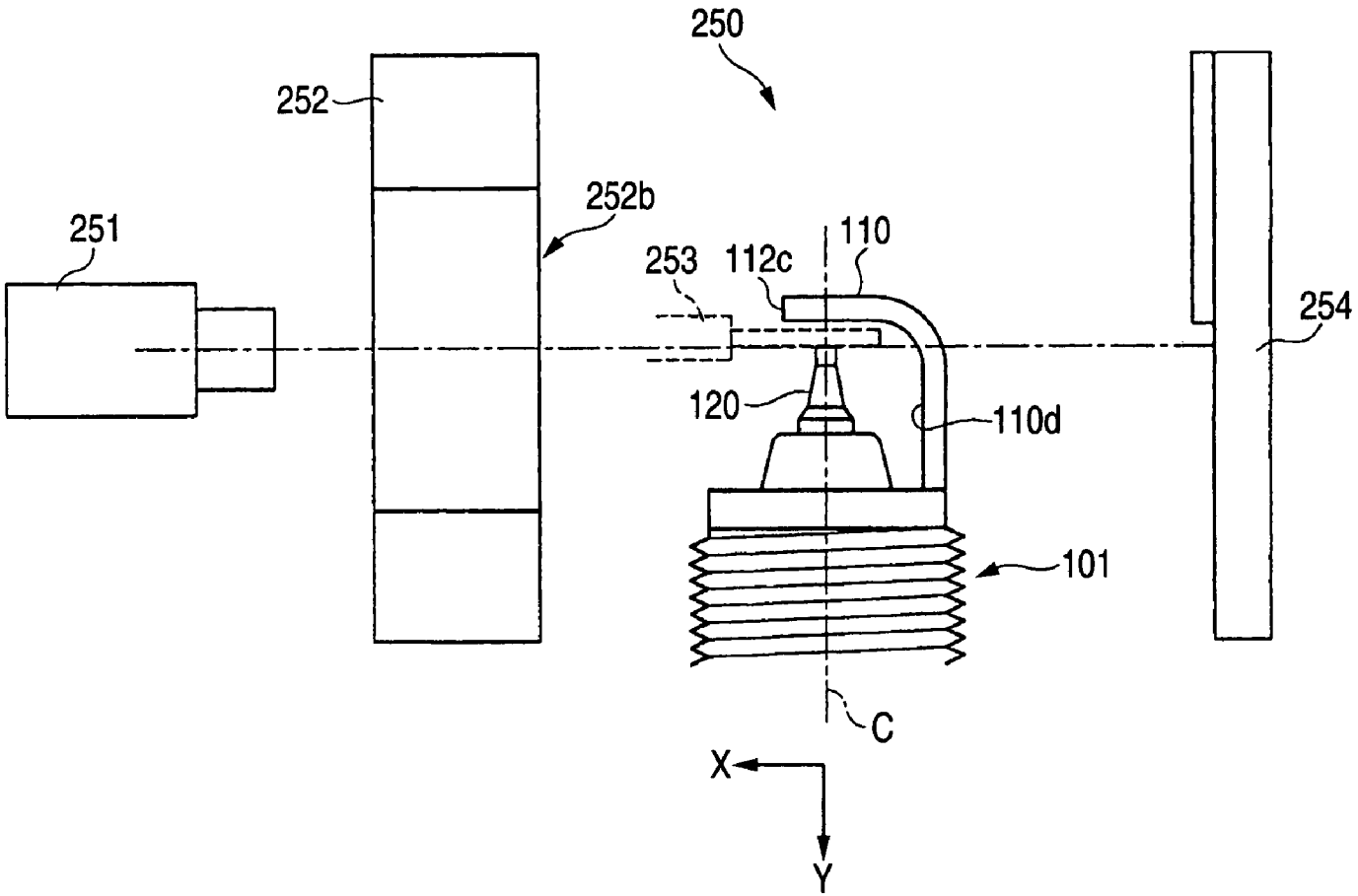
FIG. 10 is a side view schematically showing a deviation measuring unit 250 according to Embodiment 1.

FIG. 10 is a side view schematically showing the deviation measuring unit 250. As shown in FIG. 10, the deviation measuring unit 250 is constituted by a first illuminator 252, a second illuminator 253, a background unit 254, a photographing camera 251, and a not-shown computer connected to the photographing camera 251. The first illuminator 252 is an LED illuminator having a surface emitting LED or a large number of LEDs arrayed two-dimensionally. The first illuminator 252 has a through hole 252*b* for securing a field of view for the photographing camera 251. The first illuminator 252 is provided to radiate light in the −X direction (right direction in FIG. 10) so as to illuminate the center electrode 120 and the ground electrode 110 of the work 101. The second illuminator 253 is an optical fiber illumination, which is disposed in a clearance between the ground electrode 110 and the center electrode 120. The second illuminator 253 is provided to radiate light in the −X direction (right direction in FIG. 10) so as to illuminate an inner side surface 110*d* of the ground electrode 110.

The photographing camera 251 is, for examples, a CCD camera similar to the photographing camera 241. The photographing camera 251 is disposed in a position opposed to the work 101 in the X direction through the through hole 252*b* of the first illuminator 252. When the work 101 is illuminated by the first illuminator 252, light is reflected uniformly by the flat front end surface 112*c* of the ground electrode 110. Thus, the front end surface 112*c* of the ground electrode 110 is photographed in bright relief against any other part (see FIGS. 11A-11B). Based on this photographed image, the position of the front end surface 112*c* of the ground electrode 110 is determined by the not-shown computer.

On the other hand, when the work 101 is irradiated by the second illuminator 253, the inner side surface 110*d* of the ground electrode 110 looks bright while the center electrode 120 is contoured. Thus, the contours of the center electrode 120 can be photographed clearly due to the contrast with the bright background (see FIGS. 12A-12C). Based on this photographed image, the position of the front end 120*b* of the center electrode 120 is determined. Based on the position of the front end 120*b* of the center electrode 120 and the position of the front end surface 112*c* of the ground electrode 110 measured thus, the Z-directional deviation P of the front end surface 112*c* of the ground electrode 110 with respect to the front end 120*b* of the center electrode 120 is calculated (see FIG. 13).

Figure 14:
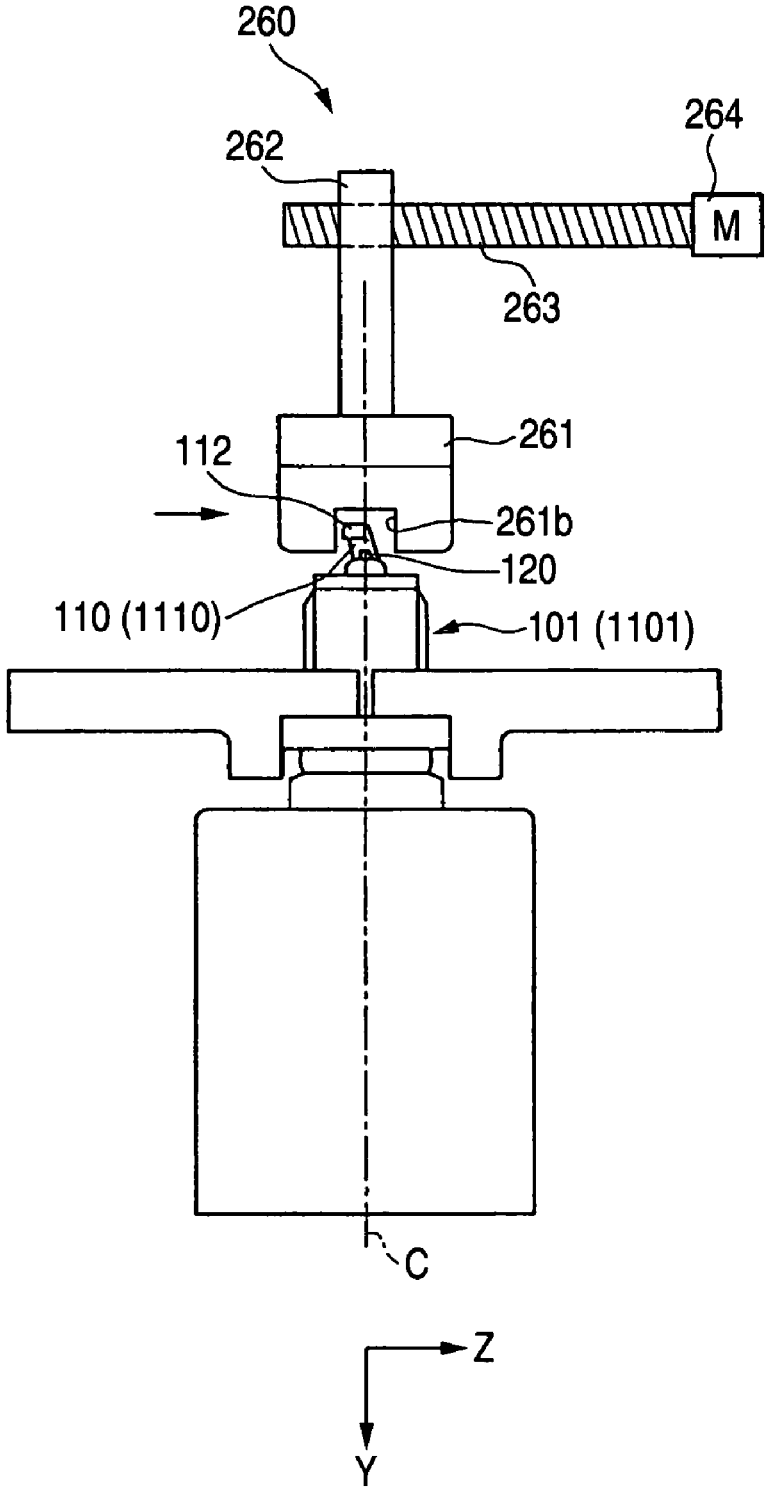
FIG. 14 is a side view schematically showing a deviation adjusting unit 260 according to Embodiment 1.

FIG. 14 is a side view schematically showing the deviation adjusting unit 260. The deviation adjusting unit 260 has a bending member 261, an internally threaded portion 262, an externally threaded portion 263, and a drive motor 264. The bending member 261 presses the front end portion 112 of the ground electrode 110 in the Z direction. The internally threaded portion 262 is provided integrally with the bending member 261. The externally threaded portion 263,is screwed down to the internally threaded portion 262. The drive motor 264 rotates the externally threaded portion 263 around its axis. In this deviation adjusting unit 260, the externally threaded portion 263 is rotated around its axis by the drive motor 264 so as to move the bending member 261 in the Z direction. Thus, the front end portion 112 of the ground electrode 110 is pressed and deformed in the Z direction while a groove portion 261*b* formed in the bending member 261 engages with the front end portion 112 of the ground electrode 110. In such a manner, it is possible to adjust the Z-directional deviation of the front end surface 112*c* of the ground electrode 110 with respect to the front end 120*b* of the center electrode 120. Incidentally, in the deviation adjusting unit 260, the number of revolutions of the drive motor 264 is calculated to set the Z-directional deviation P at 0.0 mm by a not-shown computer based on the Z-directional deviation P calculated by the deviation measuring unit 250.

Figure 15:
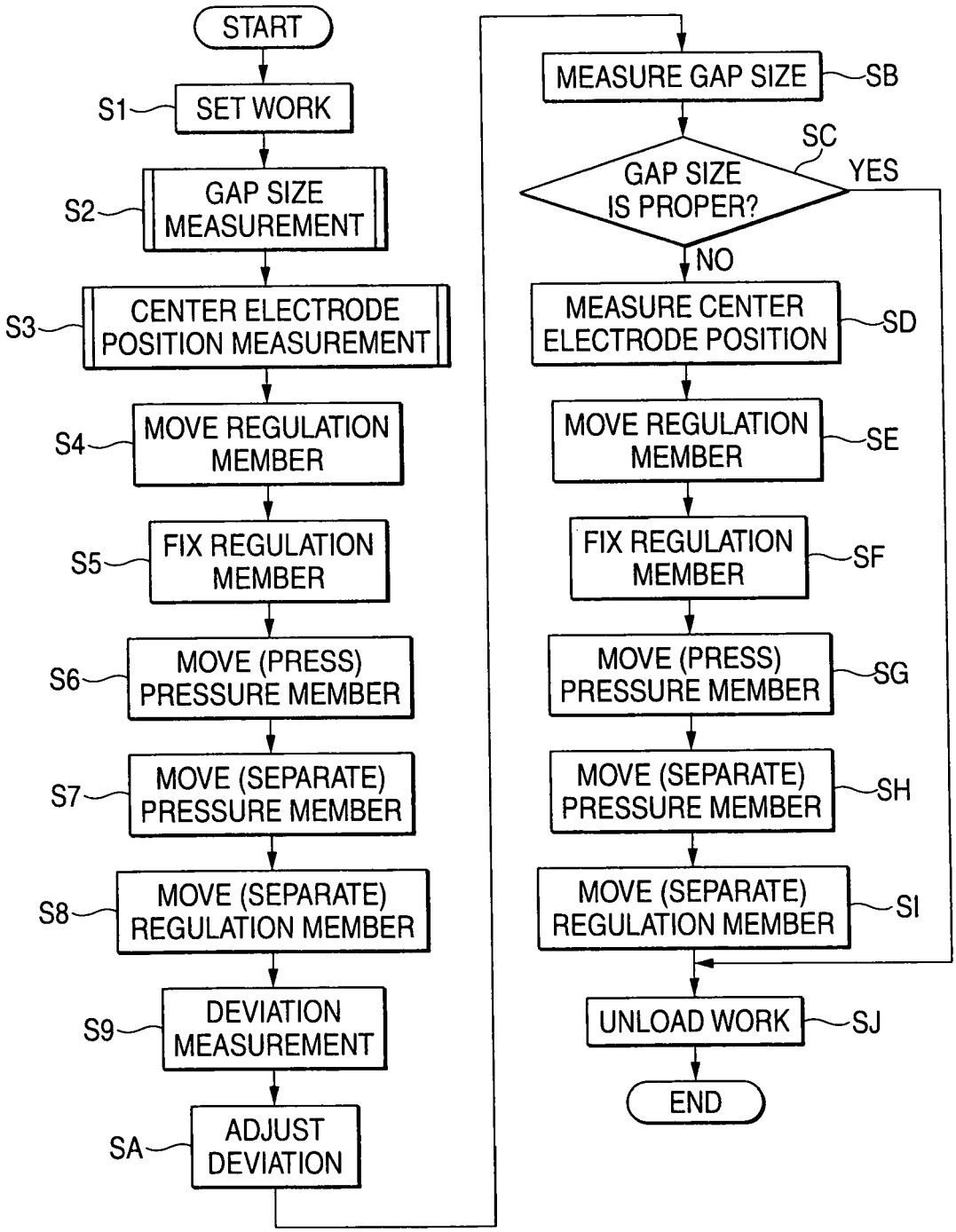
FIG. 15 is a flow chart showing a flow of steps in a method for manufacturing the spark plug 100 according to Embodiment 1.

Next, description will be made about a method for manufacturing the spark plug 100 using the spark plug manufacturing apparatus 200 configured as described above. FIG. 15 is a flow chart (main routine) showing a flow of steps in the method for manufacturing the spark plug 100. Description will be made along this flow chart and the general view of the spark plug manufacturing apparatus 200 in FIG. 2.

First, in Step S1 (work setting step), the work 101 is set, in a position E in FIG. 2, on one of the carriers 211 attached to the linear conveyor 210 at predetermined intervals (see FIG. 2). Specifically, by the setter 220, the work 101 is mounted on the cylindrical work holder 212 placed on the carrier 211 (see FIG. 3).

Figure 16:
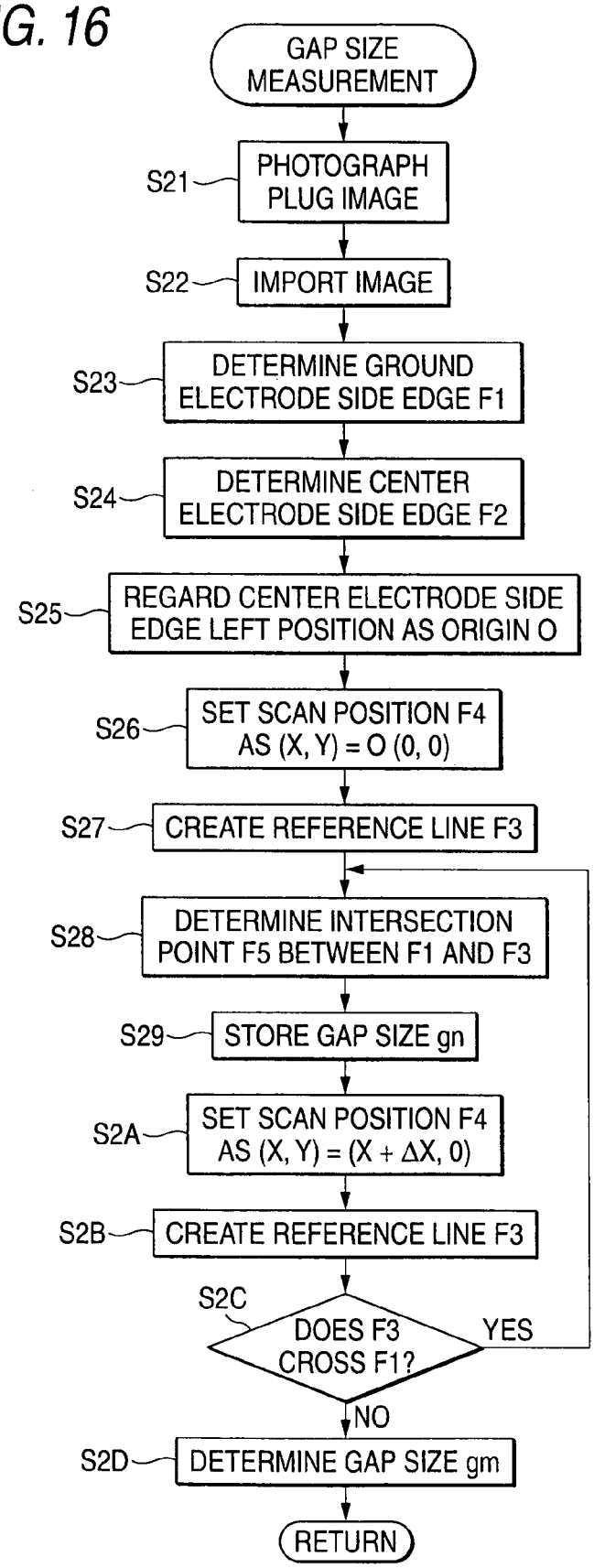
FIG. 16 is a flow chart showing a flow of steps in a gap size measuring process according to Embodiment 1.

Next, in Step S2 (first gap size measuring step), the gap size of the work 101 is measured in a position F in FIG. 2 (see FIG. 2). Specifically, in a position where the linear conveyor 210 has been advanced by one stroke, the gap size of the work 101 is measured by the gap size measuring unit 230 having the photographing camera 231 (see FIG. 3). Here, the gap size measuring process will be described in detail with reference to FIG. 16 showing the subroutine of Step S2. First, in Step S21, the contours of the center electrode 120 and the ground electrode 110 of the work 101 illuminated by the illuminator 232 is photographed by the photographing camera 231 disposed on the −Z direction side with respect to the work 101 (see FIG. 3). Next, in Step S22, an image picked up by the photographing camera 231 is imported by the not-shown computer (see FIG. 4). Next, based on this photographed image, an edge F1 of the ground electrode 110 facing the spark discharge gap g is determined in Step S23, and an edge F2 of the center electrode 120 is determined in Step S24.

Next, in Step S25, an origin O (X,Y)=(0,0) is set at one end (left end in Embodiment 1) of the edge F2. In Step S26, a scan position F4 (X,Y) is set as the origin O. Next, in Step S27, a reference line F3 passing through the scan position F4 and crossing the edge F2 at right angles is made up. In Step S28, the coordinates of an intersection point F5 with the edge F1 are obtained. In Step S29, the gap size gn of the spark discharge gap g is calculated as the length of a line segment connecting F4 and F5, and stored. Next, in Steps S2A and S2B, the X coordinate of the scan position F4 is increased by a predetermined amount ΔX. Thus, a new reference line F3 is made up. In Step S2C, it is determined whether the reference line F3 crosses the edge F1 or not. Next, when the reference line F3 crosses the edge F1, the routine of processing returns to Steps S28 and S29, where an intersection point F5 with the edge F1 is obtained. Thus, the gap size gn is calculated and stored in the same manner. In such a manner, the processing from S28 to S2B is repeated till the intersection point with the edge F1 disappears. After that, in Step S2D, of the measured gap sizes gn, a smallest one is determined as a gap size gm. Then, the routine of processing returns to the main routine of FIG. 15.

Figure 17:
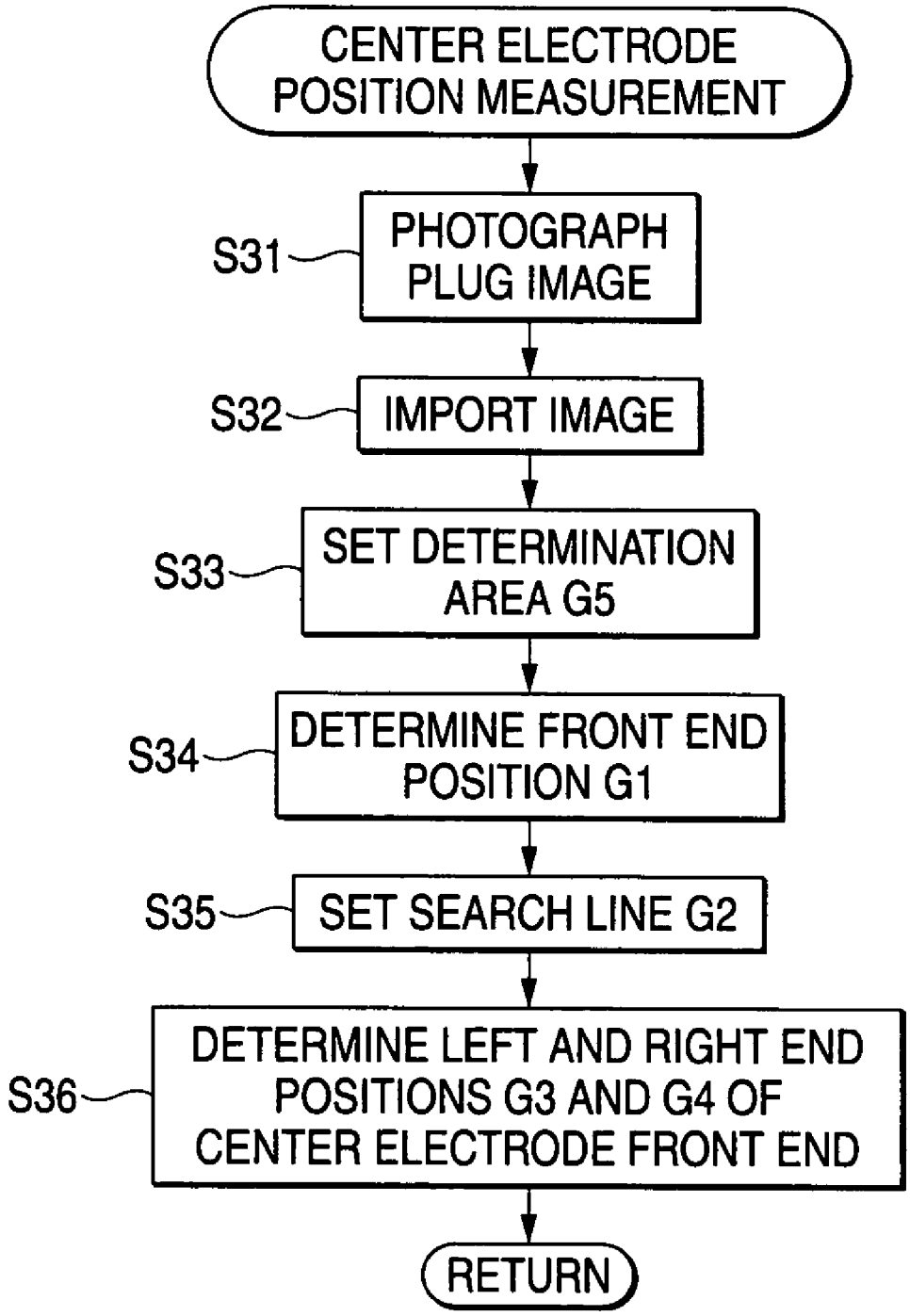
FIG. 17 is a flow chart showing a flow of steps in a center electrode position measuring process according to Embodiment 1.

Next, in Step 3 (center electrode position measuring step), the position of the front end 120*b* of the center electrode 120 of the work 101 is measured in a position G in FIG. 2 (see FIG. 2). Specifically, the position of the front end 120*b* of the center electrode 120 of the work 101 is measured by the first electrode position measuring unit 240 (see FIG. 5). Here, the center electrode position measuring step will be described in detail with reference to FIG. 17 showing the subroutine of Step S3. First, in Step S31, the contours of the center electrode 120 and the ground electrode 110 of the work 101 illuminated by the illuminator 242 are photographed by the photographing camera 241 disposed on the −Z direction side with respect to the work 101 (see FIG. 5). Next, in Step S32, an image photographed by the photographing camera 241 is imported (see FIG. 6).

Next, in Step S33, a determination area G5 having a predetermined width in the Y direction and extending like a belt in the X direction is set in an area A where the noble metal tip 121 forming the front end 120*b* of the center electrode 120 is expected to exist in the photographed image. Next, in Step S34, a front end position G1 is determined based on a Y-direction density distribution obtained in each pixel position in the X direction (see FIG. 7A). Next, in Step S35, a search line G2 is set in a position shifted from the front end position G1 by a predetermined distance (e.g. 0.1 mm) in the Y direction (downward in FIGS. 7A and 7B) (see FIG. 7B). Next, in Step S36, a pixel density distribution in the X direction is obtained along the search line G2, and the coordinates of a left end position G3 and a right end position G4 are determined based on the obtained pixel density distribution. In Embodiment 1, the coordinates (Xg, Yg) of the right end position G4 are stored as the position of the front end 120*b* of the center electrode 120. After that, the routine of processing returns to the main routine of FIG. 15.

Next, in Steps S4 and S5 (regulation member positioning step), the X-direction position of the regulation member 340 of the gap forming unit 300 is positioned in a position H in FIG. 2. Specifically, first, the predetermined covering size Q (see FIG. 1) of the ground electrode 110 with respect to the center electrode 120 and an amount Sb with which the ground electrode 110 is expected to spring back in the −X direction after pressure are added to the X-coordinate Xg of the front end 120*b* of the center electrode 120 measured in Step S3 (center electrode position measuring step), so that an X-coordinate Xf (see FIG. 9A) is calculated. That is, an X-coordinate Xf in which the covering size Q (see FIG. 1) of the ground electrode 110 with respect to the center electrode 120 and the amount Sb with which the ground electrode 110 is expected to spring back in the −X direction after pressure are added to the X-coordinate Xg of the front end 120*b* of the center electrode 120 measured in Step S3 is calculated (Xf=Xg+Q+Sb). In order to move the regulation member 340 to a position where the X-coordinate of the regulation abutment surface 341 of the regulation member 340 will be Xf, a moving distance of the second electric actuator 320 is calculated. Next, the calculated moving distance is converted into an intended number of revolutions of the servo motor of the second electric actuator 320 corresponding thereto.

Figure 9A:
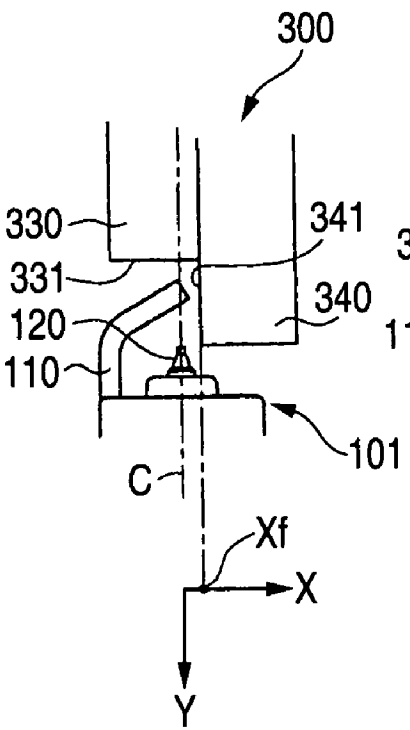
FIGS. 9A, 9B, 9C and 9D are explanatory views for explaining a regulation member positioning step, a gap forming step and a return step according to Embodiment 1.

Next, the regulation member 340 is moved in the −X direction (left direction in FIG. 8) together with the first electric actuator 310 and the pressure member 330 by the second electric actuator 320. In this event, the number of revolutions of the servo motor of the second electric actuator 320 is measured by the not-shown pulse counter. As soon as the value measured by the pulse counter reaches the intended number of revolutions, the regulation stroke is regarded as terminated, and the servo motor of the second electric actuator 320 is suspended. After that, in Step S5, the brake of the servo motor of the second electric actuator 320 is operated to fix the regulation member 340 in that position. In such a manner, the X-direction position of the regulation member 340 of the gap forming unit 300 is positioned as shown in FIG. 9A.

Next, in Step S6 (gap forming step), the spark discharge gap g of the work 101 is formed in a position H in FIG. 2. Specifically, first, a difference between the gap size gm measured in Step S2 (gap size measuring step) and the first gap size g1 (see FIG. 9D) set in advance is calculated and set as a pressure stroke distance of the first electric actuator 310. The pressure stroke distance is converted into an intended number of revolutions of the servo motor of the first electric actuator 310 corresponding thereto. Incidentally, in Embodiment 1, the value of the first gap size value g1 is set to be slightly larger (for example, 0.05 mm larger) than the second gap size value g2 equal to the gap size of the spark plug 100.

Figure 9B:
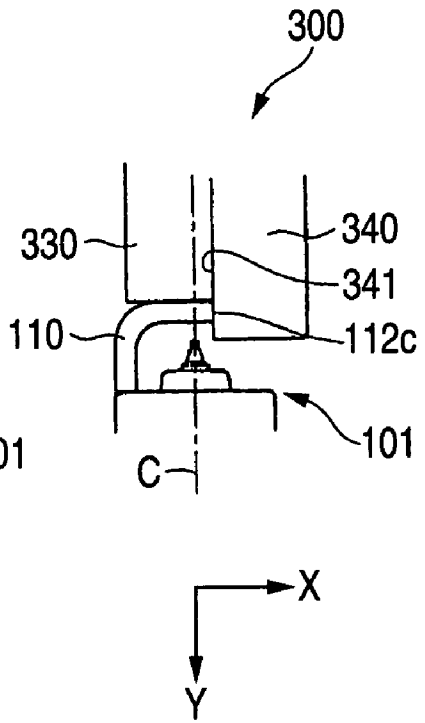

Next, the pressure member 330 is moved in the Y direction (downward in FIG. 8) by the first electric actuator 310. As described previously, the servo motor of the first electric actuator 310 is suspended as soon as the number of revolutions of the servo motor of the first electric actuator 310 reaches the determined intended number of revolutions by use of a now-shown rod cell and a not-shown pulse counter. In this event, as shown in FIG. 9B, the ground electrode 110 is pressed and bent in the Y direction by the pressure member 330, while the front end surface 112*c* of the ground electrode 110 moves in the X direction and abuts against the regulation abutment surface 341 of the regulation member 340. Since the regulation member 340 is fixed, the X-direction position of the front end surface 112*c* of the ground electrode 110 is regulated. Thus, the X-direction position of the front end surface 112*c* of the ground electrode 110 with respect to the front end 120*b* of the center electrode 120 can be regulated in a predetermined X-direction position.

Figure 9C:
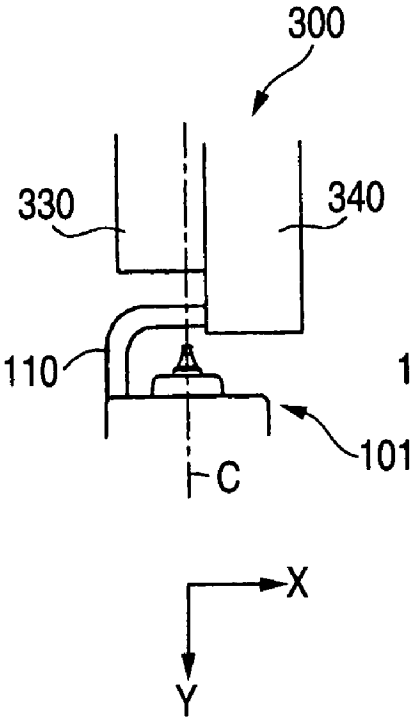
Figure 9D:
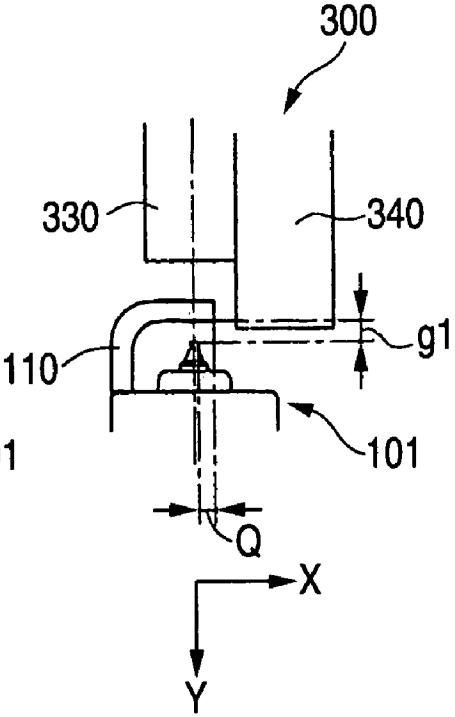

Next, in Steps S7 and S8 (return step), in a position H in FIG. 2, the pressure member 330 is returned to its position before Step S6 (gap forming step), and the regulation member 340 is returned to its position before Step S4 (regulation member positioning step). Specifically, first, in Step S7, as shown in FIG. 9C, the servo motor of the first electric actuator 310 is rotated reversely by the same number of revolutions as that in Step S6 (gap forming step). Thus, the pressure member 330 is moved in the −Y direction (upward in FIG. 9C) so that the ground electrode 110 and the pressure member 330 are separated from each other. Next, in Step S8 (separation step), as shown in FIG. 9D, the servo motor of the second electric actuator 320 is rotated reversely by the same number of revolutions as that in Step S4 (regulation member positioning step). Thus, the regulation member 340 is moved in the X direction (right direction in FIG. 9D) together with the first electric actuator 310 and the pressure member 330 so that the regulation member 340 and the ground electrode 110 are separated from each other. In this event, the covering size of the ground electrode 110 with respect to the center electrode 120 is Q, and the spark discharge gap g whose gap size is equal to the first gap size value g1 is formed.

In Step S8 (separation step) in Embodiment 1, as described above, the regulation member 340 abutting against the ground electrode 110 is moved in the X direction so as to separate the both from each other. Accordingly, when the regulation member 340 abutting against the ground electrode 110 is separated from the ground electrode 110, the regulation member 340 can be returned to its position before Step S4 (regulation member positioning step) without changing the gap size (first gap size value g1).

Figure 18:
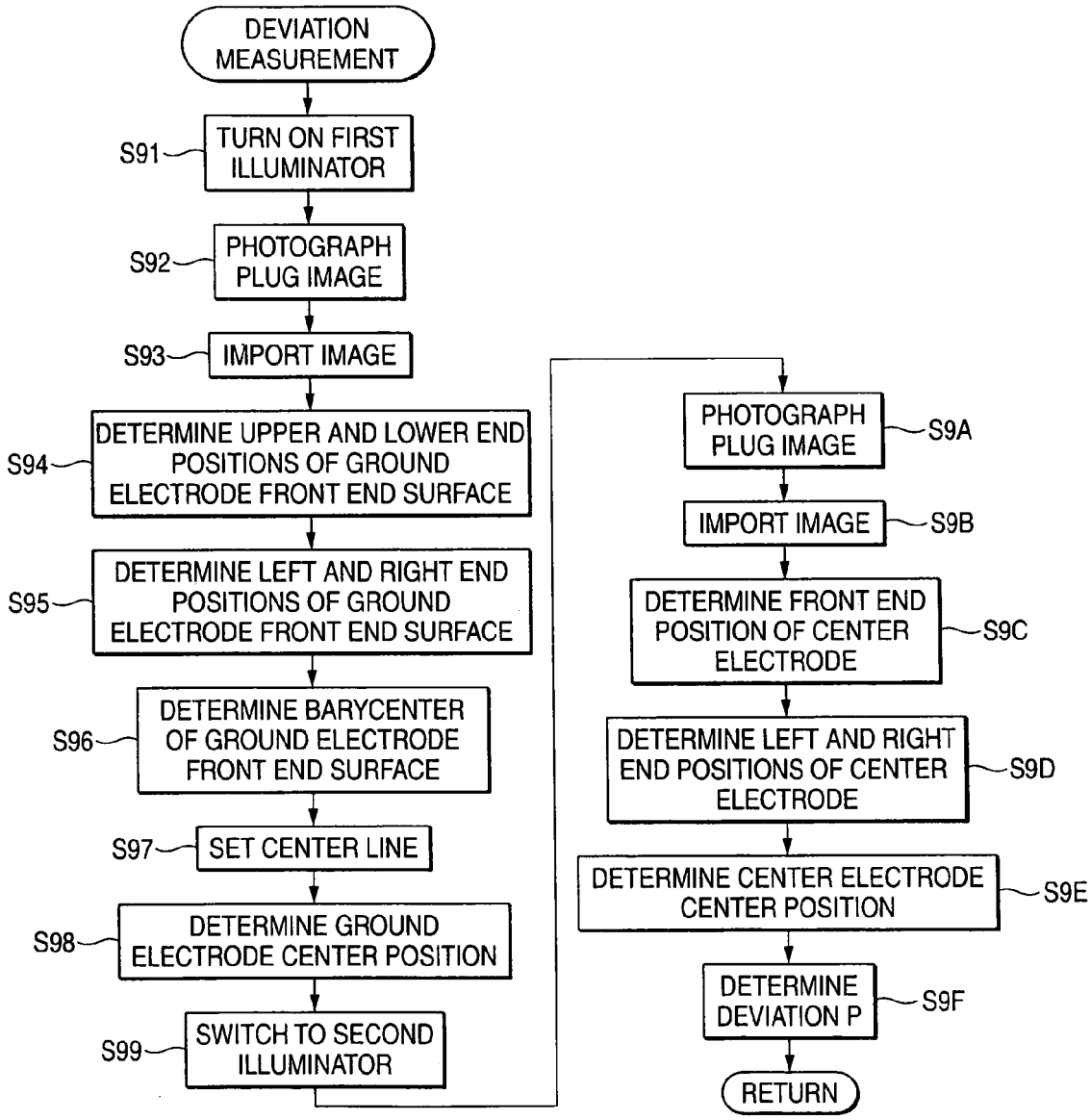
FIG. 18 is a flow chart showing a flow of steps in a deviation measuring process according to Embodiment 1.

Next, in Step S9 (deviation measuring step), the deviation of the ground electrode 110 with respect to the center electrode 120 in the work 101 is measured in a position I in FIG. 2. Specifically, the deviation of the ground electrode 110 with respect to the center electrode 120 in the work 101 is measured by the deviation measuring unit 250 (see FIG. 10). Here, the deviation measuring step will be described in detail with reference to FIG. 18 showing the subroutine of Step S9. First, in Step S91, the first illuminator 252 is turned on. Next, in Step S92, the front end surface 112*c* of the ground electrode 110 seen in brighter relief than any other part of the work 101 illuminated by the first illuminator 252 is photographed by the photographing camera 251 disposed on the X-direction side with respect to the work 101 (see FIG. 10). Next, in Step S93, an image photographed by the photographing camera 251 is imported (see FIG. 11A).

Figure 11A:
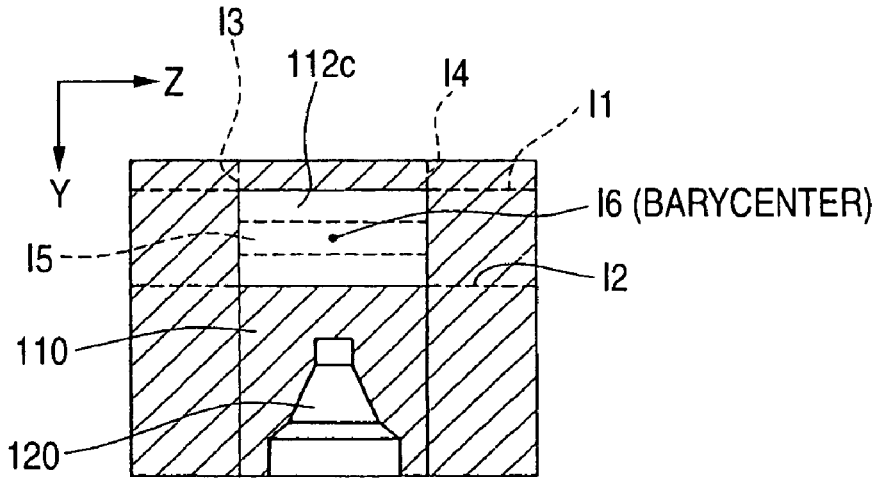
FIGS. 11A and 11B are explanatory views for explaining a method for measuring a ground electrode center position 17 in a deviation measuring step according to Embodiment 1.
Figure 11B:
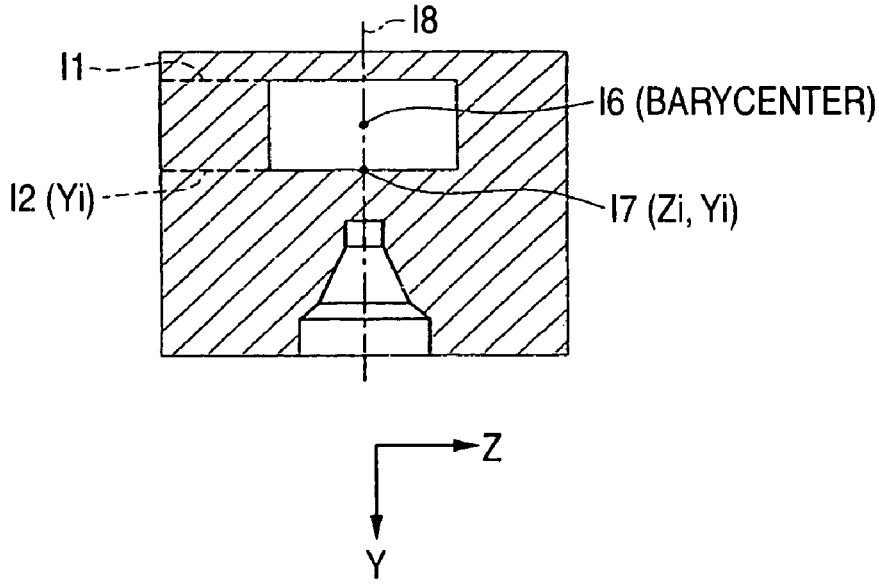

Next, in Step S94, as shown in FIG. 11A, a belt-like determination area having a predetermined width in the Z direction and extending in the Y direction is set in the photographed image, and upper end lower end positions I1 and I2 of the front end surface 112*c* of the ground electrode 110 are determined based on a Y-direction density distribution. Further, in Step S95, a belt-like determination area having a Y-direction width equal to the distance between the upper end position I1 and the lower end position I2 and extending in the Z direction is set, and left and right end positions I3 and I4 of the front end surface 112*c* of the ground electrode 110 are determined based on a Z-direction density distribution. Next, in Step S96, a central 1/3 area 15 in which upper and lower 1/3 areas are excluded from an area surrounded by the positions I1, I2, I3 and I4 is obtained, and a barycentric position 16 of the front end surface 112*c* of the ground electrode 110 is determined based on the obtained area 15. Next, in Step S97, as shown in FIG. 11B, a ground electrode center line I8 passing through the barycentric position I6 and extending in parallel to the central axis C of the metal shell 130 is set. In Step S98, a Z-coordinate corresponding to the lower end position (regarded as Yi) of the ground electrode 110 which position has been obtained is obtained on the ground electrode center line 18 to be Zi, and a point (Zi, Yi) is regarded as a ground electrode center position I7.

Figure 12A:
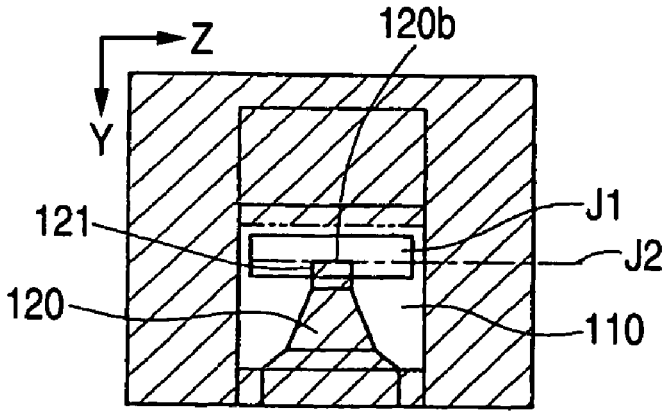
FIGS. 12A, 12B and 12C are explanatory views for explaining a method for measuring a center electrode center position J6 in the deviation measuring step according to Embodiment 1.
Figure 12B:
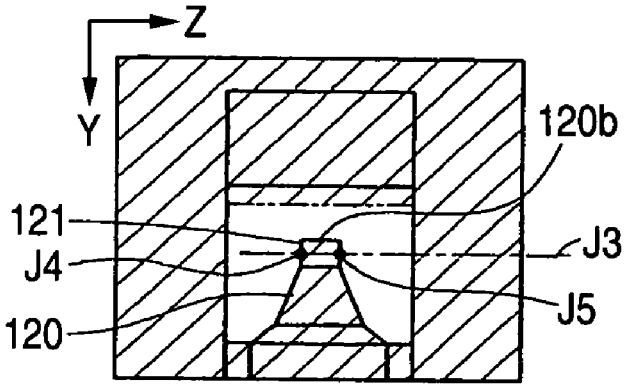
Figure 12C:
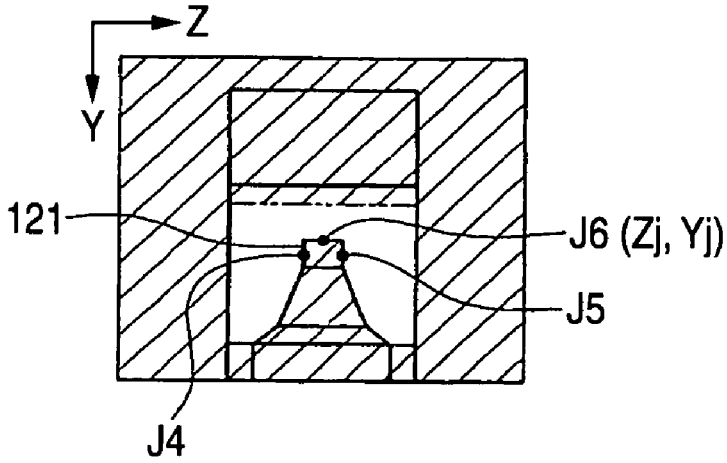

Next, in Step S99, the first illuminator 252 is turned off, and the second illuminator 253 is turned on. In Step S9A, an image in which the center electrode 120 is contoured and the contours thereof are clarified by the contrast with the bright background (see FIG. 12A) is picked up by the photographing camera 251 disposed on the X-direction side with respect to the work 101 (see FIG. 10). Next, in Step S9B, the image photographed by the photographing camera 251 is imported (see FIG. 12A). Next, in Step S9C, as shown in FIG. 12A, a belt-like determination area J1 having a predetermined width in the Y direction and extending in the Z direction is set in an area where the noble metal tip 121 forming the front end 120*b* of the center electrode 120 is expected to exist, and a front end position J2 is determined based on a Y-direction density distribution obtained in each pixel position in the Z direction. Next, in Step S9D, as shown in FIG. 12B, a search line J3 is set in a position shifted from the front end position J2 by a predetermined distance (e.g. 0.1 mm) in the Y direction (downward in FIG. 12B). A Z-direction pixel density distribution is obtained along the search line J3, and the coordinates of a left end position J4 and a right end position J5 are determined based on the obtained pixel density distribution.

Figure 13:
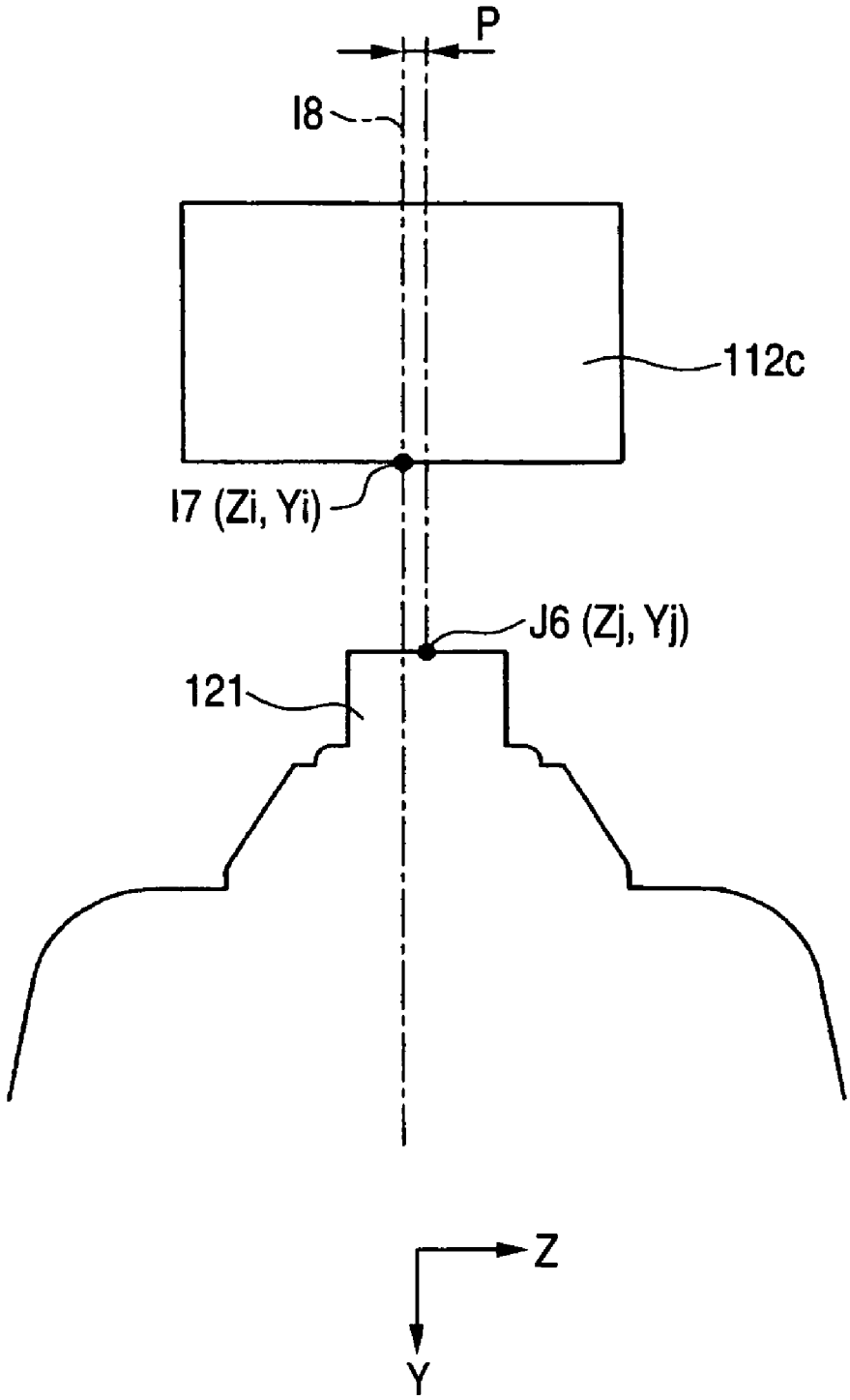
FIG. 13 is an explanatory view for explaining a method for measuring a Z-directional deviation P in the deviation measuring step according to Embodiment 1.

Next, in Step S9E, the average value of the Z-coordinates of the left and right ends of the center electrode is regarded as Zj, and the Y-coordinate of the front end position J2 is regarded as Yj. Thus, the coordinates of the center position J6 of the center electrode are determined as (Zj, Yj) (see FIG. 12C). Next, as shown in FIG. 13, with reference to the ground electrode center line I8 which has been set, it is determined whether the Z-coordinate of the center electrode center position J6 is on the left side or on the right side with respect to the ground electrode center line I8. Thus, the sign of the deviation is determined. This sign serves to define the direction of bending of the ground electrode 110 in Step SA (deviation adjusting step, see FIG. 15) which will be performed later. In Step S9F, the distance between the ground electrode center line I8 and the center electrode center position J6 is calculated as a Z-directional deviation P of the front end surface 112*c* of the ground electrode 110 with respect to the front end 120*b* of the center electrode 120. Then, the routine of processing returns to the main routine shown in FIG. 15.

Next, in Step SA (deviation adjusting step), in a position J in FIG. 2, the Z-directional deviation P of the ground electrode 110 with respect to the center electrode 120 in the work 101 is adjusted to be within a predetermined range. Specifically, the front end portion 112 of the ground electrode 110 is bent in the direction (which is a direction determined in Step S9 (deviation measuring step) and a right direction in FIG. 14 in this embodiment) with which the Z-directional deviation P will be reduced by the deviation adjusting unit 260 shown in FIG. 14. The bending amount (moving distance of the bending member 261) is set to be a value in which a spring-back distance of the ground electrode 110 due to release from an urging force of the bending member 261 is added to the Z-directional deviation P. In such a manner, the Z-directional deviation of the front end surface 112*c* of the ground electrode 110 with respect to the front end 120*b* of the center electrode 120 is adjusted or controlled to be 0.0 mm.

Next, in Step SB (second gap size measuring step), the gap size of the work 101 is measured in a position K in FIG. 2 (see FIG. 2). Specifically, a gap size measuring step (S21 to S2D) similar to Step S2 is carried out to determine the gap size gm (see FIGS. 3 and 4). In Step SC, it is determined whether the gap size gm is or not within a predetermined tolerance range (e.g. g2±0.1(mm)) from the second gap size value g2 (mm) which is an intended value of a final gap size. When the gap size gm is within the predetermined tolerance range, the routine, of processing proceeds to Step SJ (work unloading step), where in a position L in FIG. 2, the work 101 is unloaded from the carrier 211 attached to the linear conveyor 210 at the predetermined interval. Specifically, the work 101 is detached from the cylindrical work holder 212 by the first unloading unit 290 so that the work 101 is unloaded from the carrier 211 of the linear conveyor 210. Thus, the spark plug 100 as shown in FIG. 1 is completed.

On the contrary, when the gap size gm is out of the predetermined tolerance range (e.g. g2±0.1(mm)) from the second gap size value g2 (mm), the routine of processing proceeds to Steps SD-SI, where the following steps are carried out. The following steps are substantially similar to the aforementioned Step S3 (center electrode position measuring step), Step S4 (regulation member positioning step), Step S6 (gap forming step), and Steps S7-S8 (return step). Thus, description about similar parts will be omitted or simplified.

First, in Step SD (second center electrode position measuring step), the position of the front end 120*b* of the center electrode 120 of the work 101 is measured in a position M in FIG. 2 (see FIG. 2). Specifically, a center electrode position measuring step (Steps S31-S36) similar to Step S3 is carried out so that the coordinates (Xg, Yg) of the right end position G4 are stored as the position of the front end 120*b* of the center electrode 120 (see FIGS. 5, 6 and 7A-7B).

Figure 19A:
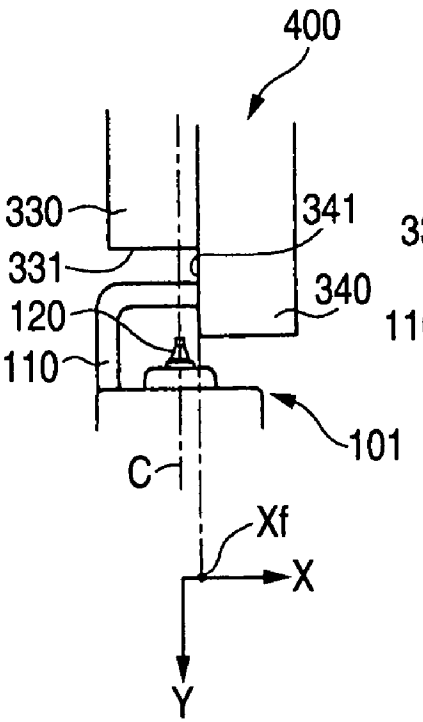
FIGS. 19A, 19B, 19C and 19D are explanatory views for explaining a second regulation member positioning step, a gap adjusting step and a return step according to Embodiment 1.

Next, in Step SE (second regulation member positioning step), the X-directional position of the regulation member 340 of the gap forming unit 300 is positioned in a position N in FIG. 2 (see FIG. 19A). Specifically, a regulation member moving step similar to Step S4 is carried out to move the regulation member 340 in the −X direction so that the X-coordinate of the regulation abutment surface 341 of the regulation member 340 is Xf. In Step SF, a regulation member fixing step similar to Step S5 is carried out to fix the regulation member 340 of the gap forming unit 300. Even when the X-directional position of the front end surface 112*c* of the ground electrode 110 varies in the previous Step SA (deviation adjusting step) so that the covering size is larger than Q, the X-directional position of the front end surface 112*c* of the ground electrode 110 can be returned to its predetermined position (whose X-coordinate is Xf) in this Step SE (second regulation member positioning step).

Figure 19B:
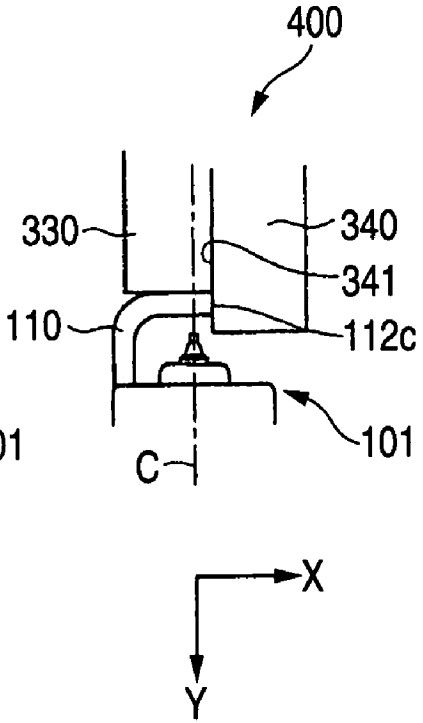
Figure 19C:
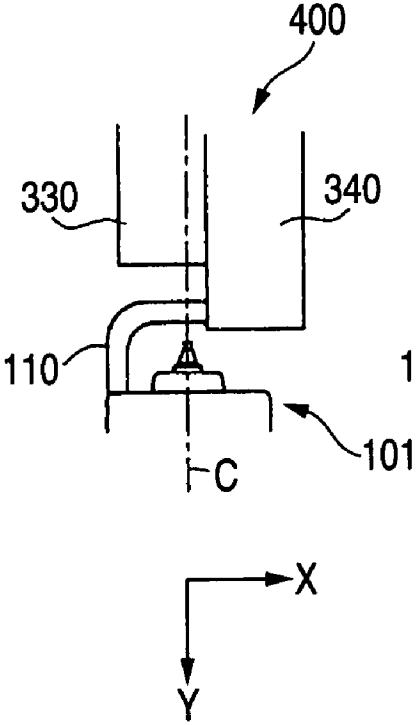
Figure 19D:
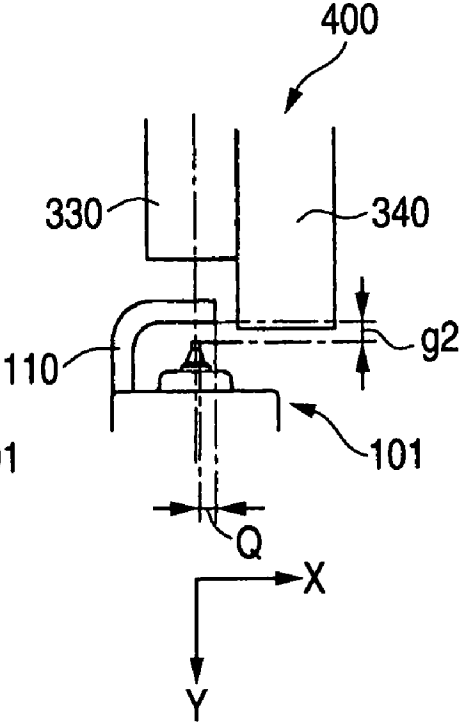

Next, in Step SG (gap adjusting step), in a position N in FIG. 2, the gap size of the spark discharge gap g of the work 101 is adjusted by the gap adjusting unit 400 (see FIG. 19B). Specifically, the difference between the gap size gm measured in Step SD (second gap size measuring step) and the second gap size value g2 (see FIG. 19D) set in advance is calculated and set as the pressure stroke distance of the first electric actuator 310. Based on the pressure stroke distance, the pressure member 330 is moved in the Y direction (downward in FIGS. 19A-19D) by the first electric actuator 310. In this event, as shown in FIG. 19B, the ground electrode 110 is pressed in the Y direction by the pressure member 330 while the front end surface 112*c* of the ground electrode 110 abuts against the regulation abutment surface 341 of the regulation member 340. Therefore, the X-directional position of the front end surface 112*c* of the ground electrode 110 with respect to the front end 120*b* of the center electrode 120 can be regulated and controlled to a predetermined X-directional position.

In the previous Step S6 (gap forming step), the gap size is set as the first gap size value slightly (e.g. 0.05 mm) larger than the second gap size value g2. Therefore, the Y-directional pressure distance in Step SG (gap adjusting step) becomes slight. As a result, the Z-directional deviation of the front end surface 112*c* of the ground electrode 110 with respect to the front end 120*b* of the center electrode 120 in Step SG becomes so slight that there is no concern that the Z-directional deviation adjusted in Step SA (deviation adjusting step) is out of a predetermined range.

Next, in Steps SH and SI (second return step), in a position N in FIG. 2, the pressure member 330 is returned to its position before Step SG (gap adjusting step), and the regulation member 340 is returned to its position before Step SE (second regulation member positioning step). Specifically, a separation step similar to Steps S7-S8 is carried out to separate the pressure member 330 from the ground electrode 110 (see FIG. 19C). Next, the regulation member 340 is separated from the ground electrode 110 (see FIG. 19D). In this event, the covering size of the ground electrode 110 with respect to the center electrode 120 is Q (mm). Thus, the spark discharge gap g whose gap size is equal to the second gap size value g2 is formed.

In Steps SH-SI (second return step), in the same manner as in Steps S7-S8 (first return step), the regulation member 340 abutting against the ground electrode 110 is moved in the X direction so as to separate the both from each other. Accordingly, the regulation member 340 can be returned to its position before Step SE (second regulation member positioning step) without changing the gap size (second gap size value g2).

Finally, in Step SJ (work unloading step), in a position R in FIG. 2, the work 101 is unloaded from the carrier 211 of the linear conveyor 210. Specifically, the work 101 is detached from the work holder 212 of the carrier 211 by the second unloading unit 390 so that the work 101 is moved onto a palette.

In such a manner, the spark plug 100 as shown in FIG. 1 is completed.

Embodiment 2

Next, Embodiment 2 of the invention will be described with reference to FIGS. 20A-20B, 21A-21C and 22. A spark plug manufacturing apparatus 600 according to Embodiment 2 is almost the same as the spark plug manufacturing apparatus 200 according to Embodiment 1 with the exception of a gap forming unit. A method for manufacturing a spark plug 100 according to Embodiment 2 is almost the same as that according to Embodiment 1 with the exception of Steps S4-S5 (regulation member positioning step), Step S6 (gap forming step) and S7-S8 (return step). Description will focus on parts different from those in Embodiment 1, but description about parts similar to those in Embodiment 1 will be omitted or simplified.

Figure 20A:
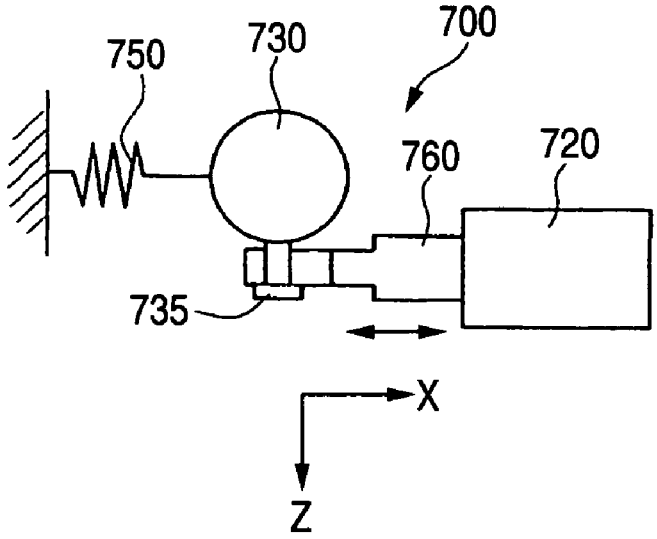
FIGS. 20A and 20B are side views schematically showing a gap forming unit 700 according to Embodiment 2.
Figure 20B:
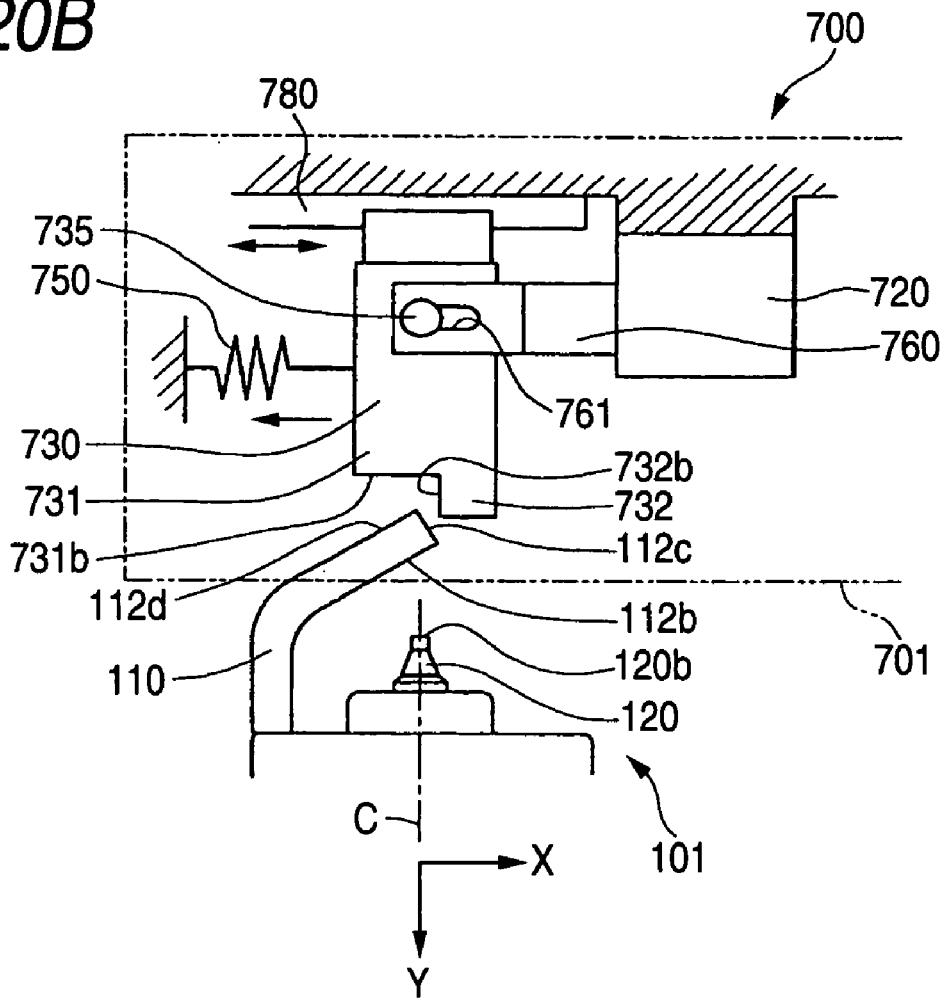

FIGS. 20A and 20B are views schematically showing a gap forming unit 700 according to Embodiment 2. FIG. 20A is a top view thereof, and FIG. 20B is a side view thereof. As shown in FIGS. 20A and 20B, the gap forming unit 700 has a second electric actuator 720 including a servo motor with a brake, a guide 760, a gap forming member 730, a spring 750, a linear bearing 780 and a not-shown first electric actuator. Although the pressure member 330 and the regulation member 340 are formed separately in the gap forming unit 300 according to Embodiment 1, the gap forming member 730 includes a pressure portion 731 and a regulation portion 732 in the gap forming unit 700 according to Embodiment 2. That is, the pressure portion 731 and the regulation portion 732 are formed integrally.

The guide 760 is linked with the second electric actuator 720. The gap forming member 730 is linked with the guide 760 by a pin 735 inserted into a long hole 761 of the guide 760. Although the first electric actuator 310, the pressure member 330 and the regulation member 340 is moved together in the X direction and the −X direction by the second electric actuator 320 in the gap forming unit 300 according to Embodiment 1, the gap forming member 730 is moved in the X direction and the −X direction (left and right directions in FIGS. 20A-20B) in concert with the motion of the guide 760 by the electric actuator 720 in the gap forming unit 700 according to Embodiment 2.

Further, the gap forming member 730 is attached to the linear bearing 780 extending in the X direction. Accordingly, when the gap forming member 730 moves in the X direction or the −X direction, the gap forming member 730 goes straight in the X direction or the −X direction while the Z-directional position thereof is regulated. Moreover, the gap forming member 730 is linked with the spring 750. Thus, as shown in FIG. 20B, before the pressure portion 731 of the gap forming member 730 applies pressure to the ground electrode 110, the gap forming member 730 is designed to be pulled in the −X direction (left direction in FIG. 20B) by the spring 750 so that the pin 735 is located in the left end of the long hole 761.

Further, a gap forming unit 701 including the second electric actuator 720, the guide 760, the gap forming member 730, the spring 750 and the linear bearing 780 is linked with the not-shown first electric actuator integrally. Although the pressure member 330 is moved in the Y direction independently by the first electric actuator 310 in the gap forming unit 300 according to Embodiment 1, the gap forming unit 701 including the gap forming member 730 is moved in the Y direction integrally by the not-shown first electric actuator in the gap forming unit 700 according to Embodiment 2 (see FIG. 20B).

In the gap forming unit 700 configured thus, the gap forming unit 701 including the gap forming member 730 is moved in the Y direction by the not-shown first electric actuator so that the ground electrode 110 is pressed and bent in the Y direction by the pressure portion 731 of the gap forming member 730. Thus, a spark discharge gap g having a predetermined gap size (first gap size value g1 in Embodiment 2) can be formed between the opposed surface 112*b* of the front end portion 112 of the ground electrode 110 and the front end 120*b* of the center electrode 120 (see FIG. 21C). The pressure stroke distance of the not-shown first electric actuator is determined in the same manner as that of the first electric actuator 310 in Embodiment 1. Further, the gap forming member 730 is moved in the Y direction by the determined pressure stroke distance by use of a not-shown load cell and a not-shown pulse counter.

When the gap forming unit 701 is being moved in the Y direction, the guide 760 is fixed with respect to the electric actuator 720. Accordingly, when the ground electrode 110 is pressed and bent by the pressure portion 731 of the gap forming member 730, the front end surface 112*c* of the ground electrode 110 abuts against a regulation abutment surface 732*b* of the regulation portion 732. The regulation abutment surface 732*b* of the regulation portion 732 moves in the X direction (right direction in the drawings) together with the front end surface 112*c* of the ground electrode 110 while the regulation abutment surface 732*b* of the regulation portion 732 abuts against the front end surface 112*c* of the ground electrode 110 together with the pin 735 moving in the X direction (right direction in the drawings) in the long hole 761. After that, as soon as the pin 735 reaches the right end of the long hole 761, the X-directional position of the gap forming member 730 is regulated so that the X-directional position of the regulation abutment surface 732*b* of the regulation portion 732 is fixed. Thus, the X-directional position of the front end surface 112*c* of the ground electrode 110 can be regulated by the regulation abutment surface 732*b* (see FIG. 21B).

In Embodiment 2, the ground electrode 110 is pressed by the gap forming member 730. As soon as the pin 735 reaches the right end of the long hole 761 of the guide 760, the X-directional position of the long hole 761 of the guide 760 is positioned so that the regulation abutment surface 732*b* of the regulation portion 732 is located in a predetermined X-directional position. In such a manner, the X-directional position of the front end surface 112*c* of the ground electrode 110 with respect to the front end 120*b* of the center electrode 120 can be regulated at a predetermined X-directional position.

In addition, in the same manner as the pressure abutment surface 331 of the pressure member 330 according to Embodiment 1, the pressure abutment surface 731*b* of the pressure portion 731 according to Embodiment 2 is subjected to surface treatment with diamond-like carbon so that the friction coefficient with the ground electrode abutment surface 112d of the ground electrode 110 is made not higher than 0.2. It is therefore easy for the ground electrode 110 to slide in the X direction on the pressure abutment surface 731*b* of the pressure portion 731. Thus, when the ground electrode 110 is deformed by the pressure portion 731, the ground electrode 110 is deformed smoothly not only in the Y direction but also in the X direction, so that the X-directional position of the front end surface 112*c* of the ground electrode 110 can be regulated by the regulation portion 732.

Next, description will be made about the method for manufacturing the spark plug 100 according to Embodiment 2.

Figure 22:
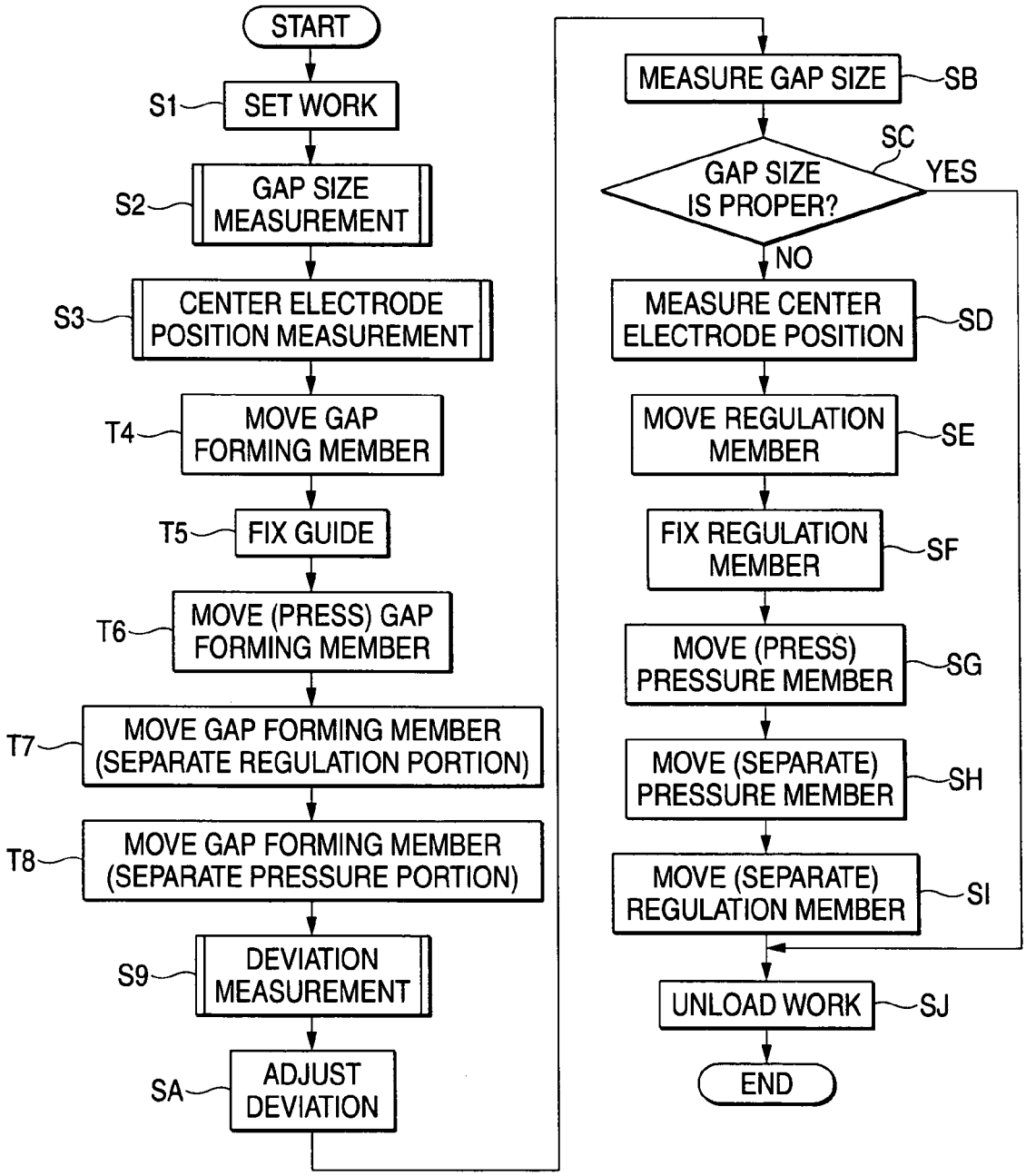
FIG. 22 is a flow chart showing a flow of steps in a method for manufacturing the spark plug 100 according to Embodiment 2.

FIG. 22 is a flow chart (main routine) showing the flow of steps in the method for manufacturing the spark plug 100. Description will be made below along this flow chart and the general view of the spark plug manufacturing apparatus 600 in FIG. 2. Incidentally, the manufacturing method according to Embodiment 2 is the same as that according to Embodiment 1, except that the processing of Steps S4-S8 in Embodiment 1 is replaced by the processing of Steps T4-T8 as shown in FIG. 22. Description about the same parts as those in Embodiment 1 will be omitted or simplified.

First, in the same manner as in Embodiment 1, the work 101 is set in Step S1 (work setting step). Next, in Step S2 (first gap size measuring step), the gap size of the work 101 is measured. Next, in Step S3 (center electrode position measuring step), the position of the front end 120*b* of the center electrode 120 in the work 101 is measured.

Next, in Steps T4-T5 (guide positioning step), the X-directional position of the guide 760 of the gap forming unit 700 is positioned in a position H in FIG. 2. Specifically, first, in Step T4, the predetermined covering size Q (see FIG. 1) of the ground electrode 110 with respect to the center electrode 120 and an amount with which the ground electrode 110 is expected to spring back in the −X direction after pressure are added to the X-coordinate Xg of the front end 120*b* Qf the center electrode 120 measured in the previous Step S3 (center electrode position measuring step). Thus, an X-coordinate Xf is calculated. A moving distance of the second electric actuator 720 is calculated so that the X-coordinate of the regulation abutment surface 732*b* of the regulation portion 732 will be Xf when the pin 735 reaches the right end of the long hole 761 (see FIG. 21B). Further, the calculated moving distance is converted into an intended number of revolutions of the servo motor of the second electric actuator 720 corresponding thereto.

Figure 21A:
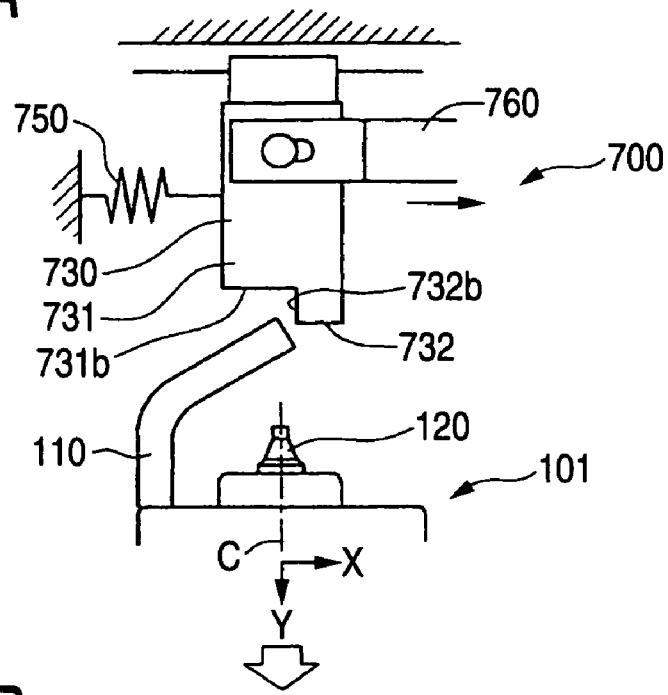
FIGS. 21A, 21B and 21C are explanatory views for explaining a regulation member positioning step, a gap forming step and a return step according to Embodiment 2.

Next, the gap forming member 730 is moved in the X direction (right direction in FIGS. 20A-20B) together with the guide 760 by the second electric actuator 720. In this event, the number of revolutions of the motor of the second electric actuator 720 is measured by a not-shown pulse counter. As soon as the value measured by the pulse counter reaches the intended number of revolutions, the movement is regarded as terminated, and the motor of the second electric actuator 720 is suspended. After that, in Step T5, the brake of the servo motor of the second electric actuator 720 is operated to fix the guide 760 in that position. In this event, the gap forming member 730 is pulled in the −X direction (left direction in FIGS. 20A-20B) by the spring 750 so that the pin 735 is located in the left end of the long hole 761 of the guide 760. In such a manner, the X-directional position of the guide 760 is positioned as shown in FIG. 21A. Incidentally, Steps T4-T5 (guide positioning step) in Embodiment 2 correspond to the regulation member positioning step.

Next, in Step T6 (gap forming step), the spark discharge gap g of the work 101 is formed. Specifically, first, a difference between the gap size gm measured in Step S2 (gap size measuring step) and the first gap size value g1 (see FIG. 21C) set in advance is calculated and set as a pressure stroke distance of the not-shown electric actuator. In Embodiment 2, in the same manner as in Embodiment 1, the value of the first gap size value g1 is set to be slightly larger (for example, 0.05 mm larger) than the second gap size value g2 equal to the gap size of the spark plug 100.

Figure 21B:
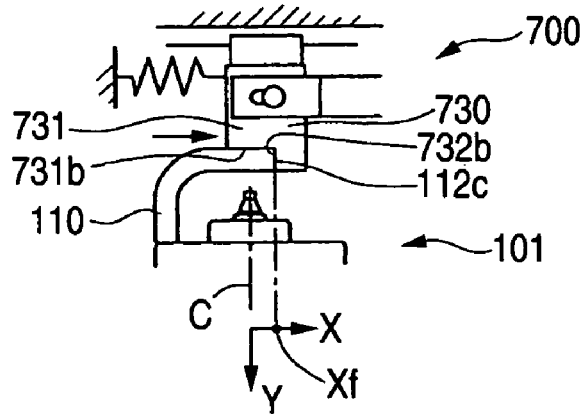

Next, the gap forming unit 701 (gap forming member 730) is moved in the Y direction (downward in FIG. 21A) by the not-shown electric actuator. Then, the gap forming member 730 is moved in the Y direction by the determined pressure stroke distance by use of the not-shown load cell and the not-shown pulse counter. In this event, as shown in FIG. 21B, the ground electrode 110 is pressed and bent in the Y direction by the pressure portion 731 so that the front end surface 112*c* of the ground electrode 110 abuts against the regulation abutment surface 732*b* of the regulation portion 732. The X-directional position of the regulation abutment surface 732*b* is regulated by the X-directional position of the pin 735 regulated in the right end of the long hole 761 of the guide 760. Accordingly, the X-directional position of the front end surface 112*c* of the ground electrode 110 with respect to the front end 120*b* of the center electrode 120 can be regulated in a predetermined X-directional position.

Figure 21C:
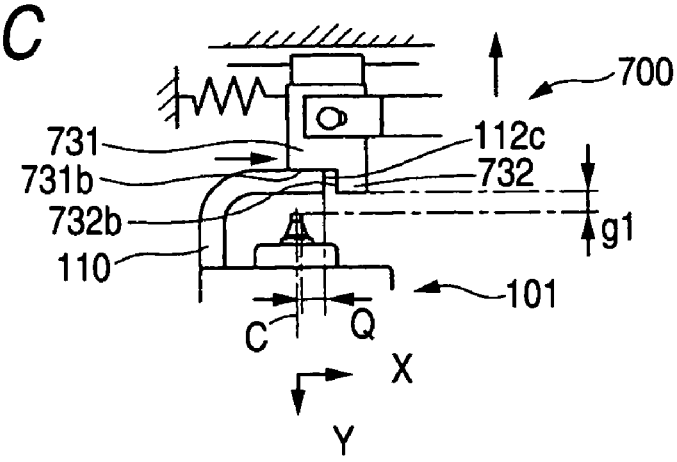

Next, in Steps T7 and T8 (return step), the gap forming member 730 is returned to its position before Step T4 (guide positioning step). Specifically, first, in Step T7 (separation step), as shown in FIG. 21C, the gap forming member 730 is moved in the X direction (right direction in FIG. 21C) by the second electric actuator 720 so that the front end surface 112*c* of the ground electrode 110 and the regulation abutment surface 732*b* of the regulation portion 732 are separated from each other. Next, in Step T8, the motor of the not-shown first electric actuator is rotated reversely by the same number of revolutions as that in Step T6 (gap forming step). Thus, the gap forming unit 701 including the gap forming member 730 is moved in the −Y direction (upward in FIG. 21C). Next, the gap forming member 730 is moved in the −X direction (left direction in FIG. 21C) by the second electric actuator 720. In such a manner, the gap forming member 730 is returned to its position before Step T4 (guide positioning step). In this event, the covering size of the ground electrode 110 with respect to the center electrode 120 is Q, and the spark discharge gap g whose gap size is equal to the first gap size value g1 is formed.

In Step T7 (separation step) in Embodiment 2, in the same manner as in Step S7 (separation step) in Embodiment 1, the regulation portion 732 of the gap forming member 730 abutting against the front end surface 112*c* of the ground electrode 110 is moved in the X direction so as to separate the both from each other. Accordingly, there is no fear that the gap size (first gap size value g1) is changed when the gap forming member 730 abutting against the ground electrode 110 is separated from the ground electrode 110.

Next, in Step S9 (deviation measuring step), in the same manner as in Embodiment 1, the deviation of the ground electrode 110 with respect to the center electrode 120 in the work 101 is measured. Further, in Step SA (deviation adjusting step), the Z-directional deviation P of the ground electrode 110 with respect to the center electrode 120 in the work 101 is adjusted to be within a predetermined range.

Next, in Step SB (second gap size measuring step), the gap size of the work 101 is measured (see FIG. 2). Specifically, the gap size gm is determined by a gap size measuring process similar to that in Embodiment 1 (see FIGS. 3 and 4). In Step SC, it is determined whether the gap size gm is or not within a predetermined tolerance range (e.g. g2±0.1(mm)) from the second gap size value g2 (mm) which is an intended value of a final gap size. When the gap size gm is within the predetermined tolerance range, the routine of processing proceeds to Step SJ (work unloading step), where the work 101 is unloaded from the carrier 211 of the linear conveyor 210 (SJ). Thus, the spark plug 100 as shown in FIG. 1 is completed.

On the contrary, when the gap size gm is out of the predetermined tolerance range (e.g. g2±0.1(mm)) from the second gap size value g2 (mm), Step SD (second center electrode position measuring step), Steps SE-SF (regulation member positioning step), Step SG (gap adjusting step), Steps SH-SI (return step) and Step SJ (work unloading step) are carried out in that order in the same manner as in Embodiment 1.

In such a manner, the spark plug 100 as shown in FIG. 1 is completed.

Embodiment 3

Next, Embodiment 3 of the invention will be described with reference to the drawings.

Figure 23:
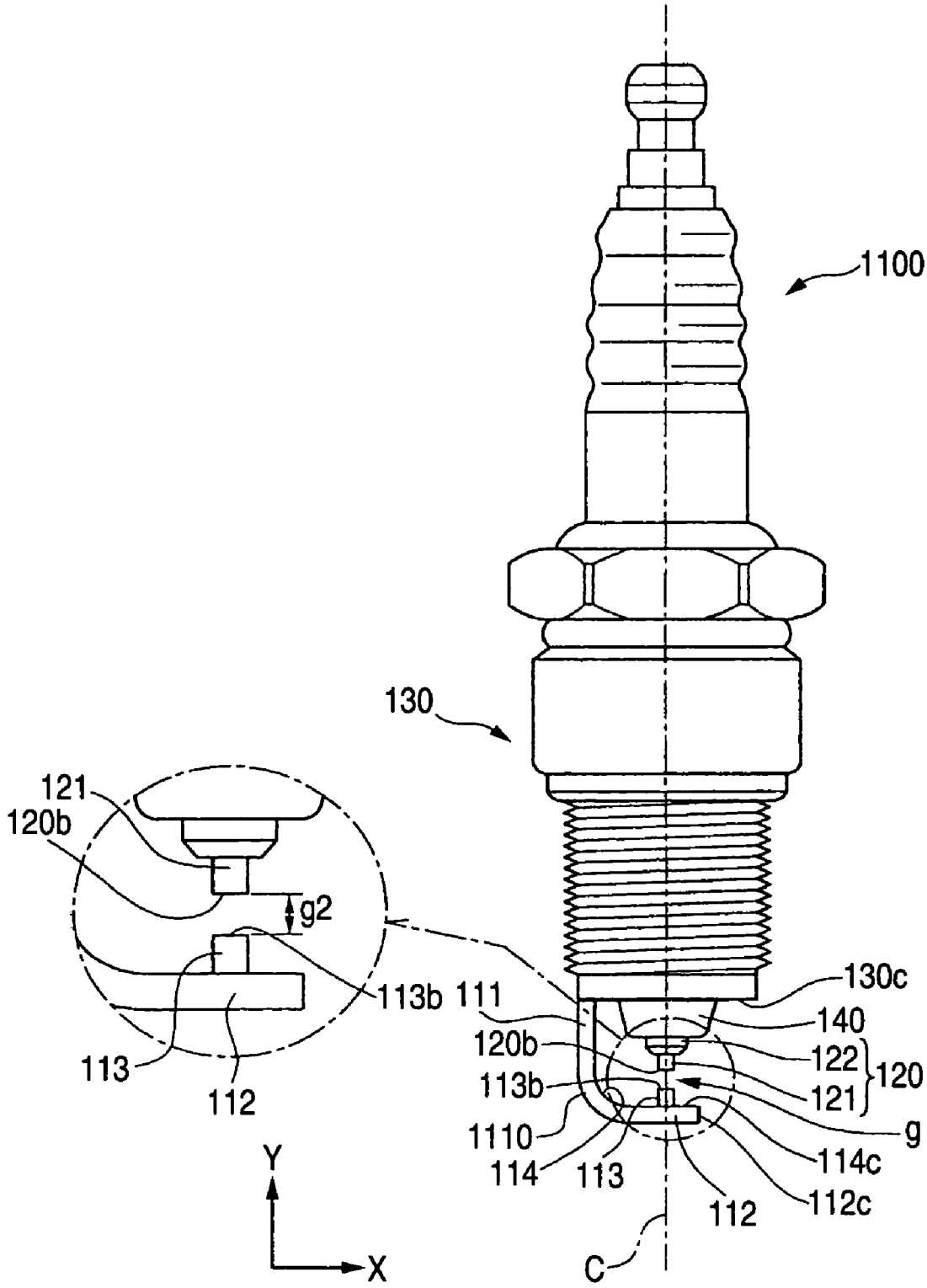
FIG. 23 is a side view of a spark plug 1100 according to Embodiment 3.

A spark plug 1100 according to Embodiment 3 is similar to the spark plug 100 according to Embodiment 1, except that a noble metal tip 113 is provided in a ground electrode as shown in FIG. 23. Specifically, the noble metal tip 113 is welded with an inner side surface 114 of a ground electrode 1110 so as to be opposed to the front end 120*b* of the center electrode 120. A spark discharge gap g is formed between a front end 113B of the noble metal tip 113 and the front end 120*b* of the center electrode 120. As shown in the enlarged view of FIG. 23, the gap size of the spark discharge gap g is g2 (mm) (corresponding to the second gap size).

Figure 24:
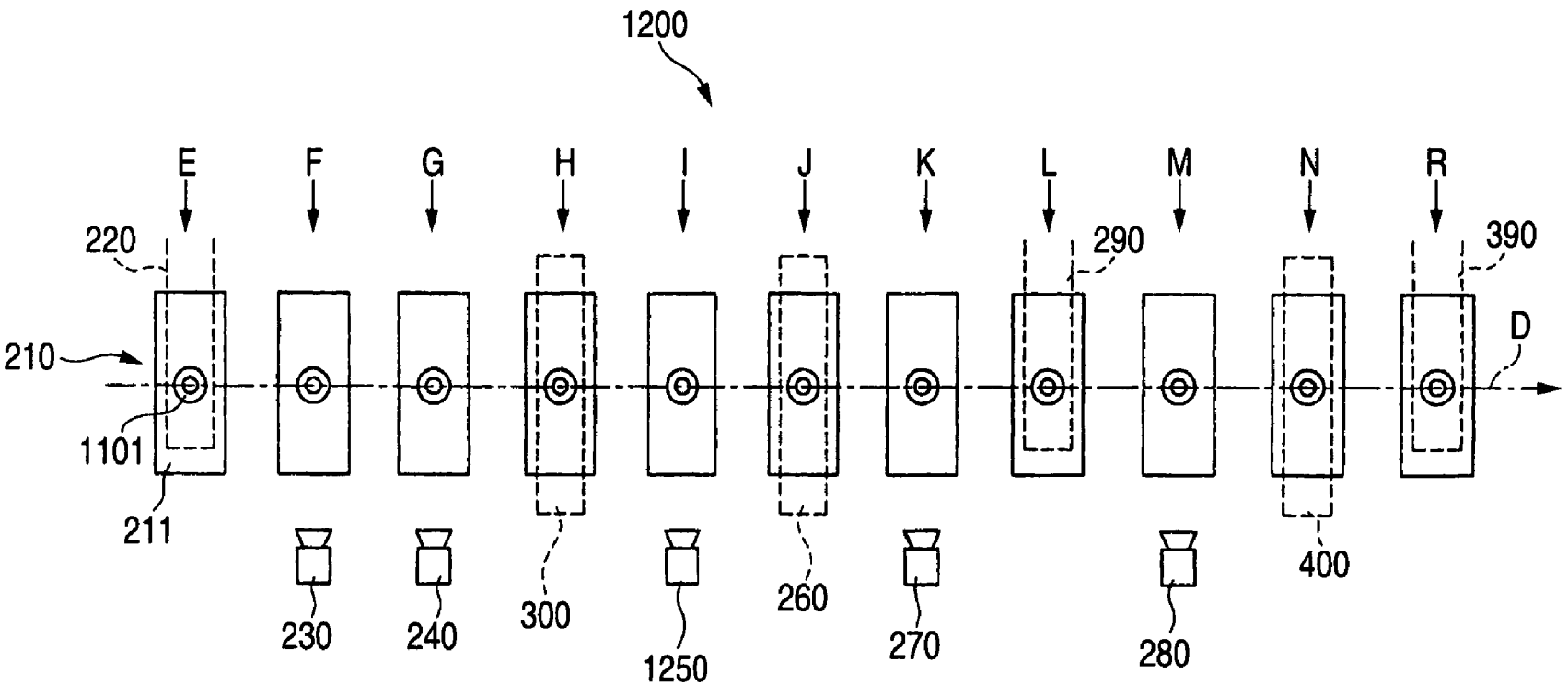
FIG. 24 is a top view schematically showing a spark plug manufacturing apparatus 1200 according to Embodiment 3.

A spark plug manufacturing apparatus 1200 according to Embodiment 3 is almost the same as the spark plug manufacturing apparatus 200 according to Embodiment 1, except that the deviation measuring unit 250 is replaced by a deviation measuring unit 1250 as shown in FIG. 24.

Figure 32:
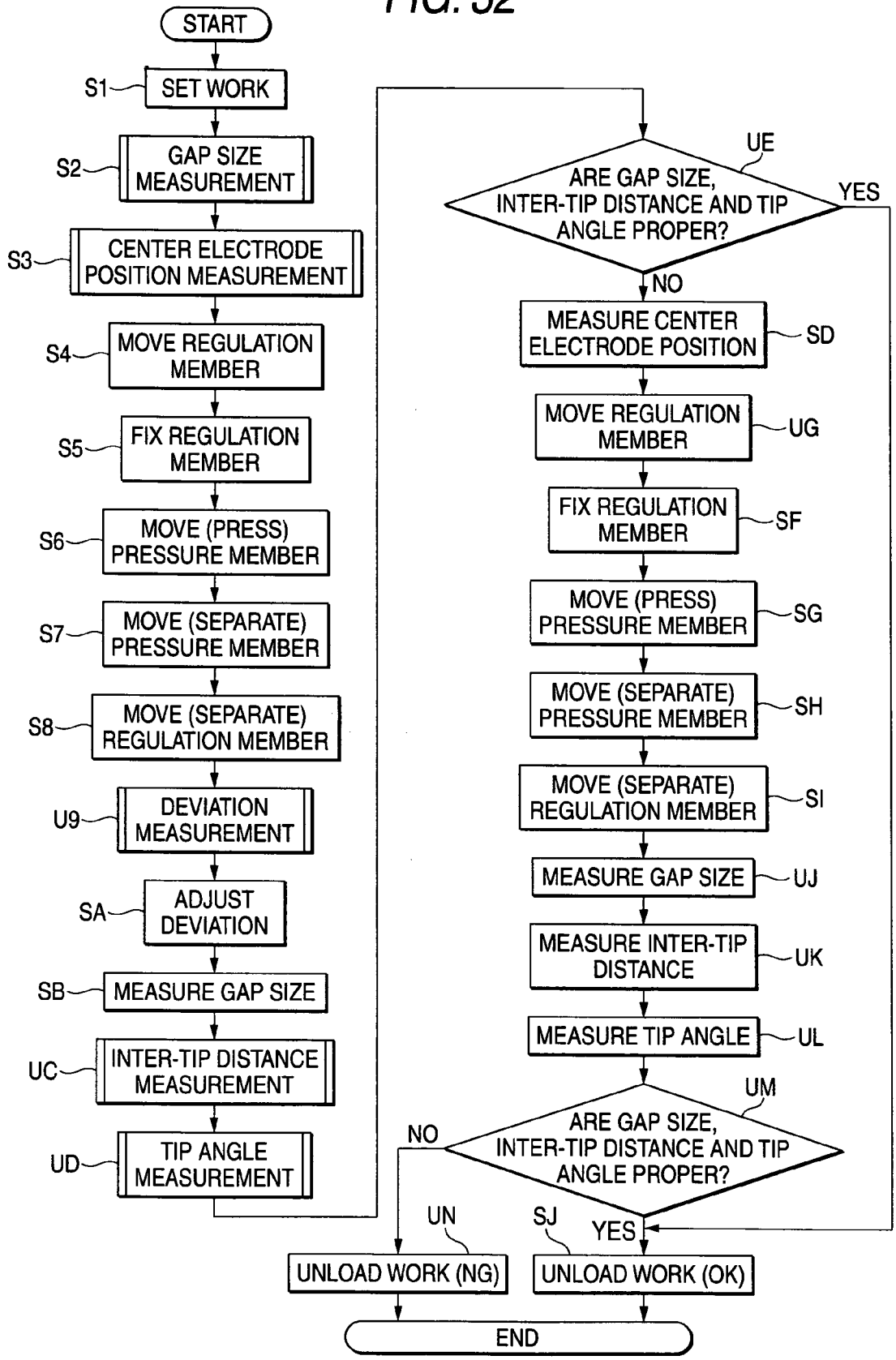
FIG. 32 is a flow chart showing a flow of steps in a method for manufacturing the spark plug 1100 according to Embodiment 3.

In a method for manufacturing the spark plug 1100 according to Embodiment 3, Step S9 (deviation measuring step) and Step SE (second regulation member positioning step) in the manufacturing method according to Embodiment 1 are replaced by Step U9 and Step UG (see FIGS. 15 and 32). Further, in the manufacturing method according to Embodiment 3, Step UC (first inter-tip distance measuring step), Step UD (first tip angle measuring step), Step UJ (third gap size measuring step), Step UK (second inter-tip distance measuring step) and Step UL (second tip angle measuring step) are added newly. The other steps are almost the same as those in the manufacturing method according to Embodiment 1. Therefore, description will focus on parts different from those in Embodiment 1, and description about similar parts will be omitted or simplified.

Figure 26:
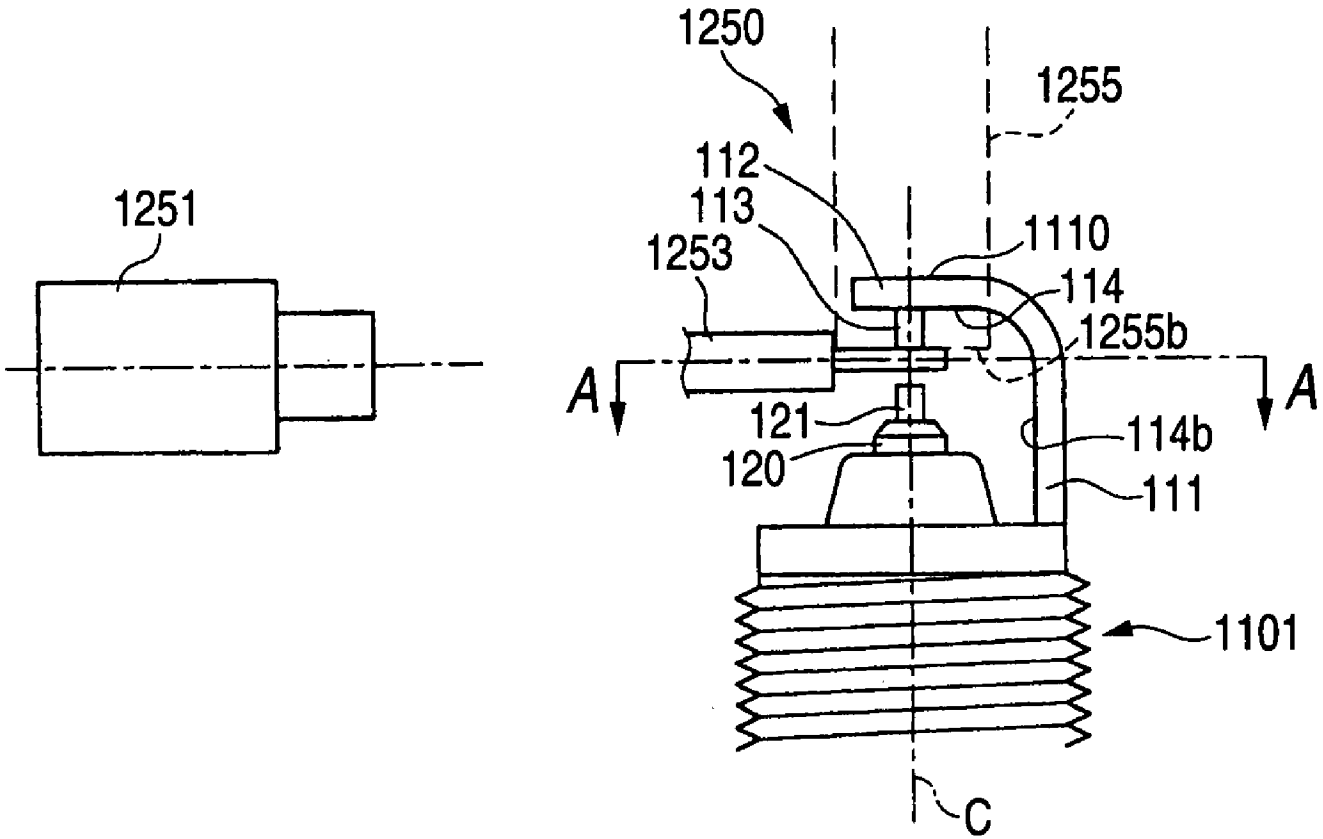
FIG. 26 is a side view schematically showing a deviation measuring unit 1250 according to Embodiment 3.

FIG. 26 is a side view schematically showing the deviation measuring unit 1250 according to Embodiment 3. As shown in FIG. 26, the deviation measuring unit 1250 is constituted by first illuminators 1253, a ground electrode chuck 1255, a photographing camera 1251 and a not-shown computer connected to the photographing camera 1251.

Figure 28A:
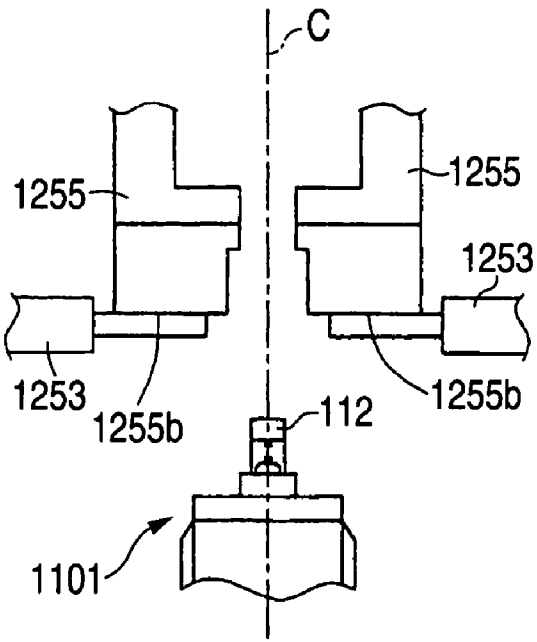
FIGS. 28A, 28B and 28C are explanatory views for explaining a chuck for a ground electrode 1110 in a deviation measuring step according to Embodiment 3.
Figure 28B:
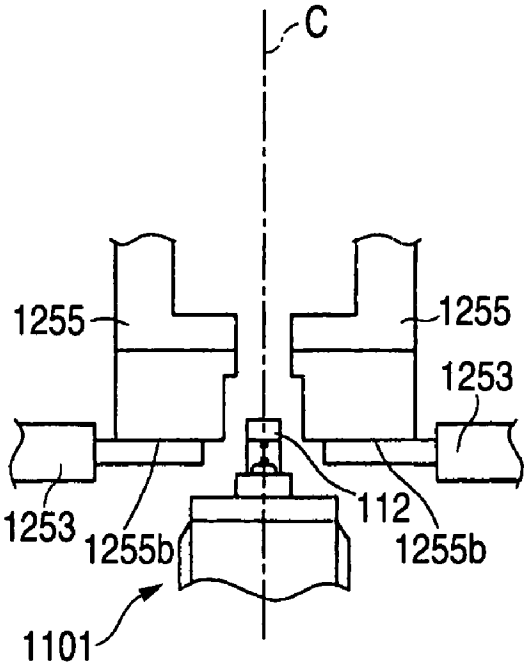
Figure 28C:
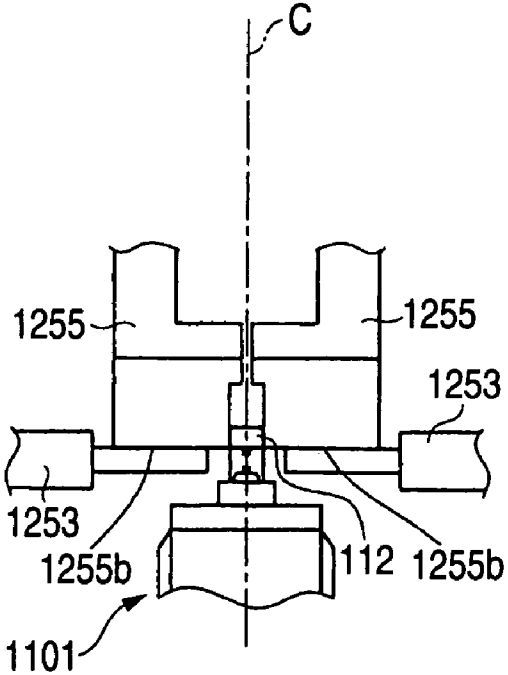

The ground electrode chuck 1255 holds a front end portion 112 of a ground electrode 1110 and rotates a to-be-formed spark plug (hereinafter also referred to as "work") 1101 around a central axis C so as to adjust the direction of the work 1101 with respect to the photographing camera 1251 (see FIGS. 28A-28C).

The photographing camera 1251 is, for example, a CCD camera. When the direction of the work 1101 is adjusted by the ground electrode chuck 1255 as described above, it is possible to acquire an image in which a center electrode 120 of the work 1101 is located on the near side and a base portion 111 of the ground electrode 1110 is located on the far side so that the center electrode 120 overlaps with the base portion 111 of the ground electrode 1110.

Figure 27:
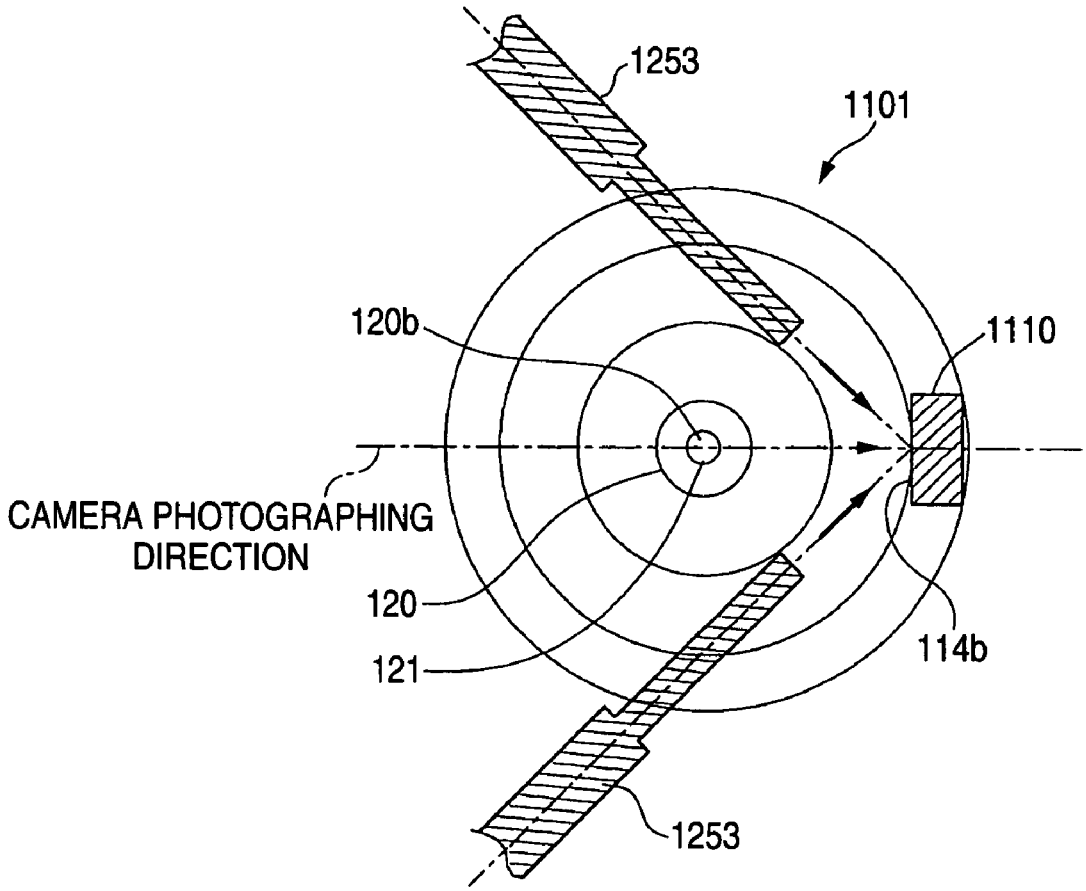
FIG. 27 is an explanatory view for explaining a method for illumination using first illuminators 1253, showing a sectional view taken on line A-A in FIG. 26.

The first illuminators 1253 are optical fiber illuminations, which are fixedly provided in a lower end surface 1255*b* of the ground electrode chuck 1255 so as to illuminate, of the inner side surface 114 of the ground electrode 1110, a back portion 114*b* located to be farther than the center electrode 120 when the work 1101 is viewed from the photographing camera 1251. Further, a sectional view taken on line A-A in FIG. 26 is shown in FIG. 27 for explaining the first illuminators 1253 in more detail. As shown in FIG. 27, two first illuminators 1253 are provided in symmetric positions with respect to the center electrode 120. Each first illuminator 1253 is disposed to illuminate the back portion 114*b* of the ground electrode 1110 with light in an oblique direction shifted by about 45 degrees from the camera photographing direction (right direction in FIG. 27). When the back portion 114*b* of the ground electrode 1110 is illuminated by the first illuminators 1253, light reflected by the back portion 114*b* of the ground electrode 1110 is blocked by the noble metal tip 121 of the center electrode 120 and the noble metal tip 113 of the ground electrode 1110. As a result, an image in which the contours of the noble metal tip 121 of the center electrode 120 and the noble metal tip 113 of the ground electrode 1110 are clarified by the back portion 114*b* of the ground electrode 1110 serving as the bright background can be acquired by the photographing camera 1251 (see FIGS. 29A-29C).

Based on the image photographed thus, the position of the noble metal tip 113 of the ground electrode 1110 and the position of the noble metal tip 121 of the center electrode 120 are determined by the not-shown computer as will be described later. Specifically, in Embodiment 3, the center position of the front end 113B of the noble metal tip 113 of the ground electrode 1110 is determined as a ground electrode center position 16 (see FIG. 29C), and the center position of the front end 120*b* of the center electrode 120 (noble metal tip 121) is determined as a center electrode center position J6 (see FIG. 30C). Based on the ground electrode center position 16 and the center electrode center position J6, a Z-directional deviation P of the noble metal tip 113 of the ground electrode 1110 with respect to the noble metal tip 121 of the center electrode 120 is calculated (see FIG. 31).

Next, description will be made about the method for manufacturing the spark plug 1100 according to Embodiment 3.

FIG. 32 is a flow chart (main routine) showing a flow of steps in the method for manufacturing the spark plug 1100. Description will be made below along this flow chart.

Figure 25:
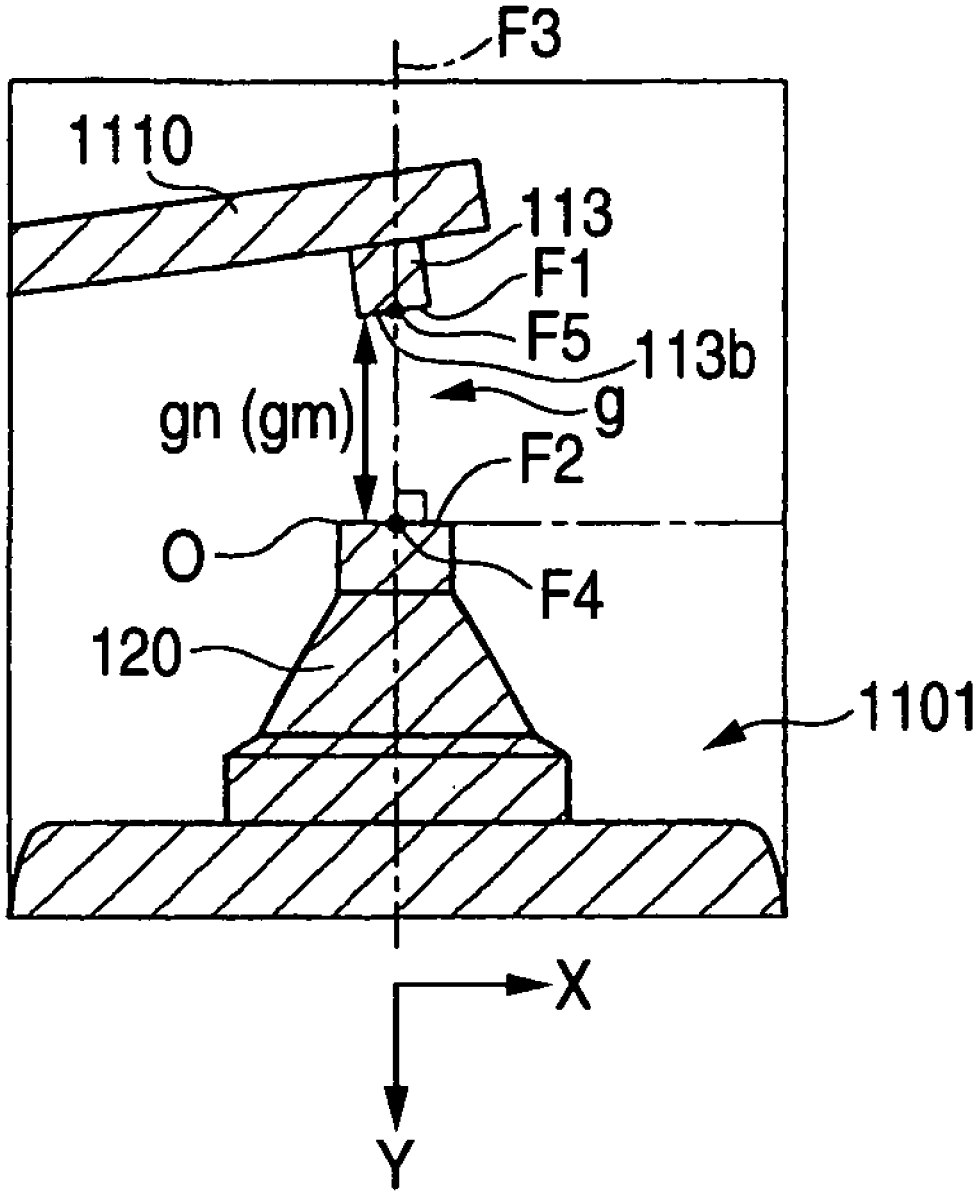
FIG. 25 is an explanatory view for explaining a gap size measuring step according to Embodiment 3.

First, in the same manner as in Embodiment 1, in Step S1 (work setting step), the work 1101 is set. Next, in Step S2 (first gap size measuring step), the gap size of the work 1101 is measured in the same manner as in Embodiment 1. Specifically, a minimum gap size gm is determined by a gap size measuring process similar to that in Embodiment 1. In Embodiment 3, based on a photographed image as shown in FIG. 25, an edge F1 on the ground electrode 1110 side and an edge F2 on the center electrode 120 side are determined in Steps S23-S24 (see FIG. 16). In Embodiment 3, due to the noble metal tip 113 provided in the ground electrode 1110, the edge F1 is determined in the position of the front end surface 113b of the noble metal tip 113. Next, in Step 3 (first center electrode position measuring step), the position of the front end 120*b* of the center electrode 120 of the work 1101 is measured. Specifically, the coordinates of a right end position G4 of the noble metal tip 121 are measured and stored as the position of the front end 120*b* of the center electrode 120 (see FIGS. 7A-7B).

Further, in the same manner as in Embodiment 1, in Steps S4-S5 (regulation member positioning step), the X-directional position of the regulation member 340 of the gap forming unit 300 is positioned. In Step S6 (gap forming step), a spark discharge gap g of the work 1101 is formed. After that, in Steps S7-S8 (return step), the pressure member 330 and the regulation member 340 are returned to their positions before Steps S6 and S4 respectively. Thus, in the same manner as in Embodiment 1, the covering size of the ground electrode 1110 with respect to the center electrode 120 becomes Q, and the spark discharge gap g whose gap size is equal to the first gap size value g1 is formed (see FIGS. 9A-9D).

Next, in Step U9 (deviation measuring step), a deviation of the ground electrode 1110 with respect to the center electrode 120 in the work 1101 is measured in a position I in FIG. 24. Specifically, a Z-directional deviation P of the noble metal tip 113 of the ground electrode 1110 with respect to the noble metal tip 121 of the center electrode 120 is measured by the deviation measuring unit 1250 (see FIG. 31).

Figure 33:
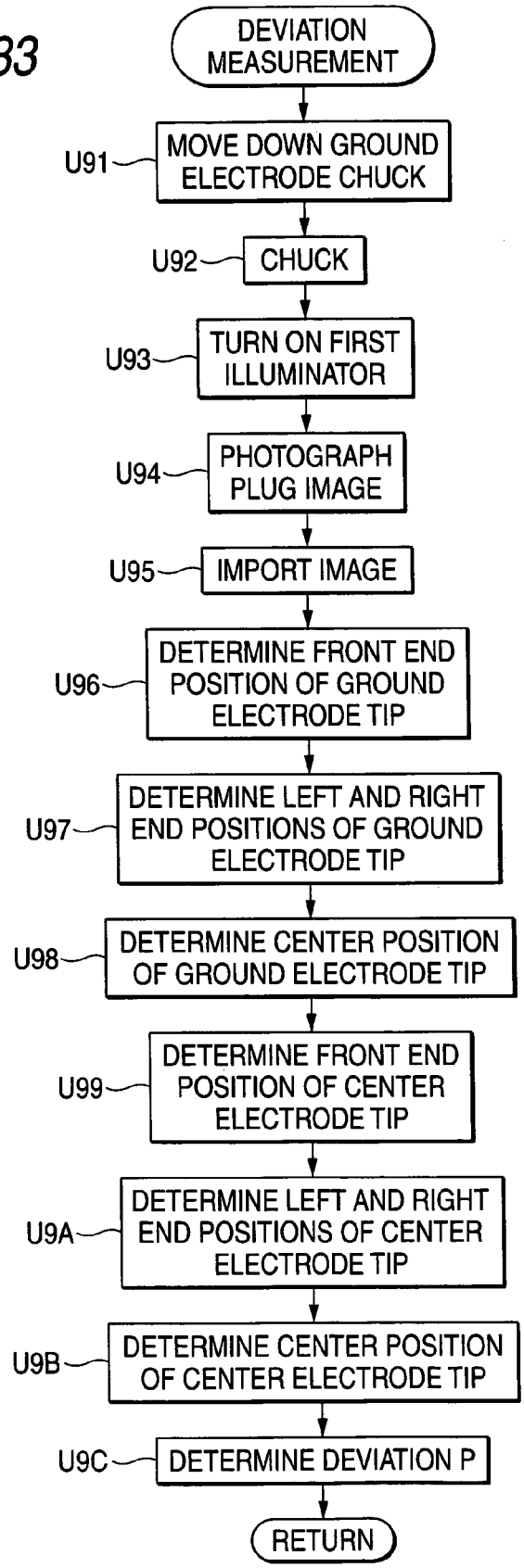
FIG. 33 is a flow chart showing a flow of a deviation measuring process according to Embodiment 3.

Here, the deviation measuring process will be described in detail with reference to FIG. 33 showing the subroutine of Step U9. First, in Step U91, the ground electrode chuck 1255 is moved down from above the work 1101 (see FIG. 28A), and stopped in a predetermined position (see FIG. 28B). Next, in Step U92, the work 1101 is rotated around the central axis C while the front end portion 112 of the ground electrode 1110 is grasped by the ground electrode chuck 1255. In this manner, the direction of the work 1101 with respect to the photographing camera 1251 disposed in a predetermined position is adjusted (see FIG. 28C). Thus, an image in which the center electrode 120 is located on the near side and a base portion 111 of the ground electrode 1110 is located on the far side so that the center electrode 120 overlaps with the base portion 111 of the ground electrode 1110 can be acquired by the photographing camera 1251. At the same time, the first illuminators 1253 fixedly provided in the lower end surface 1255*b* of the ground electrode chuck 1255 are disposed in predetermined positions (see FIGS. 26 and 27).

Next, in Step U93, the first illuminators 1253 are turned on so as to illuminate the back portion 114*b* of the ground electrode 1110 with light (see FIG. 27). Next, in Step U94, an image in which the contours of the noble metal tip 121 of the center electrode 120 and the noble metal tip 113 of the ground electrode 1110 are clarified by the back portion 114*b* of the ground electrode 1110 serving as the bright background is photographed by the photographing camera 1251 (see FIG. 26). Next, in Step U95, the image photographed by the photographing camera 1251 is imported (see FIG. 29A). According to Embodiment 3, in such a manner, an image in which both the noble metal tip 121 of the center electrode 120 and the noble metal tip 113 of the ground electrode 1110 are clear can be acquired by one-time photographing.

Figure 29A:
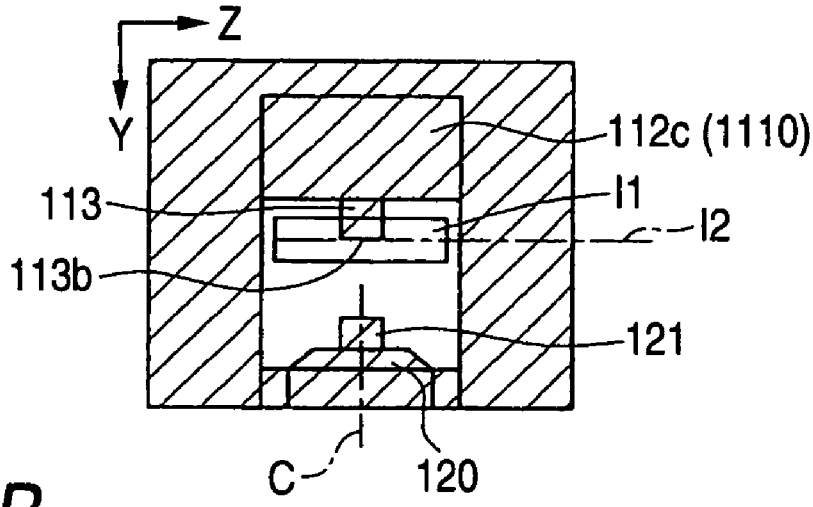
FIGS. 29A, 29B and 29C are explanatory views for explaining a method for measuring a ground electrode center position I6 in the deviation measuring step according to Embodiment 3.
Figure 29B:
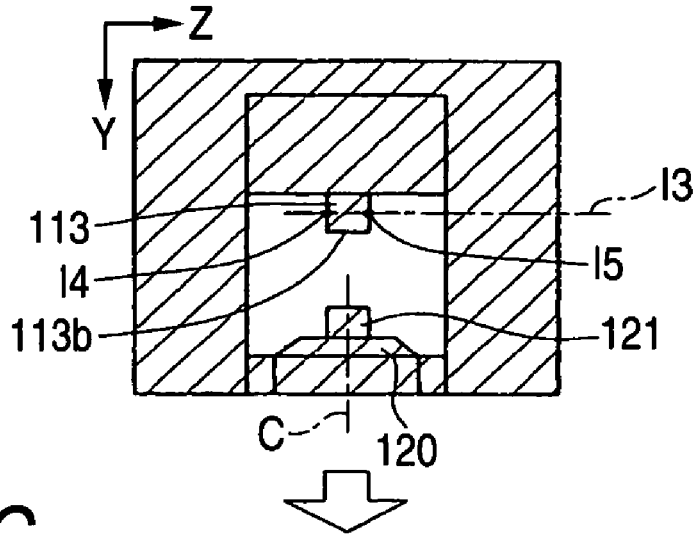
Figure 29C:
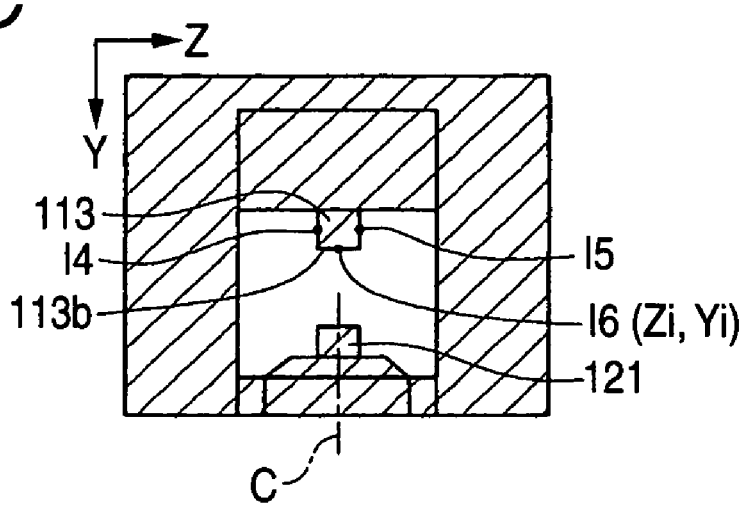

Next, in Step U96, as shown in FIG. 29A, a belt-like determination area I1 having a predetermined width in the Y direction and extending in the Z direction is set in an area where the noble metal tip 113 of the ground electrode 1110 is expected to exist in the acquired image. A front end position I2 is determined based on a Y-direction density distribution obtained in each pixel position in the Z direction. Next, in Step U97, as shown in FIG. 29B, a search line 13 is set in a position shifted from the front end position I2 by a predetermined distance (e.g. 0.1 mm) in the −Y direction (upward in FIG. 29B). A Z-direction pixel density distribution is obtained along the search line I3, and the coordinates of a left end position I4 and a right end position I5 are determined based on the obtained pixel density distribution. Next, in Step U98, the average value of the Z-coordinates of the left and right end positions I4 and I5 is regarded as Zi, and the Y-coordinate of the front end position I2 is regarded as Yi. Thus, the coordinates of the center position I6 of the noble metal tip 113 are determined as (Zi, Yi) (see FIG. 29C).

Figure 30A:
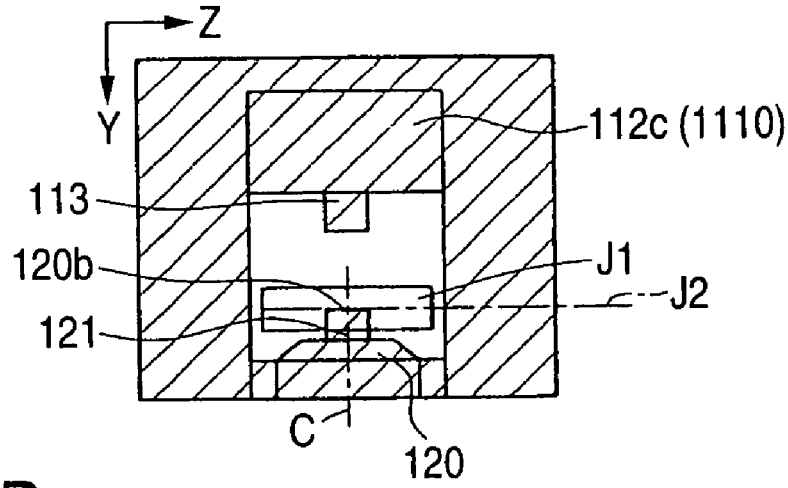
FIGS. 30A, 30B and 30C are explanatory views for explaining a method for measuring a center electrode center position J6 in the deviation measuring step according to Embodiment 3.
Figure 30B:
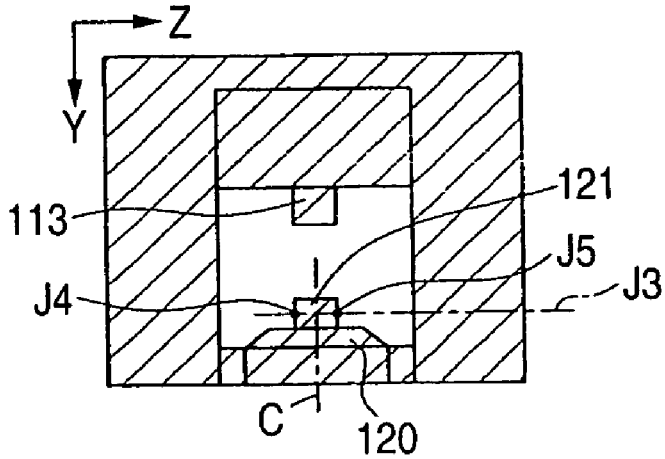
Figure 30C:
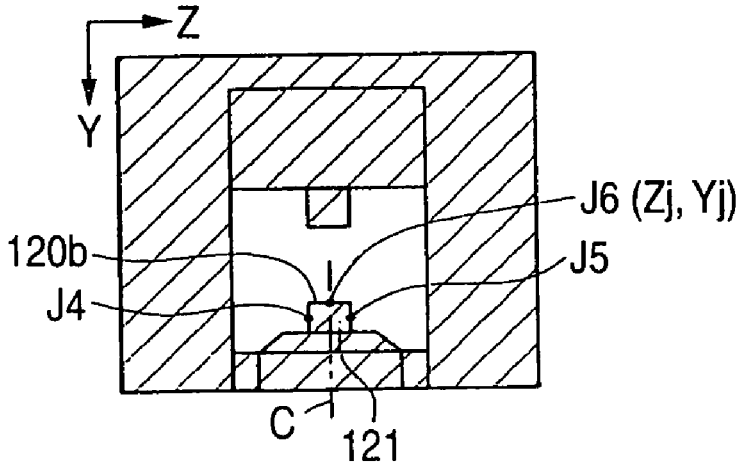

Next, in Step U99, as shown in FIG. 30A, a belt-like determination area J1 having a predetermined width in the Y direction and extending in the Z direction is set in an area where the noble metal tip 121 forming the front end 120*b* of the center electrode 120 is expected to exist in the acquired image. A front end position J2 is determined based on a Y-direction density distribution obtained in each pixel position in the Z direction. Next, in Step U9A, as shown in FIG. 30B, a search line J3 is set in a position shifted from the front end position J2 by a predetermined distance (e.g. 0.1 mm) in the Y direction (downward in FIG. 30B). A Z-direction pixel density distribution is obtained along the search line J3, and the coordinates of a left end position J4 and a right end position J5 are determined based on the obtained pixel density distribution. Next, in Step U9B, the average value of the Z-coordinates of the left and right end positions J4 and J5 is regarded as Zj, and the Y-coordinate of the front end position J2 is regarded as Yj. Thus, the coordinates of the center position J6 of the front end 120*b* of the center electrode 120 (noble metal tip 121) are determined as (Zj, Yj) (see FIG. 30C).

Figure 31:
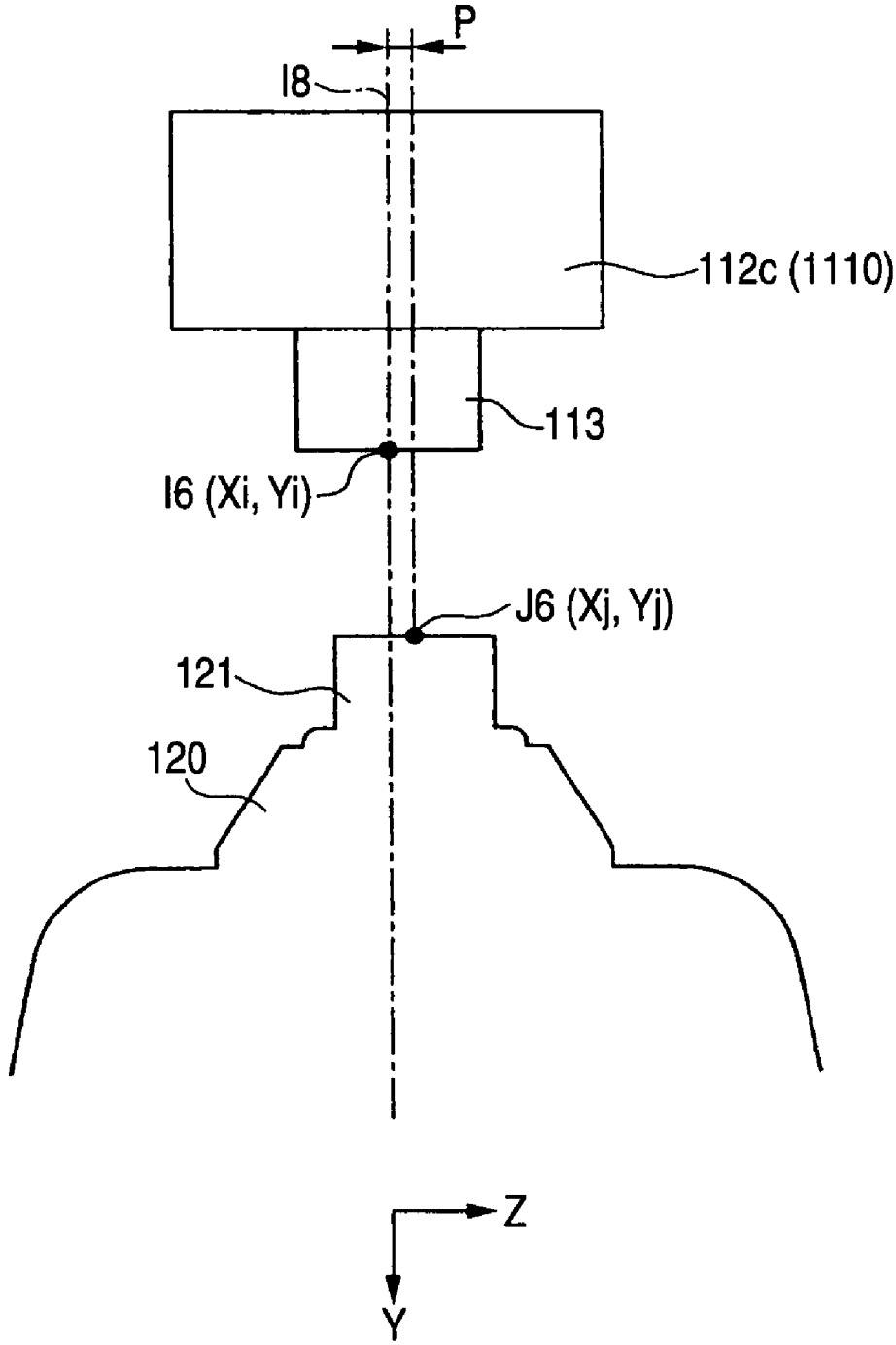
FIG. 31 is an explanatory view for explaining a method for measuring a deviation P in the deviation measuring step according to Embodiment 3.

Next, in Step U9C, as shown in FIG. 31, a center line I8 passing the center position 16 of the noble metal tip 113 and parallel to the Y axis is set. With reference to the center line 18, it is determined whether the center position J6 of the front end 120*b* of the center electrode 120 (noble metal tip 121) is on the left side or on the right side with respective to the center line I8. Thus, the sign of the deviation is determined. This sign serves to define the direction of bending of the ground electrode 1110 in Step SA (deviation adjusting step) which will be performed later. Next, the distance between the center line 18 and the center position J6 is calculated as a Z-directional deviation P of the noble metal tip 113 of the ground electrode 1110 with respect to the front end 120*b* of the center electrode 120. Then, the routine of processing returns to the main routine shown in FIG. 32.

In Embodiment 3, the coordinates (Zi, Yi) of the center position 16 of he noble metal tip 113 of the ground electrode 1110 and the coordinates (Zj, Zj) of the center position J6 of the front end 120*b* of the center electrode 120 (noble metal tip 121) are calculated based on the image where the contours of the noble metal tip 113 and the noble metal tip 121 are clarified. Accordingly, it is possible to acquire the coordinates of the center positions I6 and J6 accurately. Further, the deviation P is calculated based on the accurate center positions I6 and J6. Thus, it is possible to acquire the deviation P accurately.

Next, in Step SA (deviation adjusting step), in the same manner as in Embodiment 1, the Z-directional deviation P of the noble metal tip 113 of the ground electrode 1110 with respect to the front end 120*b* of the center electrode 120 (noble metal tip 121) in the work 1101 is adjusted to be within a predetermined range.

Next, in Step SB (second gap size measuring step), the gap size gm of the work 1101 is measured in the same manner as in Step S2 (first gap size measuring step).

Figure 34:
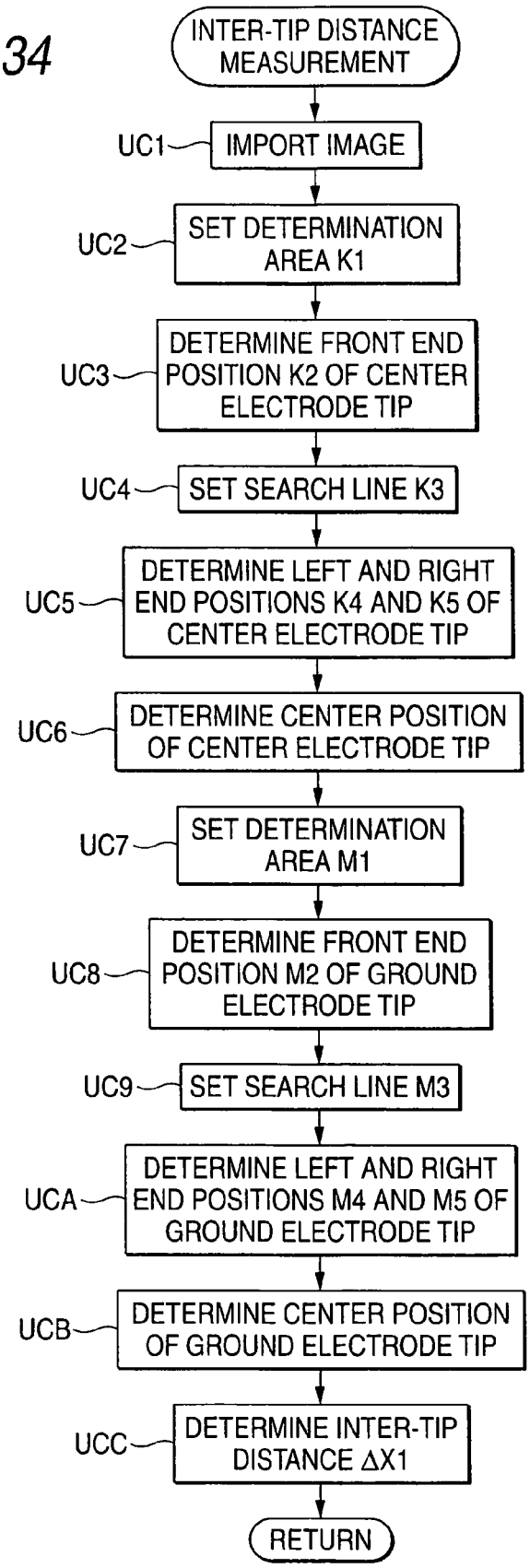
FIG. 34 is a flow chart showing a flow of an inter-tip distance measuring process according to Embodiment 3.

Next, in Step UC (first inter-tip distance measuring step), the X-directional distance (X-directional displacement) between the noble metal tip 121 of the center electrode 120 and the noble metal tip 113 of the ground electrode 1110 is measured. Here, the inter-tip distance measuring process will be described in detail with reference to FIG. 34 showing the subroutine of Step UC, and FIGS. 35A-35B and 36A-36B.

Figure 35A:
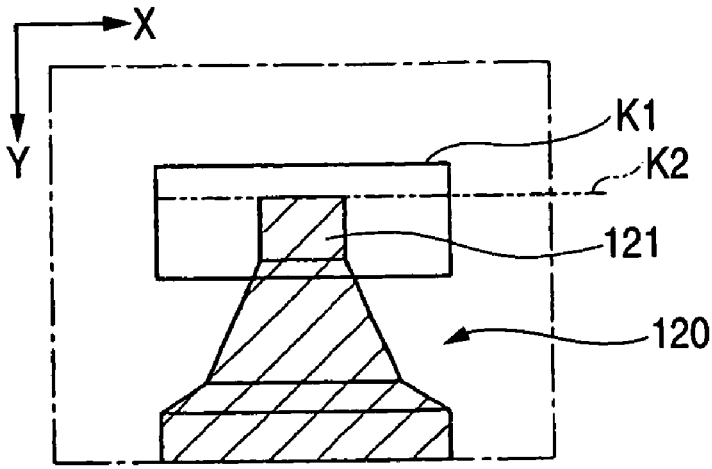
FIGS. 35A and 35B are explanatory views for explaining a method for measuring a center electrode center position K6 in the inter-tip distance measuring process according to Embodiment 3.
Figure 35B:
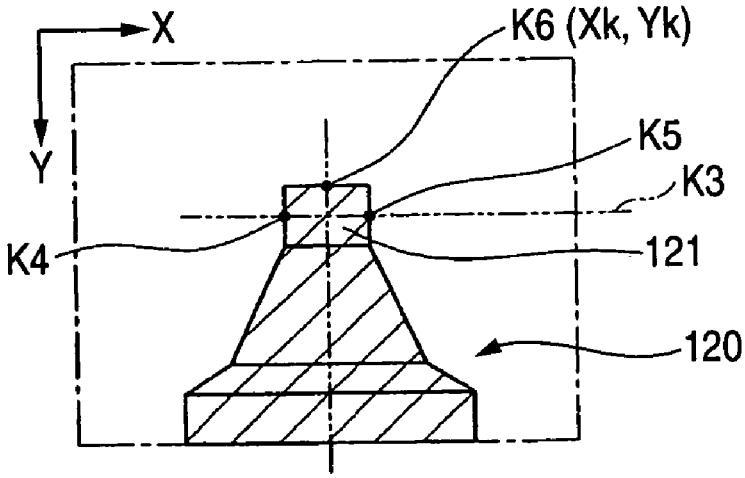

First, in Step UC1, the image photographed in Step SB (second gap size measuring step) is imported (see FIG. 25). Next, in Step UC2, as shown in FIG. 35A, a belt-like determination area K1 having a predetermined width in the Y direction and extending in the X direction is set in an area where the noble metal tip 121 of the center electrode 120 is expected to exist. Next, in Step UC3, a front end position K2 of the noble metal tip 121 of the center electrode 120 is determined based on a Y-direction density distribution obtained in each pixel position in the X direction (see FIG. 35A). Next, in Step UC4, a search line K3 is set in a position shifted from the front end position K2 by a predetermined distance (e.g. 0.1 mm) in the Y direction (downward in FIG. 35B) (see FIG. 35B). Next, in Step UC5, an X-direction pixel density distribution is obtained along the search line K3, and the coordinates of a left end position K4 and a right end position K5 are determined based on the obtained pixel density distribution. Next, in Step UC6, the average value of the X-coordinates of the left and right end positions K4 and K5 is regarded as Xk, and the Y-coordinate of the front end position K2 is regarded as Yk. Thus, the coordinates of the center position K6 of the noble metal tip 121 are determined as (Xk, Yk) (see FIG. 35B).

Figure 36A:
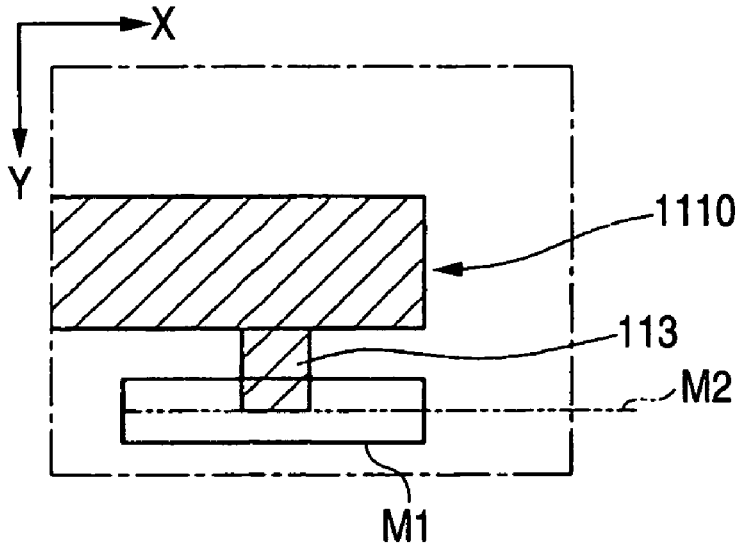
FIGS. 36A and 36B are explanatory views for explaining a method for measuring a ground electrode center position M6 in the inter-tip distance measuring process according to Embodiment 3.
Figure 36B:
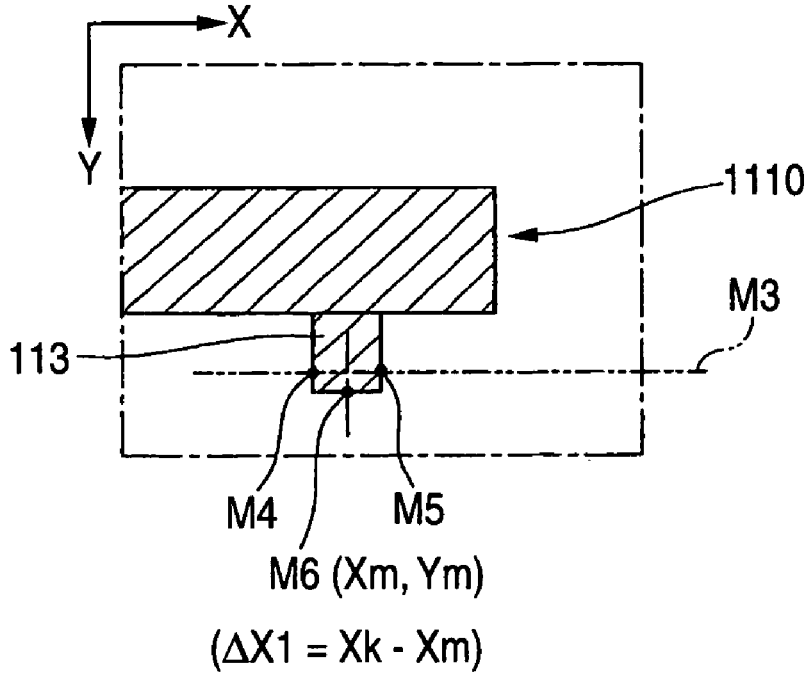

Next, in Step UC7, as shown in FIG. 36A, a belt-like determination area M1 having a predetermined width in the Y direction and extending in the X direction is set in an area where the noble metal tip 113 of the ground electrode 1110 is expected to exist. In Step UC8, a front end position M2 of the noble metal tip 113 of the ground electrode 1110 is determined based on a Y-direction density distribution obtained in each pixel position in the X direction. Next, in Step UC9, as shown in FIG. 36B, a search line M3 is set in a position shifted from the front end position M2 by a predetermined distance (e.g. 0.1 mm) in the −Y direction (upward in FIG. 36B). In Step UCA, an X-direction pixel density distribution is obtained along the search line M3, and the coordinates of a left end position M4 and a right end position M5 are determined based on the obtained pixel density distribution. Next, in Step UCB, the average value of the X-coordinates of the left and right end positions M4 and M5 is regarded as Xm, and the Y-coordinate of the front end position M2 is regarded as Ym. Thus, the coordinates of the center position M6 of the noble metal tip 113 are determined as (Xm, Ym) (see FIG. 36B).

Next, in Step UCC, an X-directional distance (X-direction displacement) □X1 between the noble metal tip 121 of the center electrode 120 and the noble metal tip 113 of the ground electrode 1110 is calculated based on the coordinates (Xk, Yk) of the center position K6 of the noble metal tip 121 and the coordinates (Xm, Ym) of the center position M6 of the noble metal tip 113. Specifically, the X-directional displacement $\Delta X1$ is calculated by $\Delta X1 = Xk - Xm$. Then, the routine of processing returns to the main routine shown in FIG. 32.

Figure 37:
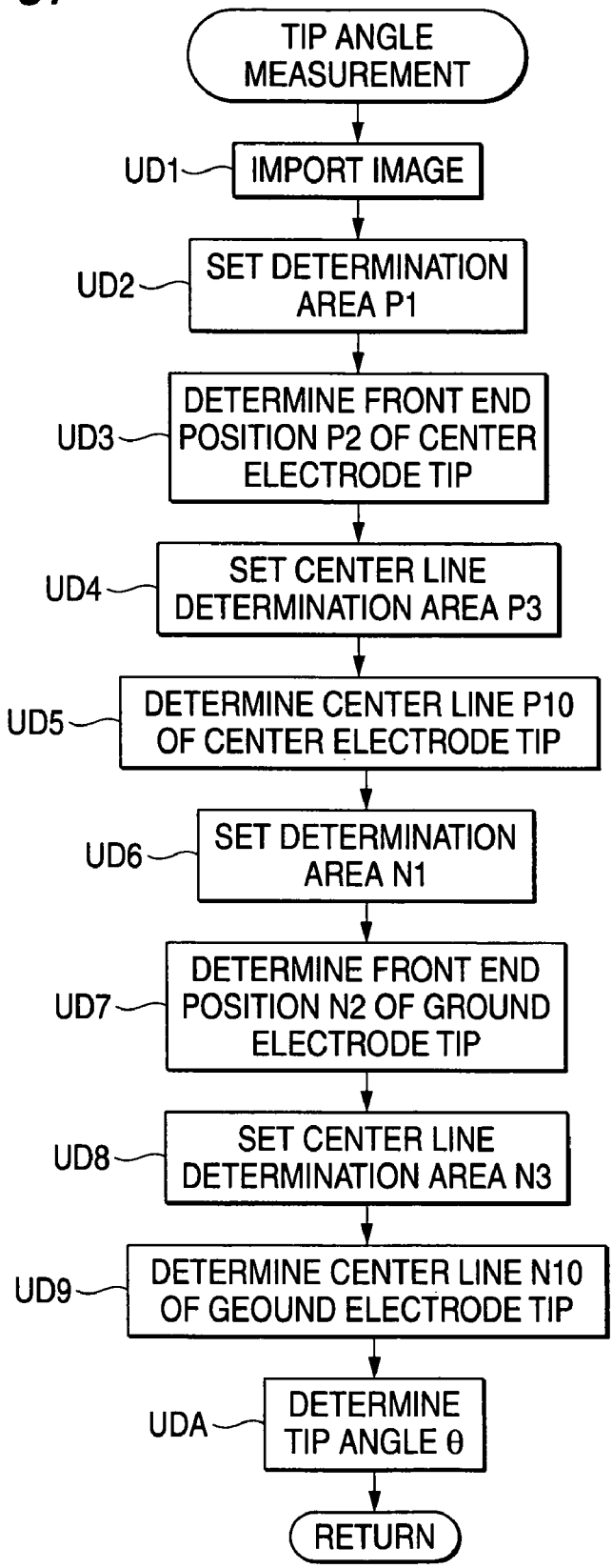
FIG. 37 is a flow chart showing a flow of a tip angle measuring process according to Embodiment 3.

Next, Step UD (first tip angle measuring step), the angle (angle displacement) between the noble metal tip 121 of the center electrode 120 and the noble metal tip 113 of the ground electrode 1110 is measured. Here, the tip angle measuring process will be described in detail with reference to FIG. 37 showing the subroutine of Step UD, and FIGS. 38A-38B and 39A-39B.

Figure 38A:
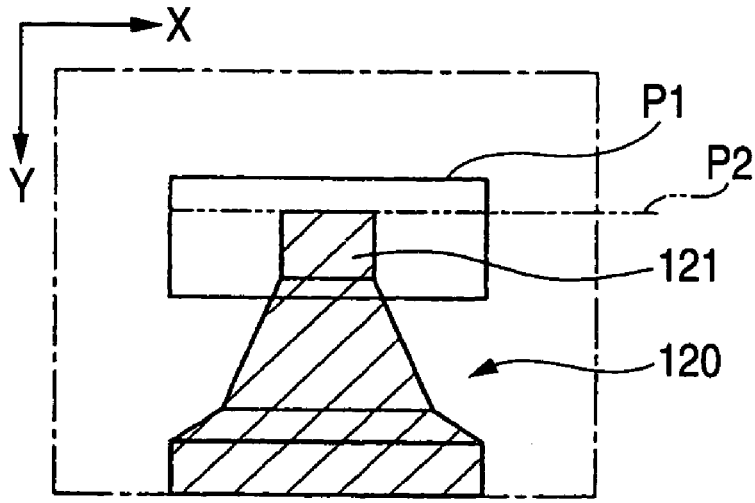
FIGS. 38A and 38B are explanatory views for explaining a method for determining a center line P10 of a noble metal tip 121 of a center electrode 120 in the tip angle measuring process according to Embodiment 3.

First, in Step UD1, the image photographed in Step SB (second gap size measuring step) is imported (see FIG. 25). Next, in Step UD2, as shown in FIG. 38A, a belt-like determination area P1 having a predetermined width in the Y direction and extending in the X direction is set in an area where the noble metal tip 121 of the center electrode 120 is expected to exist. Next, in Step UD3, a front end position P2 of the noble metal tip 121 of the center electrode 120 is determined based on a Y-direction density distribution obtained in each pixel position in the X direction (see FIG. 38A).

Figure 38B:
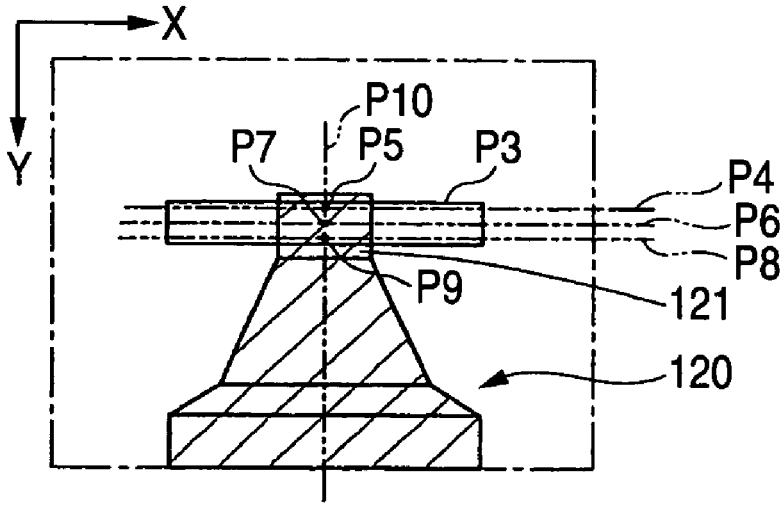

Next, in Step UD4, as shown in FIG. 38B, a center line determination area P3 for determining the center line (axis) of the noble metal tip 121 is set in a position shifted from the front end position P2 in the Y direction (downward in FIG. 38B). Next, in Step UD5, in the center line determination area P3, for example, three search lines P4, P6 and P8 parallel to the X axis are set at predetermined intervals (e.g. 0.1 mm) in the Y direction (downward in FIG. 38B). X-direction pixel density distributions are obtained along the search lines P4, P6 and P8, and center positions P5, P7 and P9 are determined based on the obtained pixel density distributions. A center line P10 of the noble metal tip 121 is determined based on the center positions P5, P7 and P9 (see FIG. 38B).

Figure 39A:
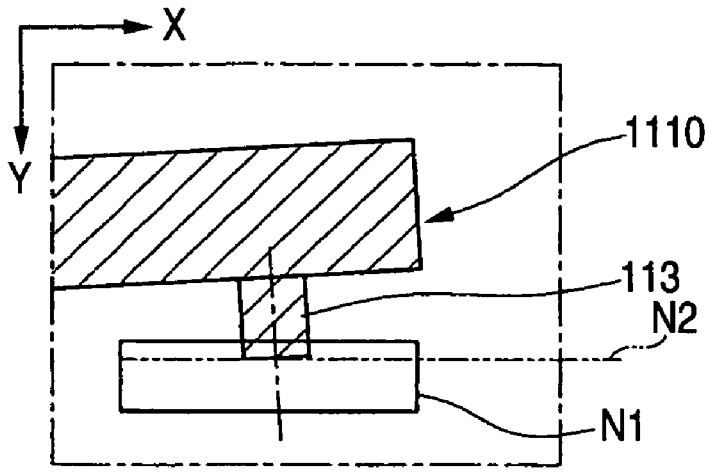
FIGS. 39A and 39B are explanatory views for explaining a method for determining a center line N10 of a noble metal tip 113 of the ground electrode 1110 in the tip angle measuring process according to Embodiment 3.
Figure 39B:
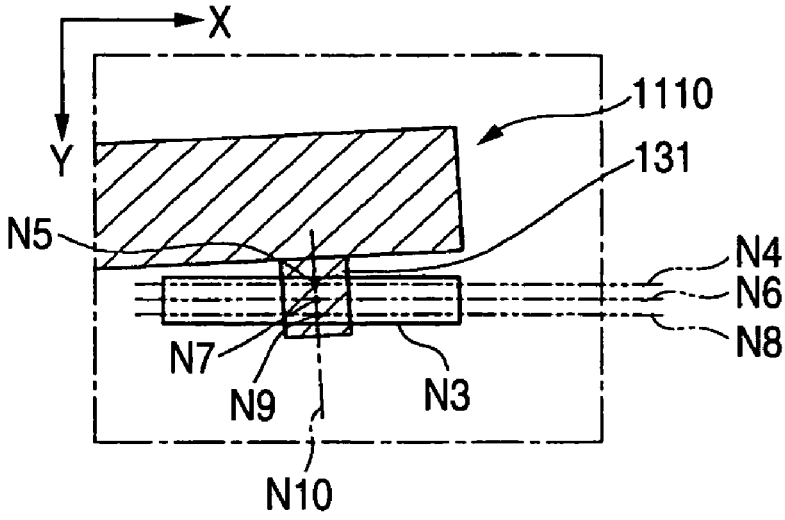

Next, in Step UD6, as shown in FIG. 39A, a belt-like determination area N1 having a predetermined width in the Y direction and extending in the X direction is set in an area where the noble metal tip 113 of the ground electrode 1110 is expected to exist. In Step UD7, a front end position N2 of the noble metal tip 113 of the ground electrode 1110 is determined based on a Y-direction density distribution obtained in each pixel position in the X direction. Next, in Step UD8, as shown in FIG. 39B, a center line determination area N3 for determining the center line (axis) of the noble metal tip 113 is set in a position shifted from the front end position N2 in the −Y direction (upward in FIG. 39B). Next, in Step UD9, in the center line determination area N3, for example, three search lines N4, N6 and N8 parallel to the X axis are set at predetermined intervals (e.g. 0.1 mm) in the Y direction (downward in FIG. 39B). X-direction pixel density distributions are obtained along the search lines N4, N6 and N8, and center positions N5, N7 and N9 are determined based on the obtained pixel density distributions. A center line N10 of the noble metal tip 113 is determined based on the center positions N5, N7 and N9 (see FIG. 39B).

Figure 40:
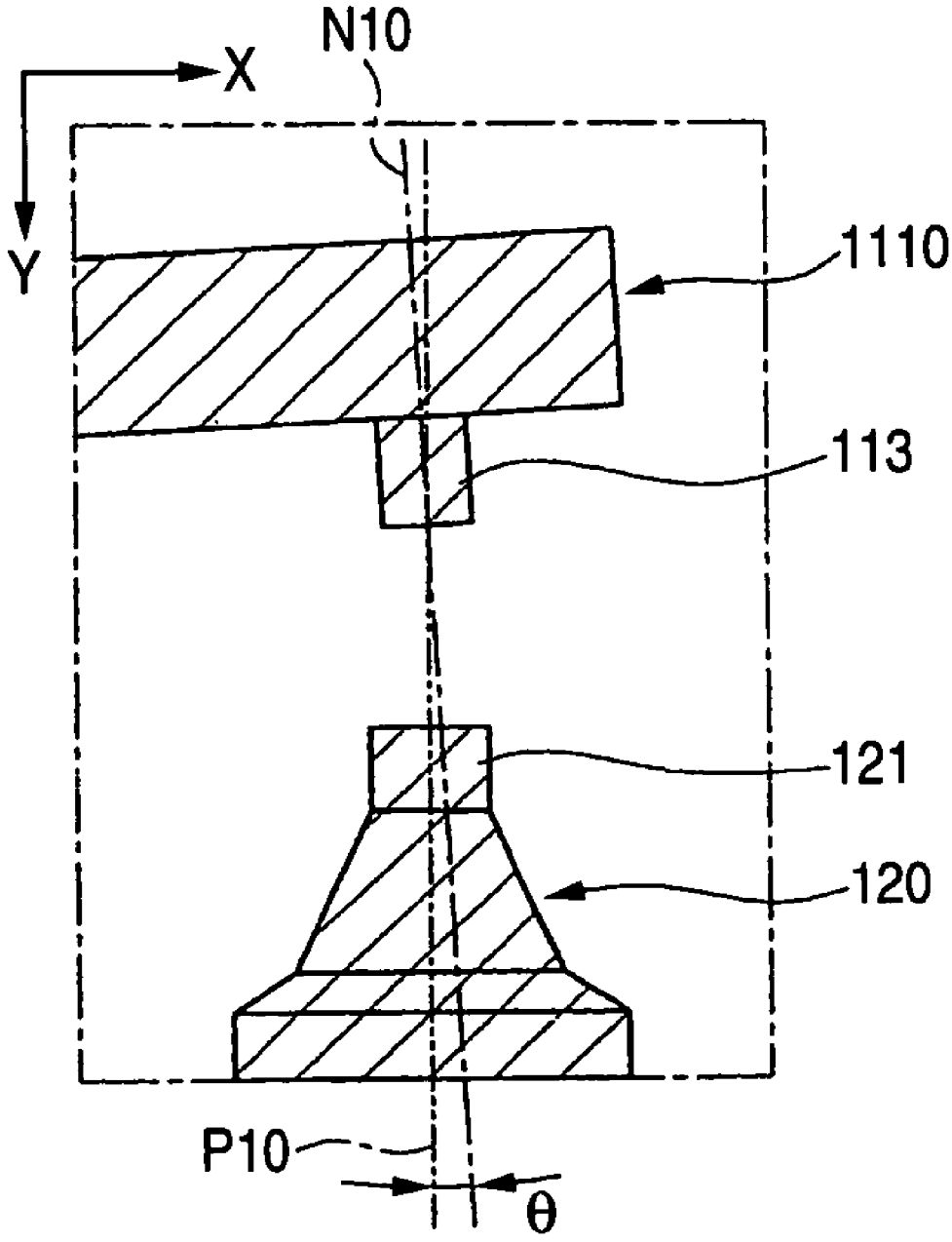
FIG. 40 is an explanatory view for explaining an angle □ between the noble metal tip 121 of the center electrode 120 and the noble metal tip 113 of the ground electrode 1110 in the tip angle measuring process according to Embodiment 3.

Next, in Step UDA, an angle between the noble metal tip 121 of the center electrode 120 and the noble metal tip 113 of the ground electrode 1110 is calculated based on the center line P10 of the noble metal tip 121 and the center line N10 of the noble metal tip 113. Specifically, of angles formed between the center line N10 and the center line P10, an acute one is calculated as a tip angle θ (see FIG. 40). Then, the routine of processing returns to the main routine shown in FIG. 32.

In Step UE, it is determined whether the gap size gm is or not within a predetermined tolerance range (e.g. g2±0.1 (mm)) from the second gap size value g2 (mm) which is an intended value of a final gap size. In the same manner, it is also determined whether the inter-tip distance ΔX1 and the tip angle θ are within predetermined ranges respectively or not. When the gap size gm, the inter-tip distance ΔX1 and the tip angle θ are within the predetermined ranges respectively, the routine of processing proceeds to Step SJ (work unloading step), where the work 1101 is unloaded from the carrier 211 of the linear conveyor 210. Thus, the spark plug 1100 as shown in FIG. 23 is completed.

Figure 7A:
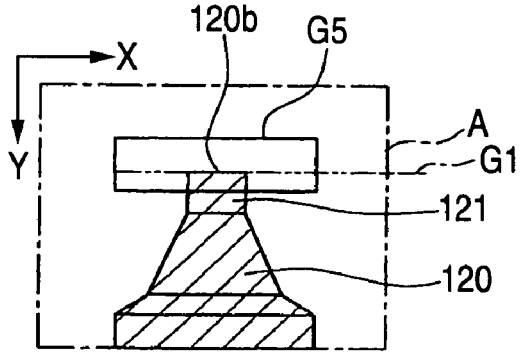
FIGS. 7A and 7B are explanatory views for explaining a center electrode position measuring step, showing enlarged views of a portion A of the photographed image in the first, second electrode position measuring unit 240, 280 according to Embodiment 1.
Figure 7B:
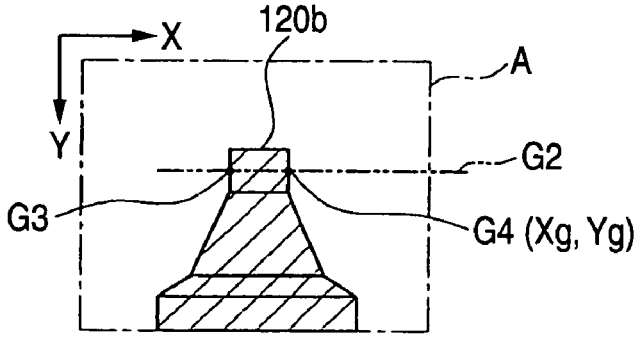

On the contrary, when the gap size gm, the inter-tip distance ΔX1 or the tip angle θ is out of its predetermined tolerance range, the routine of processing proceeds to Step SD (second center electrode position measuring step), where the coordinates (Xg, Yg) of the right end position G4 of the noble metal tip 121 of the center electrode 120 are measured in the same manner as in Step S3 (first center electrode position measuring step) (see FIGS. 7A-7B).

Figure 41A:
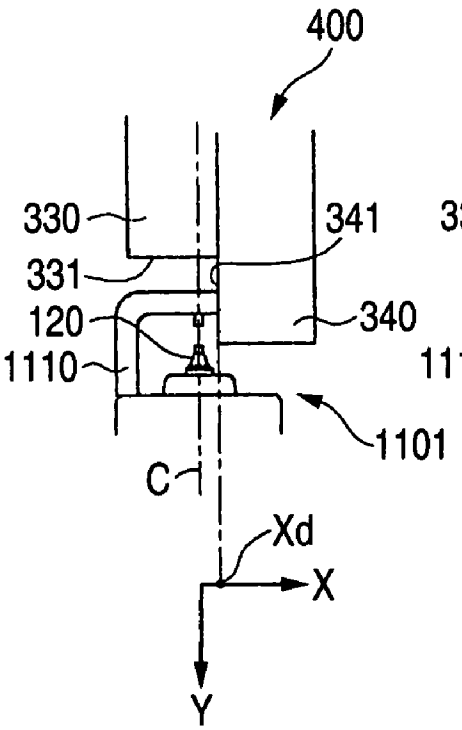
FIGS. 41A, 41B, 41C and 41D are explanatory views for explaining a second regulation member positioning step, a gap adjusting step and a return step according to Embodiment 3.

Next, in Steps UG and SF (second regulation member positioning step), the X-directional position of the regulation member 340 of the gap forming unit 300 is positioned. Specifically, first, a difference ΔXg (Xg in Step SD—Xg in Step S3) between the X-coordinate of the position G4 measured in Step S3 (first center electrode position measuring step) and the X-coordinate of the position G4 measured in Step SD (second center electrode position measuring step) is calculated. Next, the aforementioned difference ΔXg is added to the X-coordinate Xf of the regulation abutment surface 341 of the regulation member 340 set in Steps S6-S7 (first regulation member positioning step), and further the inter-tip distance ΔX1 calculated in Step UC is added thereto. Thus, an X-coordinate Xd (see FIG. 41A) is calculated (Xd=Xf+ΔXg+ΔX1). The regulation member 340 is moved and fixed to the position where the X-coordinate of the regulation abutment surface 341 of the regulation member 340 is Xd.

In Embodiment 3, the regulation member 340 is positioned thus. Accordingly, in the next step SG (gap adjusting step), the X-directional position of the noble metal tip 113 of the ground electrode 1110 with respect to the front end 120*b* of the center electrode 120 (noble metal tip 121) can be adjusted to be located within a predetermined range while the gap size is adjusted.

Figure 41B:
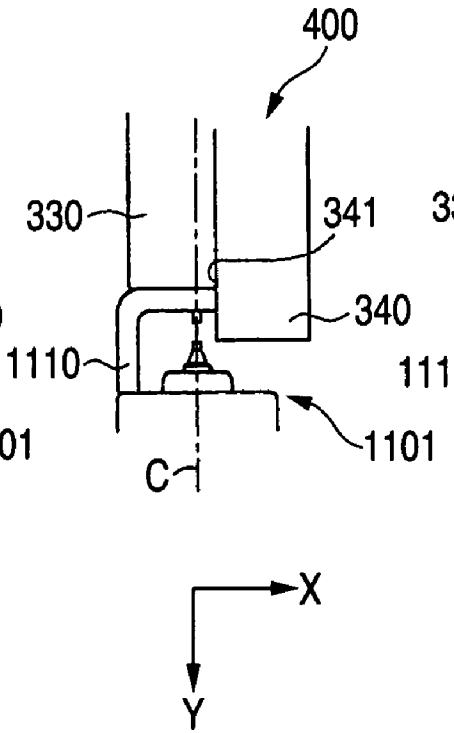
Figure 41C:
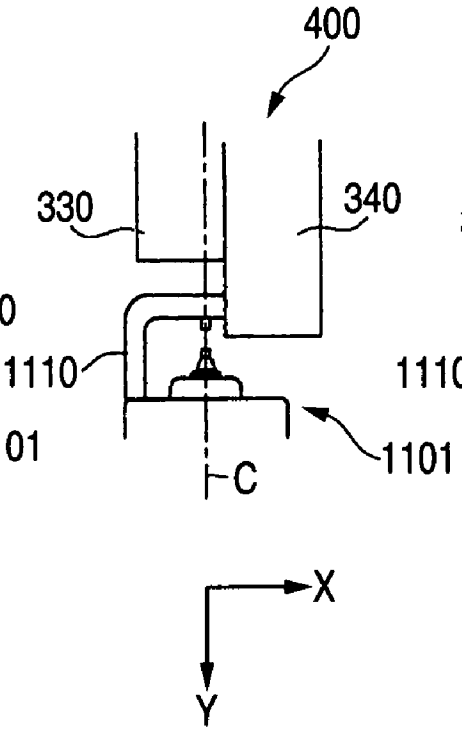
Figure 41D:
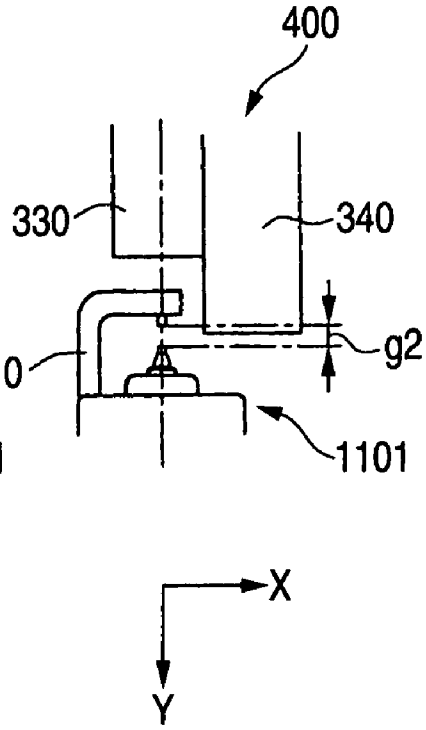

Next, in the same manner as in Embodiment 1, Step SG (gap adjusting step) (see FIG. 41B) and Steps SH-SI (return step) (see FIGS. 41C-41D) are carried out in that order. Thus, a spark discharge gap g whose gap size is equal to the second gap size value g2 is formed. In this event, it is also possible to adjust the X-directional position of the noble metal tip 113 of the ground electrode 1110 with respect to the front end 120*b* of the center electrode 120 (noble metal tip 121) as described above.

Next, Step UJ (third gap size measuring step), Step UK (second inter-tip distance measuring step) and Step UL (second tip angle measuring step) are carried out in that order. Thus, the gap size gm, the inter-tip distance ΔX1 and the tip angle θ are calculated in the same manner as in the aforementioned Steps SB, UC and UD.

Next, in Step UM, it is determined whether the gap size gm, the inter-tip distance ΔX1 and the tip angle θ are within their predetermined ranges or not. When they are within the predetermined ranges, the routine of processing proceeds to Step SJ, where the work 1101 is unloaded from the carrier 211 of the linear conveyor 210 as an acceptable product. On the contrary, when the gap size gm, the inter-tip distance ΔX1 or the tip angle θ is out of its predetermined range, the routine of processing proceeds to Step UN where the work 1101 is unloaded from the carrier 211 of the linear conveyor 210 as an inferior product.

In such a manner, the spark plug 1100 as shown in FIG. 23 is completed.

Embodiment 4

Next, Embodiment 4 of the invention will be described with reference to the drawings.

Figure 42:
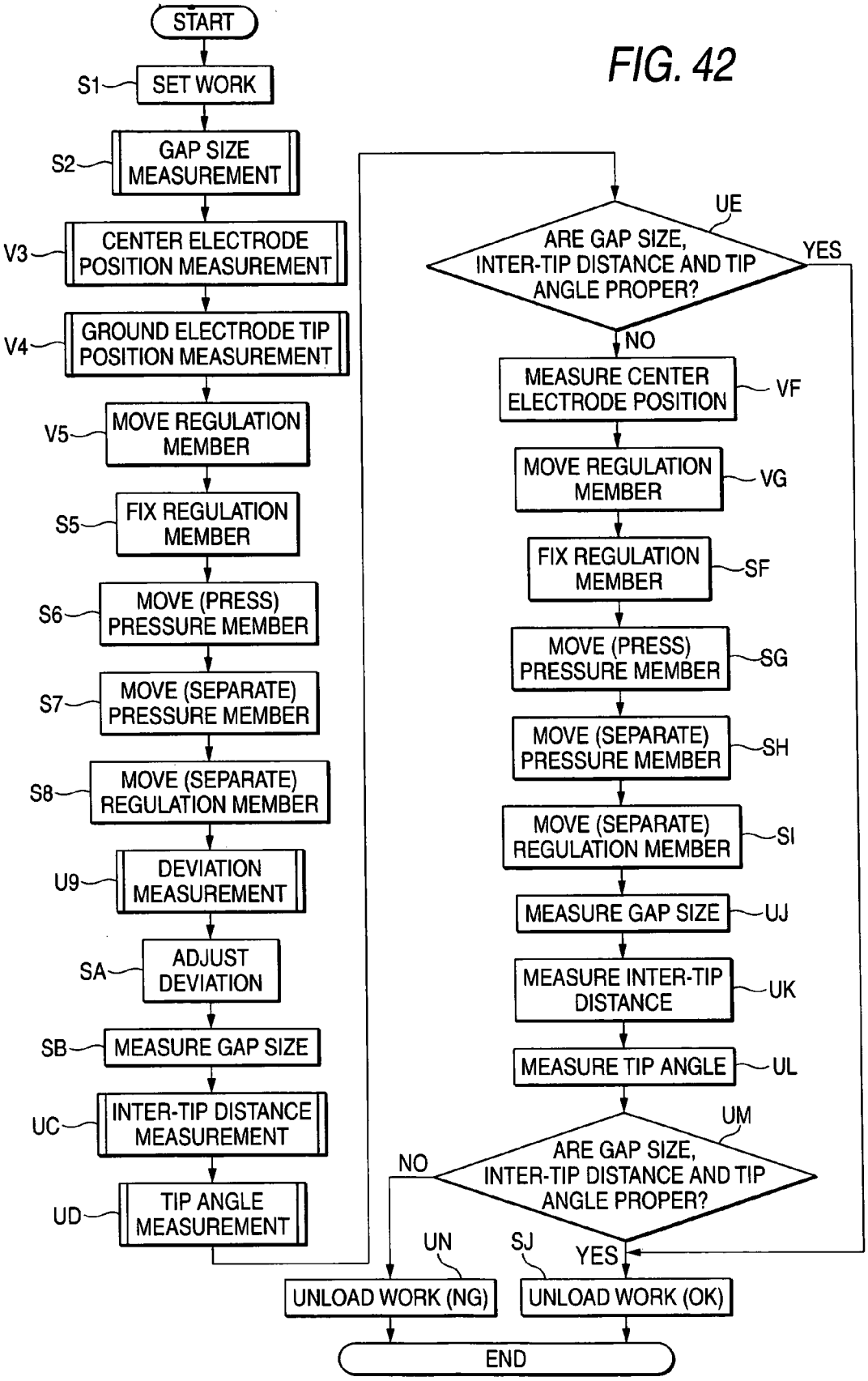
FIG. 42 is a flow chart showing a flow of steps in a method for manufacturing the spark plug 1100 according to Embodiment 4.

A method for manufacturing a spark plug 1100 according to Embodiment 4 is almost the same as that according to Embodiment 3, except that Step S3 (first center electrode position measuring step) and Steps S4 and UG (regulation member positioning step) in the manufacturing method according to Embodiment 3 are replaced by Step V3 and Steps V5 and VG respectively, and further Step V4 (ground electrode tip position measuring step) is added (see FIGS. 32 and 42). Therefore, description will focus on parts different from those in Embodiment 3, and description about similar parts will be omitted or simplified.

Description will be made on the method for manufacturing a spark plug 1100 according to Embodiment 4 will be described with reference to the drawings.

FIG. 42 is a flow chart (main routine) showing a flow of steps in the method for manufacturing the spark plug 1100. First, in the same manner as in Embodiment 3, in Step S1 (work setting step), the work 1101 is set. Next, in Step S2 (first gap size measuring step), the gap size gm of the work 1101 is measured in the same manner as in Embodiment 3.

Figure 43:
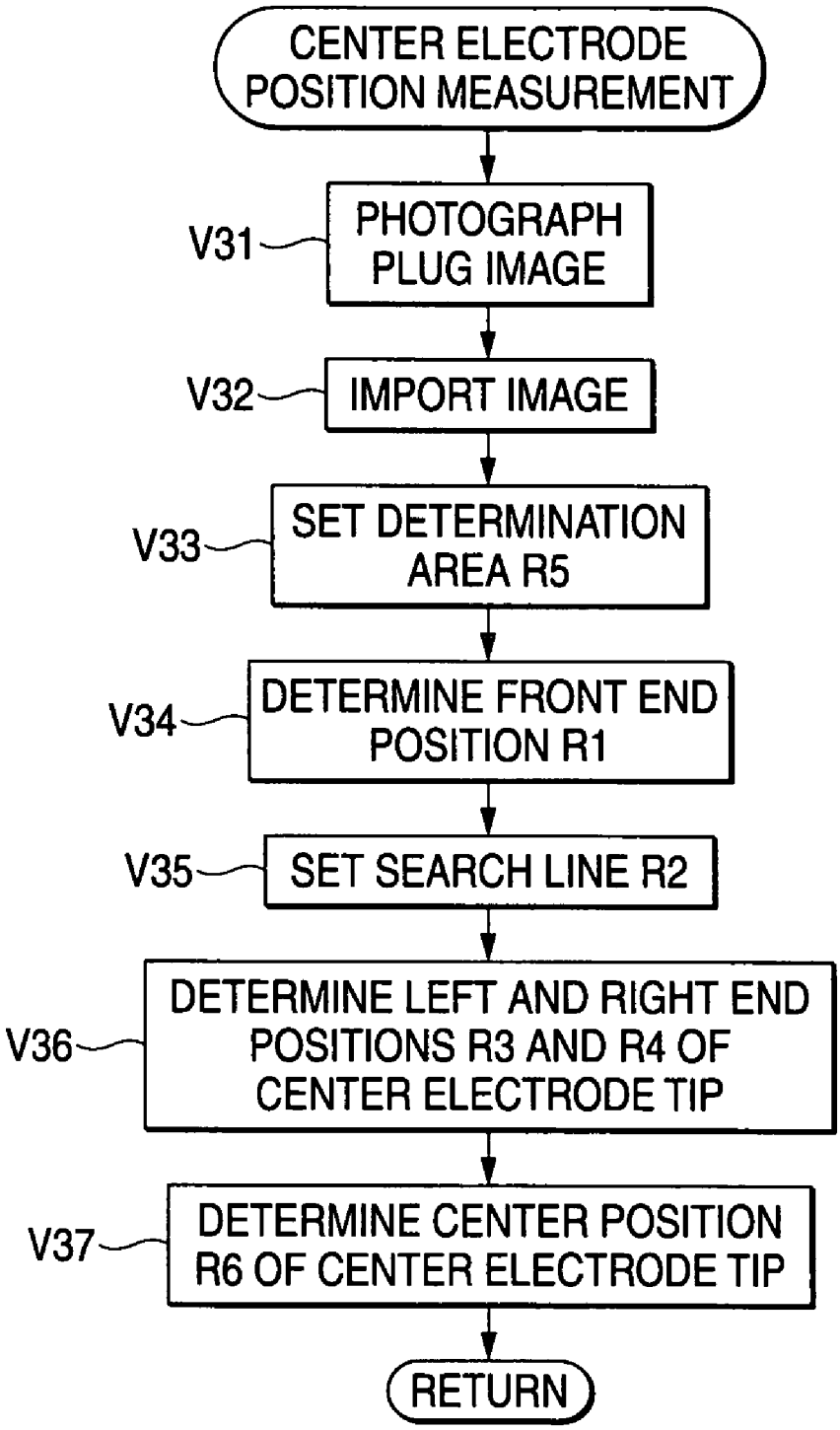
FIG. 43 is a flow chart showing a flow of a center electrode position measuring process according to Embodiment 4.

Next in Step V3 (first center electrode position measuring step), the position of the front end 120*b* of the center electrode 120 of the work 1101 is measured. Specifically, the center position of the front end 120*b* of the center electrode 120 (noble metal tip 121) is measured by a first electrode position measuring unit 240 (see FIG. 5) similar to that in Step S3 in Embodiment 3. Here, the center electrode position measuring process will be described in detail with reference to FIG. 43 showing the subroutine of Step V3. First, in Step V31, an image of the work 1101 is photographed by the photographing camera 241, and next in Step V32, the photographed image is imported (see FIG. 44).

Figure 45A:
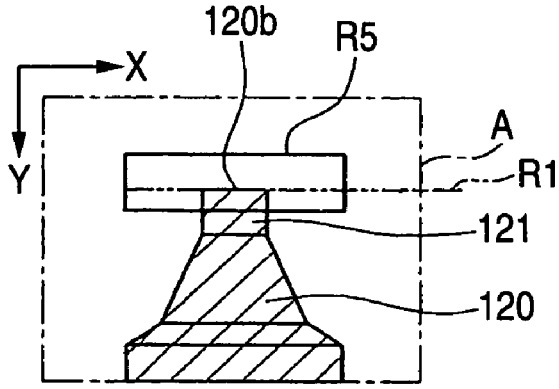
FIGS. 45A and 45B are explanatory views for explaining a center electrode position measuring step, showing enlarged views of a portion A of the photographed image in the first electrode position measuring unit 240 according to Embodiment 4.

Next, in Step V33, as shown in FIG. 45A, a belt-like determination area R5 having a predetermined width in the Y direction and extending in the X direction is set in an area A where the noble metal tip 121 of the center electrode 210 is expected to exist in the acquired image. Next, in Step V34, a front end position RI is determined based on a Y-direction density distribution obtained in each pixel position in the X direction (see FIG. 45A). Next, in Step V35, a search line R2 is set in a position shifted from the front end position R1 by a predetermined distance (e.g. 0.1 mm) in the Y direction (downward in FIG. 45B) (see FIG. 45B). Next, in Step V36, an X-direction pixel density distribution is obtained along the search line R2, and the coordinates of a left end position R3 and a right end position R4 are determined based on the obtained pixel density distribution. Next, in Step V37, the average value of the X-coordinates of the left and right end positions R3 and R4 is regarded as Xr, and the Y-coordinate of the front end position R1 is regarded as Yr. Thus, the coordinates of a center position R6 of the front end 120*b* of the center electrode 120 (noble metal tip 121) are determined as (Xr, Yr) (see FIG. 45B). After that, the routine of processing returns to the main routine of FIG. 32.

Figure 46:
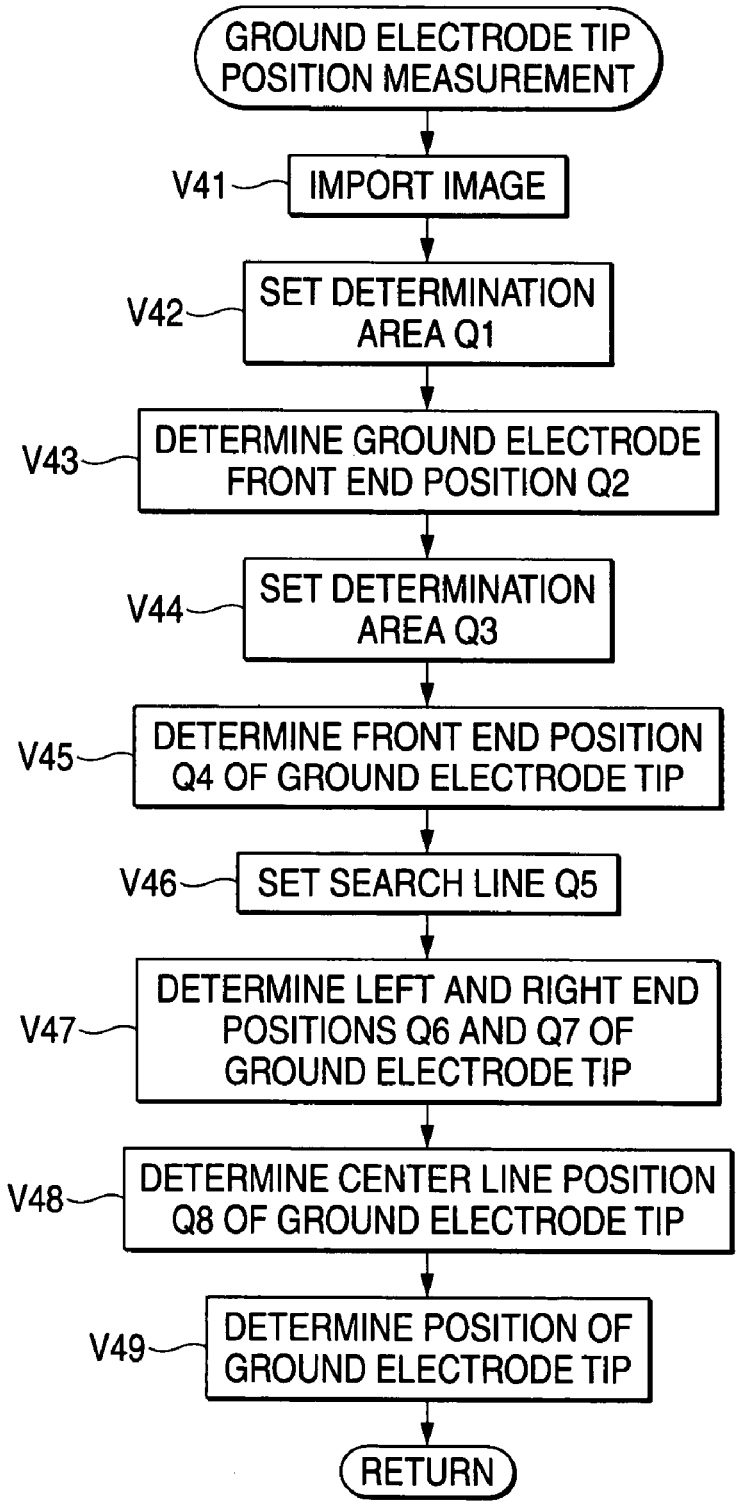
FIG. 46 is a flow chart showing a flow of a ground electrode tip position measuring process according to Embodiment 4.
Figure 47A:
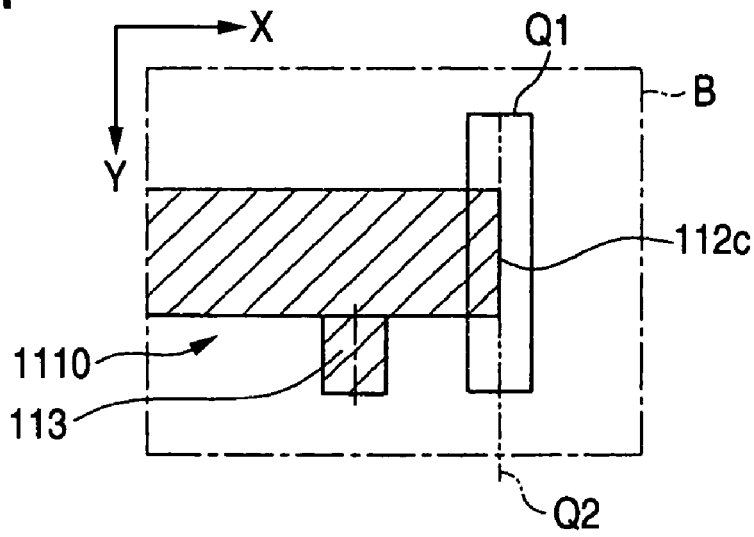
FIGS. 47A, 47B and 47C are explanatory views for explaining the ground electrode tip position measuring step, showing enlarged views of a portion B of the photographed image in the first electrode position measuring unit 240 according to Embodiment 4.

Next in Step V4 (ground electrode tip position measuring step), the position of the noble metal tip 113 of the ground electrode 1110 is measured. Specifically, an X-directional distance between the front end surface 112*c* of the ground electrode 1110 and the center position of the noble metal tip 113 is measured by a first electrode position measuring unit 240 (see FIG. 5) similar to that in Step V3 (see FIGS. 47A-47C). Here, the ground electrode tip position measuring process will be described in detail with reference to FIG. 46 showing the subroutine of Step V4. First, in Step V41, an image photographed in the pervious Step V3 is imported (see FIG. 44).

Figure 44:
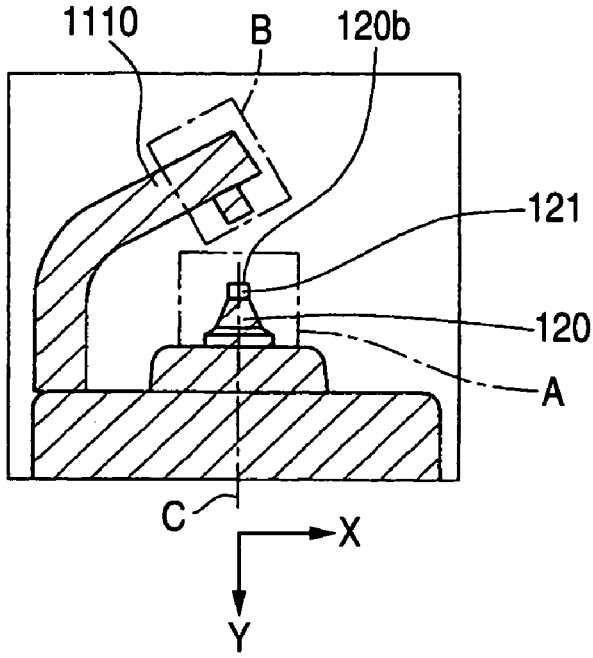
FIG. 44 is an explanatory view showing a photographed image in a first electrode position measuring unit 240 according to Embodiment 4.

Next, in Step V42, an area B where the noble metal tip 113 of the ground electrode 1110 is expected to exist is created in the acquired image (see FIG. 44). This area B is rotated and moved on the XY plane so that the central axis of the noble metal tip 113 is parallel to the Y axis (see FIG. 47A). A belt-like determination area Q1 having a predetermined width in the X direction and extending in the Y direction is set in an area where the front end surface 112*c* of the ground electrode 1110 is expected to exist in the area B. Next, in Step V43, a front end position Q2 is determined based on an X-direction density distribution obtained in each pixel position in the Y direction (see FIG. 47A).

Figure 47B:
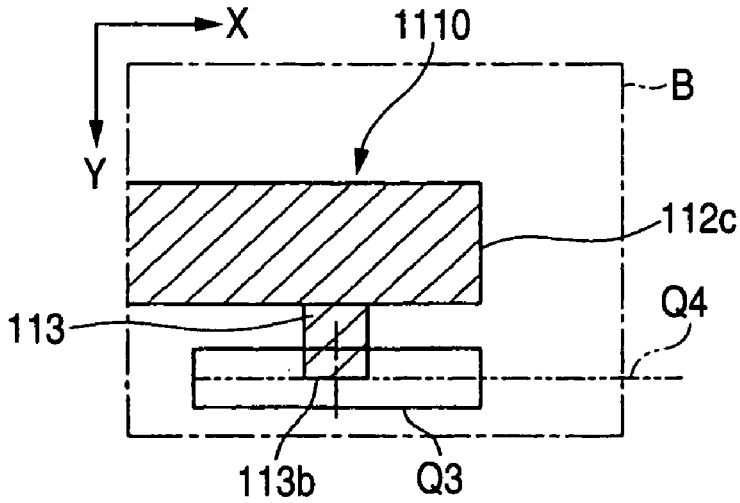
Figure 47C:
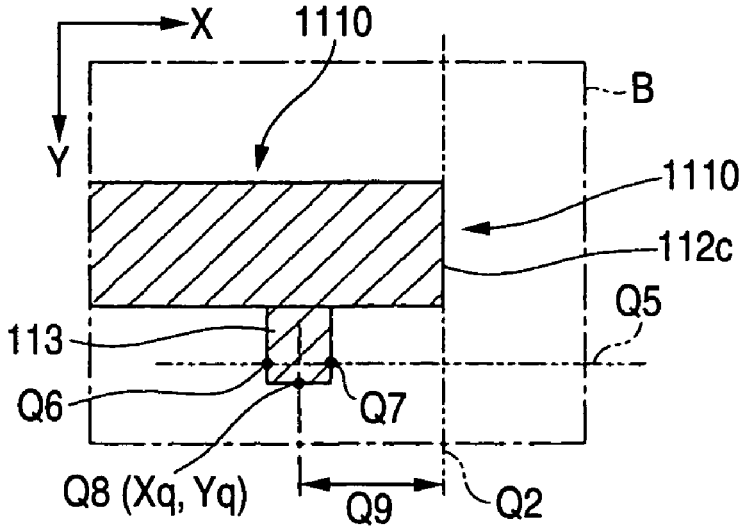

Next, in Step V44, a belt-like determination area Q3 having a predetermined width in the Y direction and extending in the X direction is set in an area where the front end 113B of the noble metal tip 113 of the ground electrode 1110 is expected to exist in the area B (see FIG. 47B). Next, in Step V45, a front end position Q4 is determined based on a Y-direction density distribution obtained in each pixel position in the X direction. Next, in Step V46, a search line Q5 is set in a position shifted from the front end position Q4 by a predetermined distance (e.g. 0.1 mm) in the −Y direction (upward in FIG. 47C) (see FIG. 47C).

Next, in Step V47, an X-direction pixel density distribution is obtained along the search line Q5, and the coordinates of a left end position Q6 and a right end position Q7 are determined based on the obtained pixel density distribution. Next, in Step V48, the average value of the X-coordinates of the left and right end positions Q6 and Q7 is regarded as Xq, and the Y-coordinate of the front end position Q4 is regarded as Yq. Thus, the coordinates of a center position Q8 of the noble metal tip 113 of the ground electrode 1110 are determined as (Xq, Yq) (see FIG. 47C). Next, in Step V49, an X-directional distance Q9 between the front end position Q2 of the ground electrode 1110 and the center position Q8 of the noble metal tip 113 (a distance between the front end surface 112*c* of the ground electrode 1110 and the central axis of the noble metal tip 113) is calculated. After that, the routine of processing returns to the main routine of FIG. 42.

Figures 48A, 48B, 48C, 48D:
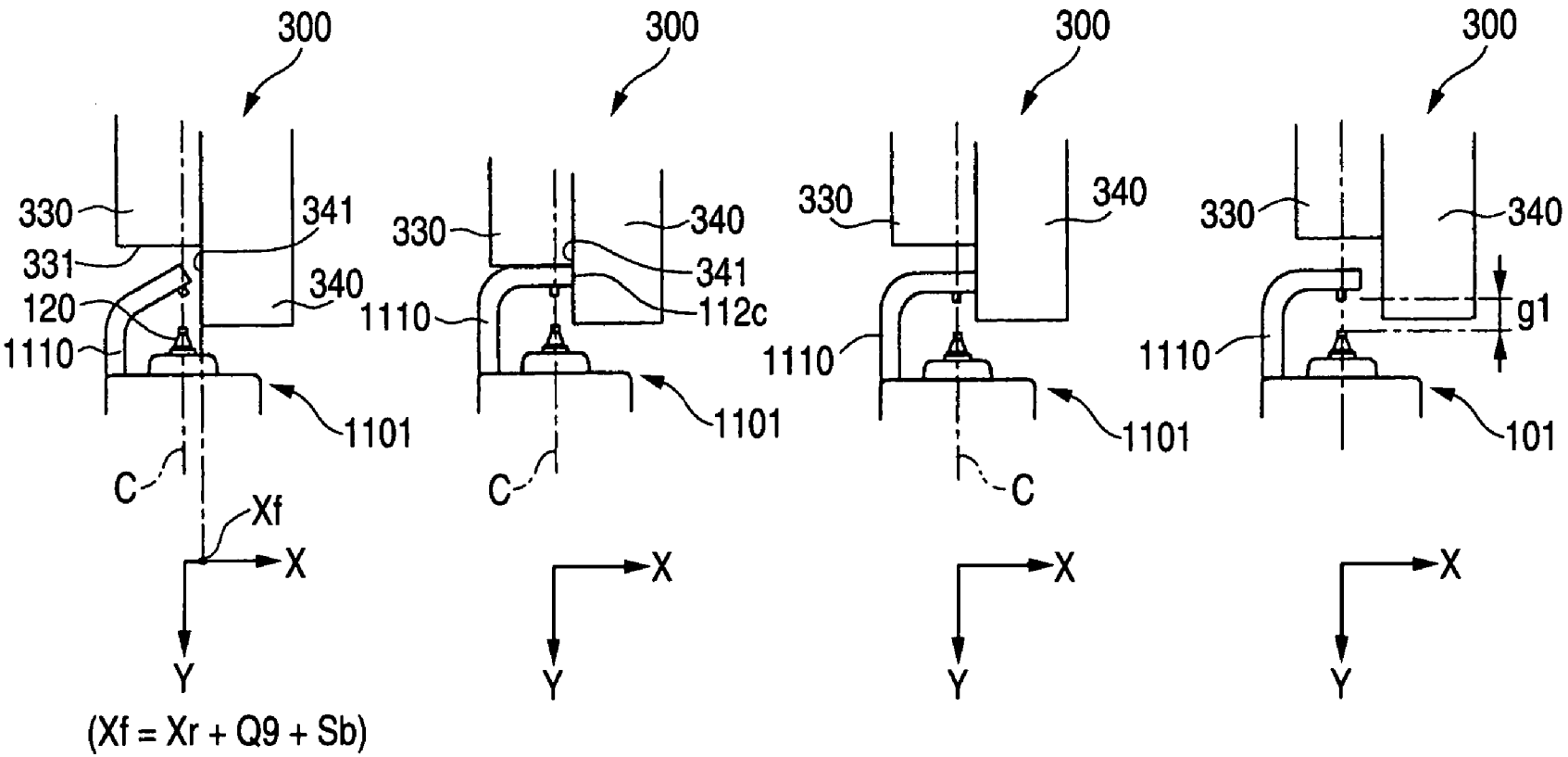
FIGS. 48A, 48B, 48C and 48D are explanatory views for explaining a regulation member positioning process, a gap forming process and a return process according to Embodiment 4.

Next, in Steps V5 and S5 (regulation member positioning step), the X-directional position of the regulation member 340 of the gap forming unit 300 is positioned. Specifically, first, the X-direction distance Q9 (distance between the front end surface 112*c* of the ground electrode 1110 and the central axis of the noble metal tip 113) measured in Step V4 and an amount Sb with which the, ground electrode 1110 is expected to spring back in the −X direction after pressure are added to the X-coordinate Xr of the center position R6 of the front end 120*b* of the center electrode 120 (noble metal tip 121) measured in Step V3 (first center electrode position measuring step), so that an X-coordinate Xf (see FIG. 48A) is calculated (Xf=Xr+Q9+Sb). The regulation member 340 is moved and fixed to a position where the X-coordinate of the regulation abutment surface 341 of the regulation member 340 satisfies Xf=Xr+Q9+Sb.

In Embodiment 4, the regulation member 340 is positioned thus. Accordingly, in the next Step S6 (gap forming step), the spark discharge gap g can be formed while the noble metal tip 113 of the ground electrode 1110 can be disposed in an X-directional position within a predetermined range with respect to the front end 120*b* of the center electrode 120 (noble metal tip 121).

After that, in the same manner as in Embodiment 3, in Step S6 (gap forming step) (see FIG. 48B), the spark discharge gap g of the work 1101 is formed. After that, in Steps S7-S8 (return step) (see FIGS. 48C-48D), the pressure member 330 and the regulation member 340 are returned to their positions before Steps S6 and V5 respectively. Thus, the spark discharge gap g whose gap size is equal to the first gap size value g1 can be formed while the X-directional position of the noble metal tip 113 of the ground electrode 1110 with respect to the front end 120*b* of the center electrode 120 (noble metal tip 121) is regulated (see FIG. 48D).

Next, in the same manner as in Embodiment 3, in Step U9 (deviation measuring step) and Step SA (deviation adjusting step) in turn, a deviation P of the noble metal tip 113 of the ground electrode 1110 with respect to the noble metal tip 121 of the center electrode 120 is measured, and the deviation P is adjusted to be within a predetermined range.

Next, in the same manner as in Embodiment 3, Step SB (second gap size measuring step), Step UC (first inter-tip distance measuring step) and Step UD (first tip angle measuring step) are carried out in that order. Thus, the gap size gm (see FIG. 25), the inter-tip distance ΔX1 (see FIGS. 35A-35B and 36A-36B) and the tip angle θ (see FIG. 40) are calculated. Next, in Step UE, it is determined whether the gap size gm, the inter-tip distance ΔX1 and the tip angle θ are within their predetermined ranges or not. When they are within the predetermined ranges, the routine of processing proceeds to Step SJ, where the work 1101 is unloaded from the carrier 211 of the linear conveyor 210 as an acceptable product.

Figure 45B:
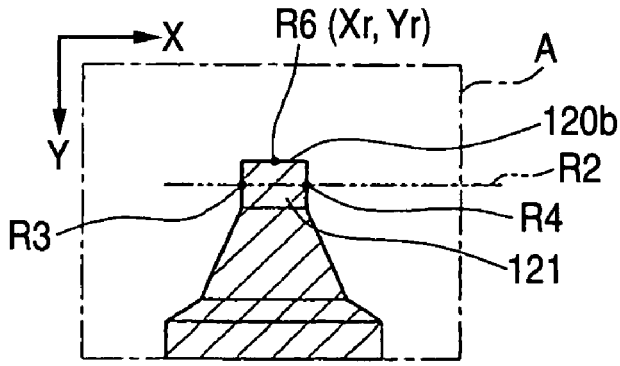

On the contrary, when the gap size gm, the inter-tip distance ΔX1 or the tip angle θ is out of its predetermined range, the routine of processing proceeds to Step VF (second center electrode position measuring step), in which the coordinates (Xr, Yr) of the center position R6 of the front of the center electrode 120 (noble metal tip 121) are measured in the same manner as in Step V3 (see FIG. 45B).

Next, in Steps VG and SF (second regulation member positioning step), the X-directional position of the regulation member 340 of the gap forming unit 300 is positioned. Specifically, first, a difference ΔXr (Xr in Step VF—Xr in Step V3) between the X-coordinate of the position R6 measured in Step V3 (first center electrode position measuring step) and the X-coordinate of the position R6 measured in Step VF (second center electrode position measuring step) is calculated. Next, the aforementioned difference ΔXr is added to the X-coordinate Xf of the regulation abutment surface 341 of the regulation member 340 set in Steps S6-S7 (first regulation member positioning step), and further the inter-tip distance ΔX1 calculated in Step UC is added thereto. Thus, an X-coordinate Xd (see FIG. 41A) is calculated (Xd=Xf+ΔXr+ΔX1). The regulation member 340 is moved and fixed to the position where the X-coordinate of the regulation abutment surface 341 of the regulation member 340 is Xd.

In Embodiment 4, the regulation member 340 is positioned thus. Accordingly, in the next step SG (gap adjusting step), the X-directional position of the noble metal tip 113 of the ground electrode 1110 with respect to the front end 120*b* of the center electrode 120 (noble metal tip 121) can be adjusted to be located within a predetermined range while the gap size is adjusted.

Next, in the same manner as in Embodiment 3, Step SG (gap adjusting step) (see FIG. 41B) and Steps SH-SI (return step) (see FIGS. 41C-41D) are carried out in that order. Thus, a spark discharge gap g whose gap size is equal to the second gap size value g2 is formed. In this event, it is also possible to adjust the X-directional position of the noble metal tip 113 of the ground electrode 1110 with respect to the front end 120*b* of the center electrode 120 (noble metal tip 121) as described above.

Next, in the same manner as in Embodiment 3, Step UJ (third gap size measuring step), Step UK (second inter-tip distance measuring step) and Step UL (second tip angle measuring step) are carried out in that order. Thus, the gap size gm, the inter-tip distance ΔX1 and the tip angle θ are calculated.

Next, in the same manner as in Embodiment 3, in Step UM, it is determined whether the gap size gm, the inter-tip distance ΔX1 and the tip angle θ are within their predetermined ranges or not. When they are within the predetermined ranges, the routine of processing proceeds to Step SJ, where the work 1101 is unloaded from the carrier 211 of the linear conveyor 210 as an acceptable product. On the contrary, when the gap size gm, the inter-tip distance ΔX1 or the tip angle θ is out of its predetermined range, the routine of processing proceeds to Step UN where the work 1101 is unloaded from the carrier 211 of the linear conveyor 210 as an inferior product.

In such a manner, the spark plug 1100 as shown in FIG. 23 is completed.

Although the present invention has been described in detail above with respect to Embodiments 1-4, it should further be apparent to those skilled in the art that various changes in form and detail of the invention as shown and described above may be made. It is intended that such changes be included within the spirit and scope of the claims appended hereto.

For example, in Embodiment 1 or the like, in Step SG (gap adjusting step), by use of the gap forming unit 300, the ground electrode 110, 1110 is pressed in the Y direction so as to adjust the gap size while the X-directional position of the front end surface 112*c* of the ground electrode 110, 1110 is regulated. However, the distance with which the ground electrode 110, 1110 is pressed in the Y direction in Step SG (gap adjusting step) is slight because the gap size is set at the first gap size value g1 slightly (e.g. 0.05 mm) larger than the second gap size value g2 in the previous Step S6, T6 (gap forming step). Therefore, the change of the X-directional position of the front end surface 112*c* of the ground electrode 110, 1110 is extremely slight. Thus, there are some cases in which the X-directional position of the front end surface 112*c* of the ground electrode 110, 1110 does not have to be regulated in Step SG (gap adjusting step) where the ground electrode 110, 1110 is pressed in the Y direction.

In Embodiment 1 or the like, Step SA (deviation adjusting step) is carried out after Step S9, U9 (deviation measuring step). However, Step SA (deviation adjusting step) may be designed not to be carried out when the deviation of the work 101, 1101 measured in Step S9, U9 (deviation measuring step) has a value within a predetermined range.

In Embodiment 1 or the like, the X-coordinate of the regulation abutment surface 341 of the regulation member 340 calculated in each of the first, and second regulation member positioning steps is used. However, the value calculated in the first regulation member positioning step may be stored so that the same value can be used in the second regulation member positioning step.

In Embodiment 1 or the like, a total of two center electrode position measuring steps are carried out before the gap forming step and before the gap adjusting step. However, the coordinates (Xg, Yg) of the right end of the center electrode measured in the first center electrode position measuring step may be stored so that the X-directional position of the regulation member can be positioned in the second regulation member positioning step using the stored coordinates (Xg, Yg) of the right end of the center electrode. In such a manner, the second center electrode position measuring step can be omitted.

Further, in Embodiment 1, 2, a deviation measuring step, a center electrode position measuring step, etc. may be carried out after the gap adjusting step in order to confirm whether the deviation value or the covering distance of the work is within a predetermined range or not. The deviation adjusting step etc. may be carried out again when such a value is not within a predetermined range.

This application is based on Japanese Patent application JP 2003-24165, filed Jan. 31, 2003, and Japanese Patent application JP 2004-19696, filed Jan. 28, 2004, the entire contents of which are hereby incorporated by reference, the same as if set forth at length.

What is claimed is:

1. A method for manufacturing a spark plug, the spark plug including:

a cylindrical insulator having an axial hole penetrating said cylindrical insulator in an axial direction thereof;

a center electrode inserted into said axial hole of said insulator and having a front end projecting beyond a front end surface of said insulator;

a metal shell surrounding said insulator; and a ground electrode fixedly attached to said metal shell by a fixation portion and bent to form a spark discharge gap between a front end portion of said ground electrode and said front end of said center electrode;

said method comprising:

measuring an X-directional position of said front end of said center electrode;

positioning an X-directional position of a regulation member based on said X-directional position of said front end of said center electrode measured in said center electrode position measuring step, said regulation member regulating an X-directional position of a front end surface of said ground electrode when said ground electrode is pressed and bent in a Y direction; and forming said spark discharge gap using said regulation member to regulate said X-directional position of said front end surface of said ground electrode while pressing and bending said ground electrode in said Y direction with a pressure member so as to form said spark discharge gap; wherein:

said X direction designates, of directions perpendicular to a central axis of said metal shell and perpendicular to a width direction of said fixation portion of said ground electrode, a direction from said fixation portion of said ground electrode toward said central axis of said metal shell; and said Y direction designates a direction from a front end side of said internal combustion spark plug to a base side thereof along said central axis of said metal shell, wherein said regulation member positioning step comprises positioning said X-directional position of said regulation member so that said front end surface of said ground electrode will be located within a deviation range deviating from its predetermined position in said X direction with respect to said front end of said center electrode once said gap forming step has been completed, wherein said deviation range is ±0.1 mm, wherein said regulation member has a regulation abutment surface which abuts against said front end surface of said ground electrode in said gap forming step, and wherein said regulation member moves together with the pressure member when the pressure member presses said ground electrode to bend said ground electrode in the Y-direction.

2. The method as claimed in claim 1, wherein:

in said gap forming step, an X-directional position of said regulation abutment surface of said regulation member is fixed at least by the time that said spark discharge gap is formed after said ground electrode has been pressed.

3. The method as claimed in claim 1, wherein:

said gap forming step comprises moving said regulation abutment surface of said regulation member in said X direction together with said front end surface of said ground electrode while abutting against said front end surface of said ground electrode when said ground electrode is pressed and bent in said Y direction, so that said X-directional position of said regulation abutment surface is fixed before said spark discharge gap is formed.

4. The method as claimed in claim 1, further comprising:

returning said regulation member to a position before said regulation member positioning step, said returning step being carried out after said gap forming step;

said returning step includes moving said regulation member abutting against said ground electrode, in a direction including an X-directional component, so as to separate said regulation member and said ground electrode from each other.

5. The method as claimed in claim 1, wherein:

said gap forming step comprises pressing and bending said ground electrode in said Y direction with said pressure member having a pressure abutment surface abutting against said ground electrode; and said pressure abutment surface of said pressure member is surface-treated such that a coefficient of friction between said pressure abutment surface of said pressure member and said ground electrode abutment surface of said ground electrode is not higher than 0.2.

6. The method as claimed in claim 5, wherein said pressure abutment surface is coated with a DLC film (diamond-like carbon film).

7. The method as claimed in claim 1, further comprising:

measuring a Z-directional deviation of said front end surface of said ground electrode with respect to said front end of said center electrode, said deviation measuring step being carried out after said gap forming step or said returning step; and adjusting said Z-directional position of said front end surface of said ground electrode based on said deviation measured in said deviation measuring step, so that said front end surface of said ground electrode is located within a predetermined range in said Z direction with respect to said front end of said center electrode; wherein:

said Z direction designates a direction perpendicular to said central axis of said metal shell and perpendicular to said X direction.

8. The method as claimed in claim 7, further comprising:

measuring a gap size of said spark discharge gap after said deviation adjusting step; and adjusting the size of said spark discharge gap by regulating said X-directional position of said front end surface of said ground electrode while pressing and bending said ground electrode in said Y direction to thereby adjust said gap size within a predetermined range based on said gap size measured in said gap size measuring step.

9. The method as claimed in claim 1, wherein said ground electrode includes a noble metal tip formed at the front end portion of the ground electrode, said noble metal tip projecting toward said center electrode.

* * * * *